US009211700B1

(12) United States Patent
Sato et al.

(10) Patent No.: US 9,211,700 B1
(45) Date of Patent: Dec. 15, 2015

(54) LIQUID EJECTING APPARATUS, METHOD OF CONTROLLING LIQUID EJECTING APPARATUS, AND PROGRAM FOR CONTROLLING LIQUID EJECTING APPARATUS

(71) Applicant: SEIKO EPSON CORPORATION, Tokyo (JP)

(72) Inventors: Akito Sato, Nagano (JP); Yuko Yamamoto, Nagano (JP); Yuichi Yoneyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/749,997

(22) Filed: Jun. 25, 2015

(30) Foreign Application Priority Data

Jun. 26, 2014 (JP) ..... 2014-131190

(51) Int. Cl.
*B41J 29/38* (2006.01)
*B41J 2/045* (2006.01)
*B41J 2/21* (2006.01)

(52) U.S. Cl.
CPC ..... *B41J 2/04508* (2013.01); *B41J 2/04586* (2013.01); *B41J 2/21* (2013.01)

(58) Field of Classification Search
CPC .. B41J 29/393; B41J 2/04593; B41J 2/04596; B41J 2/04541; B41J 2/21
USPC ..... 347/9–12, 19, 40
See application file for complete search history.

(56) References Cited

U.S. PATENT DOCUMENTS 7,766,442 B2 * 8/2010 Yamanobe ..... B41J 2/04508 347/14
8,322,814 B2 * 12/2012 Hirato ..... B41J 2/0451 347/10
8,801,132 B2 * 8/2014 Ohnishi ..... B41J 2/2128 347/14

FOREIGN PATENT DOCUMENTS

JP 2004-174816 A 6/2004

* cited by examiner

*Primary Examiner* — An Do
(74) *Attorney, Agent, or Firm* — Global IP Counselors, LLP

(57) ABSTRACT

A apparatus including a head unit that includes first nozzles which eject a first liquid, second nozzles which eject a second liquid, third nozzles which eject a third liquid; and a control unit that controls driving of the head unit, in which, when an amount of the first liquid to be ejected from the first nozzles in order to form an image on the medium is a first ejection amount and an ejection state of the liquid ejected from the first nozzles is abnormal, the control unit increases the amount of the second liquid ejected from the second nozzles by a second ejection amount which is smaller than the first ejection amount and increases the amount of the third liquid ejected from the third nozzles by a third ejection amount which is smaller than the first ejection amount instead of allowing the first nozzles to eject the first liquid.

7 Claims, 29 Drawing Sheets

TEST VALUE AND CALCULATED VALUE OF RESIDUAL VIBRATION (DRYING)

FIG. 15

| SI (b1, b2, b3) | Ts1 | | | Ts2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

FIG. 21

| Flag | Tc (CONTENTS TO BE COMPARED) | Rs |
|---|---|---|
| 1 | Tc < Tth1 | 2: EJECTION ABNORMALITY (BUBBLE) |
| | Tth1 ≤ Tc ≤ Tth2 | 1: NORMAL |
| | Tth2 < Tc ≤ Tth3 | 3: EJECTION ABNORMALITY (PAPER DUST) |
| | Tth3 < Tc | 4: EJECTION ABNORMALITY (THICKENING) |
| 0 | N/A | 5: EJECTION ABNORMALITY |

FIG. 24

TBL

[UNIT: ng]

| Q-TG | EJECTION AMOUNT BEFORE COMPLEMENTATION IN N-D (N-CY, N-MG, N-YL) | EJECTION AMOUNT AFTER COMPLEMENTATION IN N-D | | | Q-D (REFERENCE) | |
|---|---|---|---|---|---|---|
| | | N-CY | N-MG | N-YL | | |
| 30 (LARGE DOTS) | 30 | 30 | 30 | 30 | 0 | ← SECOND EXCEPTION |
| | 20 | 30 | 30 | 30 | 10 | |
| | 10 | 30 | 30 | 30 | 20 | |
| | 0 | 20 | 20 | 20 | 20 | |
| 20 (MEDIUM DOTS) | 30 | 30 | 30 | 30 | 0 | ← SECOND EXCEPTION |
| | 20 | 30 | 30 | 30 | 10 | |
| | 10 | 20 | 20 | 20 | 10 | |
| | 0 | 10 | 10 | 10 | 10 | |
| 10 (SMALL DOTS) | 30 | 30 | 30 | 30 | 0 | ← FIRST EXCEPTION |
| | 20 | 20 | 20 | 20 | 0 | ← FIRST EXCEPTION |
| | 10 | 10 | 10 | 10 | 0 | ← FIRST EXCEPTION |
| | 0 | 0 | 0 | 0 | 0 | ← FIRST EXCEPTION |
| 0 (NON-RECORDING) | 30 | 30 | 30 | 30 | 0 | |
| | 20 | 20 | 20 | 20 | 0 | |
| | 10 | 10 | 10 | 10 | 0 | |
| | 0 | 0 | 0 | 0 | 0 | |

FIG. 25

TBL

[UNIT: ng]

| Q-TG | EJECTION AMOUNT BEFORE COMPLEMENTATION IN N-D (N-CY N-MG N-YL) | EJECTION AMOUNT AFTER COMPLEMENTATION IN N-D | | | Q-D (REFERENCE) |
|---|---|---|---|---|---|
| | | N-CY | N-MG | N-YL | |
| 30 (LARGE DOTS) | 30 | 35 | 35 | 35 | 5 |
| | 20 | 30 | 30 | 30 | 10 |
| | 10 | 30 | 30 | 30 | 20 |
| | 0 | 20 | 20 | 20 | 20 |
| 20 (MEDIUM DOTS) | 30 | 35 | 35 | 35 | 5 |
| | 20 | 30 | 30 | 30 | 10 |
| | 10 | 20 | 20 | 20 | 10 |
| | 0 | 10 | 10 | 10 | 10 |
| 10 (SMALL DOTS) | 30 | 35 | 35 | 35 | 5 |
| | 20 | 25 | 25 | 25 | 5 |
| | 10 | 15 | 15 | 15 | 5 |
| | 0 | 5 | 5 | 5 | 5 |
| 0 (NON-RECORDING) | 30 | 30 | 30 | 30 | 0 |
| | 20 | 20 | 20 | 20 | 0 |
| | 10 | 10 | 10 | 10 | 0 |
| | 0 | 0 | 0 | 0 | 0 |

FIG. 26

TBL

[UNIT: ng]

| Q-TG | EJECTION AMOUNT BEFORE COMPLEMENTATION IN N-D (N-CY N-MG N-YL) | EJECTION AMOUNT AFTER COMPLEMENTATION IN N-D | | | Q-D (REFERENCE) | |
|---|---|---|---|---|---|---|
| | | N-CY | N-MG | N-YL | | |
| 30 (LARGE DOTS) | 30 | 30 | 30 | 30 | 0 | SECOND EXCEPTION |
| | 20 | 30 | 30 | 30 | 10 | |
| | 10 | 30 | 30 | 30 | 20 | |
| | 0 | 20 | 20 | 20 | 20 | |
| 20 (MEDIUM DOTS) | 30 | 30 | 30 | 30 | 0 | SECOND EXCEPTION |
| | 20 | 30 | 30 | 30 | 10 | |
| | 10 | 20 | 20 | 20 | 10 | |
| | 0 | 10 | 10 | 10 | 10 | |
| 10 (SMALL DOTS) | 30 | 30 | 30 | 30 | 0 | FIRST EXCEPTION |
| | 20 | 30 | 30 | 30 | 10 | THIRD EXCEPTION |
| | 10 | 20 | 20 | 20 | 10 | THIRD EXCEPTION |
| | 0 | 10 | 10 | 10 | 10 | THIRD EXCEPTION |
| 0 (NON-RECORDING) | 30 | 30 | 30 | 30 | 0 | |
| | 20 | 20 | 20 | 20 | 0 | |
| | 10 | 10 | 10 | 10 | 0 | |
| | 0 | 0 | 0 | 0 | 0 | |

LIQUID EJECTING APPARATUS, METHOD OF CONTROLLING LIQUID EJECTING APPARATUS, AND PROGRAM FOR CONTROLLING LIQUID EJECTING APPARATUS

This application claims priority to Japanese Patent Application No. 2014-131190 filed on Jun. 26, 2014. The entire disclosure of Japanese Patent Application No. 2014-131190 is hereby incorporated herein by reference.

BACKGROUND

1. Technical Field

The present invention relates to a liquid ejecting apparatus, a method of controlling a liquid ejecting apparatus, and a program for controlling a liquid ejecting apparatus.

2. Related Art

In a liquid ejecting apparatus such as a line printer that forms an image on a medium by ejecting an ink from a nozzle, there is a case in which the ink is not normally ejected from the nozzle due to thickening of the ink. When ejection abnormality which is a state in which an ink is not normally ejected from a nozzle, that is, the ejection state of the ink from the nozzle becomes abnormal occurs, dots which are expected to be formed by the ink ejected from the nozzle are not formed and the quality of an image formed on a medium is degraded. In order to prevent degradation of the image quality caused by dot omission, techniques related to different-color complementation in which, in a case where ejection abnormality occurs in one nozzle ejecting an ink having one color, one nozzle is complemented with another nozzle by increasing the amount of an ink ejected from another nozzle that ejects an ink having a color different from the one color instead of allowing the one nozzle to eject an ink have been suggested.

For example, JP-A-2004-174816 discloses a technique of mixing three colors of cyan, magenta, and yellow and recording black by ejecting inks from three nozzles which are a nozzle ejecting a cyan ink, a nozzle ejecting a magenta ink, and a nozzle ejecting a yellow ink in a case where ejection abnormality occurs in a nozzle ejecting a black ink and black dots cannot be formed on a medium.

However, in a case where a nozzle having ejection abnormality is complemented with another one when the color of an image to be formed on the medium is changed, the image quality of an image to be formed on a medium is degraded. Due to this, in order to minimize the degradation of the image quality caused by complementation, it is necessary to minimize the extent of a change in color of an image caused by complementation.

In different-color complementation, one nozzle ejecting an ink having one color is complemented with a nozzle ejecting an ink having a color different from the one color. For this reason, in order to minimize the extent of the change in color of an image caused by complementation, one color (or a color close to the one color) needs to be reproduced by mixing a plurality of colors by complementing the one nozzle ejecting an ink having the one color with a plurality of nozzles ejecting inks having colors different from one another.

In the case where one nozzle is complemented with a plurality of nozzles, a plurality of dots formed by the plurality of nozzles are recorded instead of one dot to be formed by the one nozzle. In this case, there is a possibility that an ink with an amount larger than the amount which can be accepted by a medium is ejected onto the medium. In the case where an ink with an amount larger than the amount which can be accepted by the medium is ejected, wavy wrinkles or cockling is generated on the medium or an ink which has not been accepted by the medium is diffused on the surface or the inside of the medium and then bleeding of the ink occurs. When such cockling of a medium or bleeding of an ink occurs, the image quality of an image formed on the medium is degraded.

SUMMARY

An advantage of some aspects of the invention is to provide a technique of forming an image having the image quality, on a medium, to the extent of not being inferior to an image to be formed when ejection abnormality has not occurred in a case of complementing a nozzle in which ejection abnormality has occurred with a nozzle having a color different from the color of the nozzle at the time when an image is formed on the medium.

According to an aspect of the invention, there is provided a liquid ejecting apparatus that ejects a liquid onto a medium from a nozzle and forms an image on the medium, the apparatus including: a head unit that includes a first nozzle group including first nozzles which eject a liquid having a first color, a second nozzle group including second nozzles which eject a liquid having a second color, and a third nozzle group including third nozzles which eject a liquid having a third color; and a control unit that controls driving of the head unit, in which, when an amount of the liquid having the first color to be ejected from the first nozzles in order to form an image on the medium is a first ejection amount and an ejection state of the liquid ejected from the first nozzles is abnormal, the control unit increases the amount of the liquid having the second color ejected from the second nozzles by a second ejection amount which is smaller than the first ejection amount and increases the amount of the liquid having the third color ejected from the third nozzles by a third ejection amount which is smaller than the first ejection amount instead of allowing the first nozzles to eject the liquid having the first color.

According to the the aspect of the invention, since the second ejection amount is adjusted to be smaller than the first ejection amount and the third ejection amount is adjusted to be smaller than the first ejection amount, it is possible to reduce the total amount of a liquid to be ejected to the medium compared to a case where the second ejection amount is equal to or larger than the first ejection amount or the third ejection amount is equal to or larger than the first ejection amount. For this reason, by reducing the possibility of ejection of a liquid having an amount larger than the amount which can be accepted by a medium onto the medium, it is possible to suppress the possibility of various inconveniences, which occur when a liquid having an amount larger than the amount which can be accepted by a medium is ejected onto the medium, for example, wavy cockling being generated on a medium or bleeding of a liquid caused by a liquid which has not been accepted by a medium being diffused on the surface or in the inside of the medium.

In this manner, even in a case where so-called different-color complementation is performed by increasing the amount of the liquid having the second color to be ejected from the second nozzle and increasing the amount of the liquid having the third color to be ejected from the third nozzle instead of allowing the first nozzle to eject the liquid having the first color, it becomes possible to minimize the extent of degradation in the image quality caused by complementation.

In addition, the case where the ejection state of a liquid ejected from a nozzle is abnormal includes a case where a liquid cannot be ejected from a nozzle and a case where an ejecting direction of a liquid from a nozzle is different from an original ejecting direction, and, in other words, means a case where a liquid cannot be normally ejected from a nozzle.

Moreover, increasing the amount of a liquid to be ejected from a nozzle means ejecting a larger amount of liquid than expected to be ejected from the nozzle in order to form an image on the medium and ejecting a liquid from the nozzle for performing complementation with respect to one nozzle although the nozzle is expected not to eject a liquid in forming an image on the medium.

The liquid ejecting apparatus may further include a transport mechanism that transports the medium in the first direction, in which the first nozzle group may be provided in a first area which extends in a second direction intersecting the first direction in the head unit, the second nozzle group provided in a second area, which extends in the second direction, in the head unit, and the third nozzle group may be provided in a third area, which extends in the second direction, in the head unit.

In a liquid ejecting apparatus such as a line printer in which a direction where a medium is transported (first direction) intersects a direction where an area in which a plurality of nozzles constituting a nozzle group are provided (second direction) is extended, dots formed by a liquid ejected from respective nozzles are linearly arranged in the direction where the medium is transported (first direction). For this reason, in a case where ejection abnormality in which the ejection state of a liquid ejected from a nozzle becomes abnormal occurs and dots are not formed in a position corresponding to the nozzle, for example, a linear white stripe extending in the first direction is formed on the medium and the image quality of an image to be formed on the medium is largely degraded.

Since the liquid ejecting apparatus according to the aspect complements the first nozzle with the second nozzle and the third nozzle when ejection abnormality occurs in the first nozzle, it is possible to minimize the possibility of formation of a white stripe or the like which largely degrades the image quality of an image to be formed on the medium compared to a case where the complementation is not performed.

In the liquid ejecting apparatus, the liquid having the first color may absorb visible light in a first wavelength region at a predetermined rate or more, the liquid having the second color may absorb visible light in a second wavelength region at the predetermined rate or more, the liquid having the third color may absorb visible light in a third wavelength region at the predetermined rate or more, a part of the first wavelength region overlaps at least a part of the second wavelength region, and at least a part of the first wavelength region from which the second wavelength region may be excluded overlaps at least a part of the third wavelength region.

In the liquid ejecting apparatus according to the aspect, images are formed on the medium using a liquid having the first to third colors such that a first overlapping wavelength region in which the first wavelength region overlaps the second wavelength region is present, a second overlapping wavelength region in which the first wavelength region overlaps the third wavelength region is present, and a difference wavelength region is present which is included in one of the first overlapping wavelength region and the second overlapping wavelength region and not included in the other region. For this reason, a color close to the first color can be reproduced using the liquid having the second color and the liquid having the third color compared to a case where the first overlapping wavelength region is not present, a case where the second overlapping wavelength region is not present, or a case where the difference wavelength region is not present. In this manner, it is possible to minimize the extent of the change in color of an image caused by complementation and to minimize degradation of the image quality caused by complementation.

In the liquid ejecting apparatus, in which the liquid having the first color may absorb visible light in a first wavelength region at a predetermined rate or more, the liquid having the second color may absorb visible light in a second wavelength region at the predetermined rate or more, and the liquid having the third color may absorb visible light in a third wavelength region at the predetermined rate or more, the control unit may adjust the second ejection amount to be larger than the third ejection amount when a wavelength region in which the first wavelength region overlaps the second wavelength region is wider than a wavelength region in which the first wavelength region overlaps the third wavelength region.

In the liquid ejecting apparatus according to the aspect, in a case where the first overlapping wavelength region in which the first wavelength region overlaps the second wavelength region is wider than the second overlapping wavelength region in which the first wavelength region overlaps the third wavelength region, the second ejection amount related to the liquid having the second color that absorbs light in the second wavelength region is adjusted to be larger than the third ejection amount related to the liquid having the third color that absorbs light in the third wavelength region. Accordingly, in the liquid ejecting apparatus according to the aspect, a color close to the first color can be reproduced using the liquid having the second color and the liquid having the third color compared to a case where the second ejection amount is adjusted to be equal to or smaller than the third ejection amount in the case where the first overlapping wavelength region is larger than the second overlapping wavelength region. In this manner, it is possible to minimize the extent of the change in color of an image caused by complementation and to minimize degradation of the image quality caused by complementation.

In the liquid ejecting apparatus, in which the control unit may adjust the second ejection amount to be larger than the third ejection amount when the weight ratio of a coloring material contained in the liquid having the second color being occupied in the liquid having the second color is smaller than the weight ratio of a coloring component contained in the liquid having the third color being occupied in the liquid having the third color.

In the liquid ejecting apparatus according to the aspect, since the ejection amount of the liquid having the second color and the liquid having the third color is determined according to the weight ratio of coloring components contained in the liquid having the second color and the liquid having the third color, a color close to the first color can be reproduced using the liquid having the second color and the liquid having the third color compared to a case where the weight ratio of the coloring components is not considered. In this manner, it is possible to minimize the extent of the change in color of an image caused by complementation and to minimize degradation of the image quality caused by complementation.

According to another aspect of the invention, there is provided a method of controlling a liquid ejecting apparatus that includes a head unit that includes a first nozzle group including first nozzles which eject a liquid having a first color, a second nozzle group including second nozzles which eject a liquid having a second color, and a third nozzle group including third nozzles which eject a liquid having a third color, the method including: increasing, when an amount of the liquid having the first color to be ejected from the first nozzles in order to form an image on the medium is a first ejection amount and an ejection state of the liquid ejected from the first nozzles is abnormal, the amount of the liquid having the second color ejected from the second nozzles by a second ejection amount which is smaller than the first ejection amount and increasing the amount of the liquid having the third color ejected from the third nozzles by a third ejection amount which is smaller than the first ejection amount instead of allowing the first nozzles to eject the liquid having the first color.

According to the aspect of the invention, since the total amount of the liquid ejected onto the medium can be reduced compared to a case where the second ejection amount is equal to or larger than the first ejection amount or a case where the third ejection amount is equal to or larger than the first ejection amount, it is possible to suppress the possibility of degradation of the image quality caused by ejection of a liquid having an amount larger than the amount which can be accepted by the medium onto the medium by reducing the possibility of ejection of the liquid having an amount larger than the amount which can be accepted by the medium onto the medium.

According to still another aspect of the invention, there is provided a program for controlling a liquid ejecting apparatus includes a first nozzle group including first nozzles which eject a liquid having a first color, a second nozzle group including second nozzles which eject a liquid having a second color, a third nozzle group including third nozzles which eject a liquid having a third color, and a computer, the program causing the computer to function as: a control unit that increases, when an amount of the liquid having the first color to be ejected from the first nozzles in order to form an image on the medium is a first ejection amount and an ejection state of the liquid ejected from the first nozzles is abnormal, the amount of the liquid having the second color ejected from the second nozzles by a second ejection amount which is smaller than the first ejection amount and increases the amount of the liquid having the third color ejected from the third nozzles by a third ejection amount which is smaller than the first ejection amount instead of allowing the first nozzles to eject the liquid having the first color.

According to the aspect of the invention, since the total amount of the liquid ejected onto the medium can be reduced compared to a case where the second ejection amount is equal to or larger than the first ejection amount or a case where the third ejection amount is equal to or larger than the first ejection amount, it is possible to suppress the possibility of degradation of the image quality caused by ejection of a liquid having an amount larger than the amount which can be accepted by the medium onto the medium by reducing the possibility of ejection of the liquid having an amount larger than the amount which can be accepted by the medium onto the medium.

BRIEF DESCRIPTION OF THE DRAWINGS

The invention will be described with reference to the accompanying drawings, wherein like numbers reference like elements.

FIG. 15 is an explanatory diagram illustrating decoded contents of a decoder.

FIG. 21 is an explanatory diagram for describing a determination result signal generated by an ejection state determining unit.

FIG. 24 is an explanatory diagram illustrating an example of a data structure of a printing signal conversion table.

FIG. 25 is an explanatory diagram illustrating an example of a data structure of a printing signal conversion table.

FIG. 26 is an explanatory diagram illustrating an example of a data structure of a printing signal conversion table.

DESCRIPTION OF EXEMPLARY EMBODIMENTS

Hereinafter, embodiments for implementing the present invention will be described with reference to the drawings. However, throughout the drawings, dimensions and scales of the respective parts are appropriately different from those of actual parts. Moreover, since embodiments described herein are preferred concrete examples of the present invention, the embodiments are provided with various limitations that are technologically preferred, but the scope of the present invention is not limited to the embodiments unless there is a particularly disclosure which limits the present invention in the following description.

A. FIRST EMBODIMENT

In the present embodiment, an ink jet printer (an example of a "liquid ejecting apparatus") will be described by exemplifying an ink jet printer which is included in a printing system and ejects an ink (an example of a "liquid") to form an image on recording paper P (an example of a "medium").

1. Outline of Printing System

Figure 1:
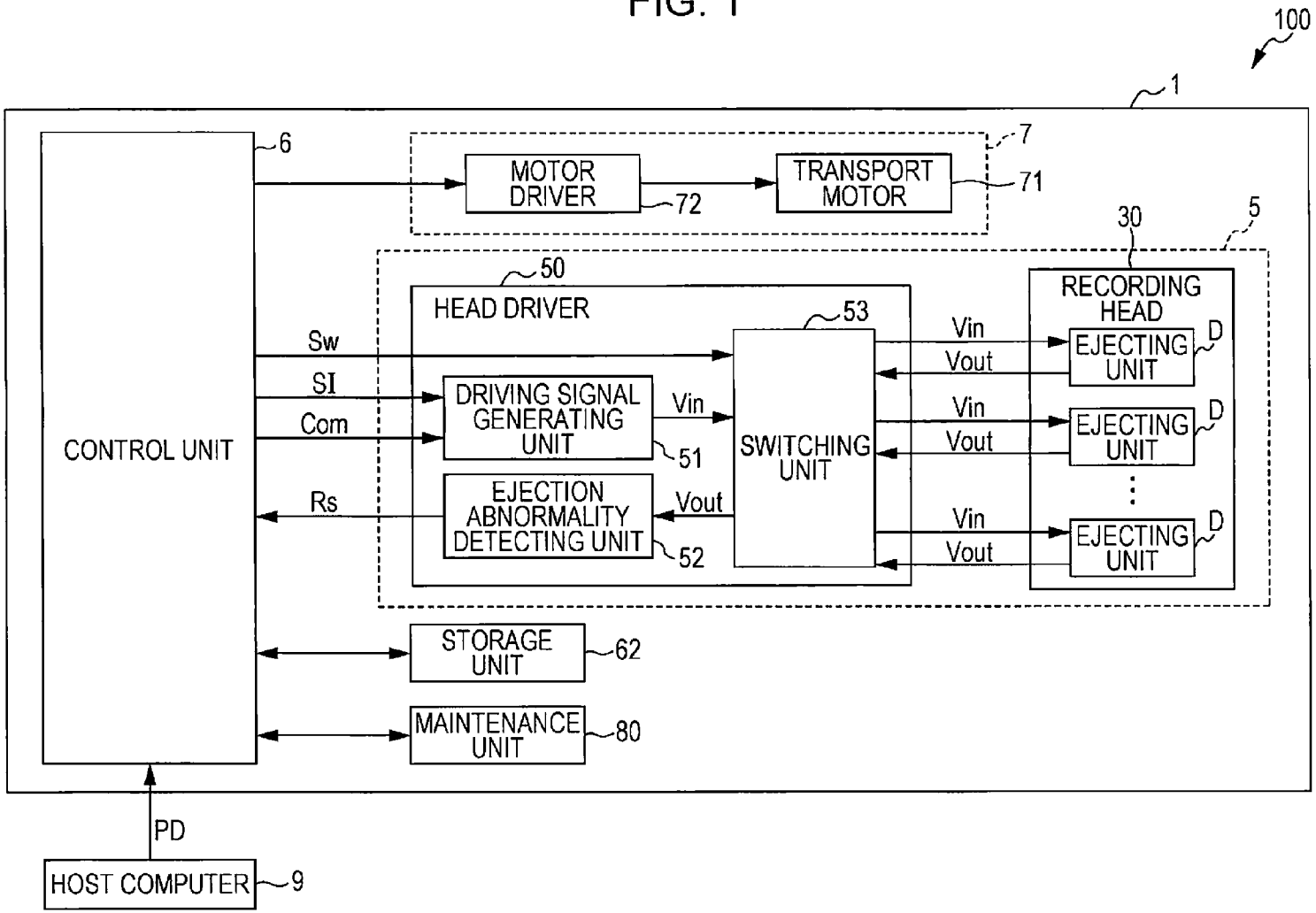
FIG. 1 is a block diagram illustrating the outline of a configuration of a printing system according to a first embodiment of the invention.

FIG. 1 is a block diagram illustrating a configuration of a printing system 100.

As illustrated in FIG. 1, the printing system 100 according to the present embodiment includes an ink jet printer 1 that performs a printing process of forming an image by ejecting an ink onto the recording paper P and a host computer 9 that generates print data PD showing an image to be formed (printed) by the ink jet printer 1. Further, in the present embodiment, the description will be made with the assumption that the ink jet printer 1 is a line printer.

The host computer 9 is a personal computer or a digital camera and generates print data PD that shows an image to be formed by the ink jet printer 1 and supplies the generated print data PD to the ink jet printer 1.

1.1. Configuration of Ink Jet Printer

The configuration of the ink jet printer 1 according to the embodiment will be described with reference to FIGS. 1 and 2.

FIG. 1 is a functional block diagram illustrating the configuration of the ink jet printer 1. FIG. 2 is a cross-sectional view schematically illustrating the internal configuration of the ink jet printer 1.

As illustrated in FIG. 1, the ink jet printer 1 includes a head unit 5 for which an ejection unit D ejecting an ink is provided; a transport mechanism 7 for changing a relative position of the recording paper P with respect to the head unit 5; a control unit 6 that controls operations of respective units of the ink jet printer 1; a storage unit 62 that stores a control program of the ink jet printer 1 or various pieces of information; and a maintenance unit 80 that performs a maintenance process for recovering the ejection state of an ink in the ejection unit D into a normal state in a case where ejection abnormality is detected in the ejection unit D.

Here, ejection abnormality is a general term for a state in which an ink is abnormally ejected from a nozzle N (see FIGS. 3 and 4 described below) included in the ejection unit D, that is, a state in which the ejection unit D is not capable of accurately ejecting an ink from the nozzle N.

More specifically, the ejection abnormality includes a state in which the ejection unit D cannot eject an ink; a state in which the ejection unit D cannot eject an ink of an amount necessary for forming an image shown by the print data PD because the amount of an ink to be ejected is small even when the ink can be ejected from the ejection unit D; and a state in which an ink of an amount more than necessary for forming an image shown by the print data PD is ejected from the ejection unit D; and a state in which an ink ejected from the ejection unit D is impacted at a position different from the impact position prepared for forming an image shown by the print data PD.

Further, the maintenance process is a general term including a wiping process of wiping foreign matters such as paper dust or the like adhered to the vicinity of the nozzle N of the ejection unit D using a wiper (not illustrated); a flushing process of allowing an ink to be preliminarily ejected from the ejection unit D; a pumping process of absorbing an ink which has thickened in the ejection unit D or bubbles using a tube pump (not illustrated); and a process of retuning the ejection state of an ink of the ejection unit D into a normal state.

Figure 2:
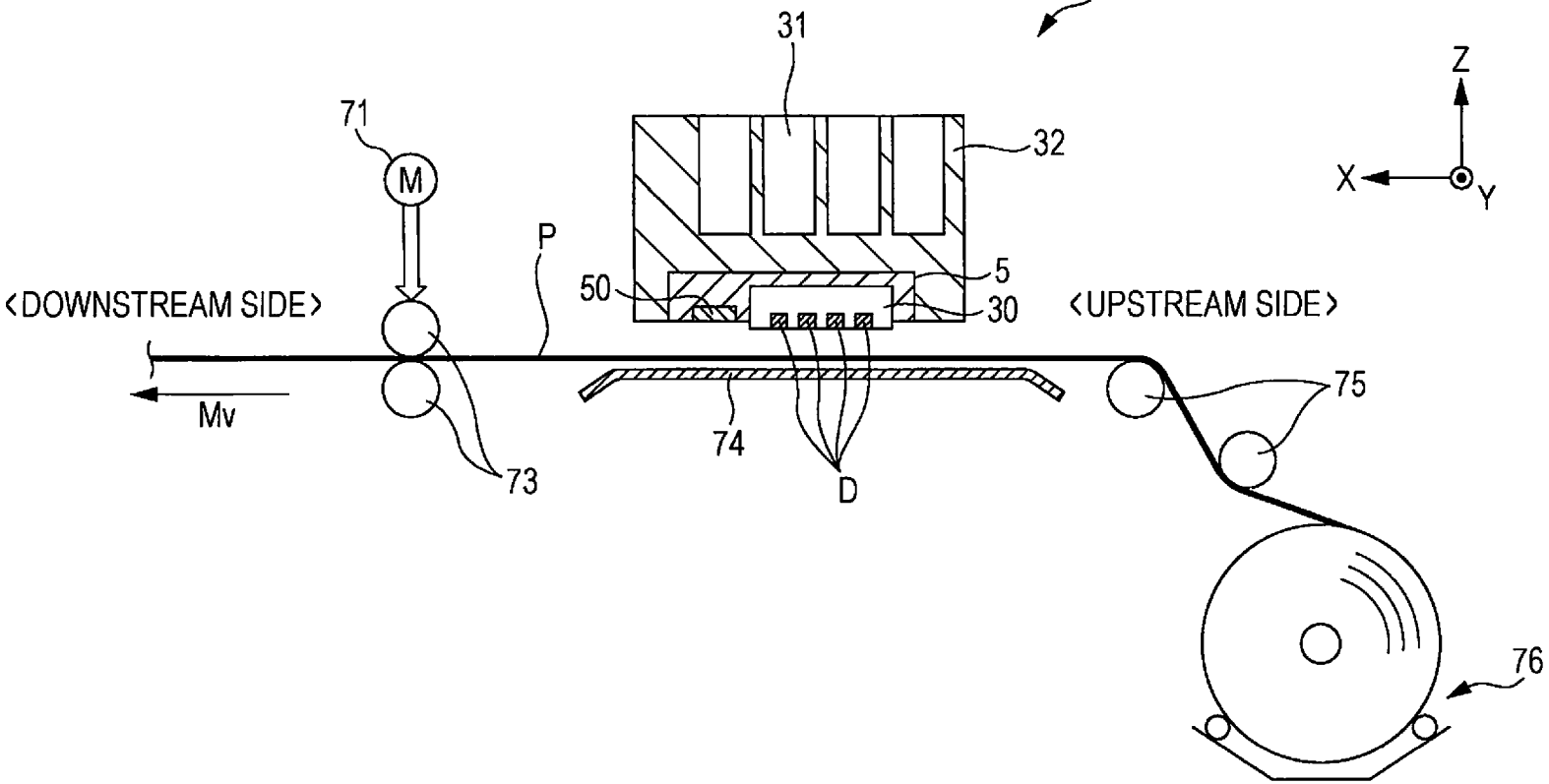
FIG. 2 is a partial cross-sectional view schematically illustrating an ink jet printer.

As illustrated in FIG. 2, the ink jet printer 1 includes a carriage 32 on which the head unit 5 is mounted. Four ink cartridges 31 are mounted on the carriage 32 in addition to the head unit 5.

Four ink cartridges 31 are provided in a one-to-one correspondence with four colors (CMYK) of black (BK), cyan (CY), magenta (MG), and yellow (YL) and the respective ink cartridges 31 are filled with inks of colors corresponding to the ink cartridges 31.

In addition, each of the ink cartridges 31 may be provided in a different area of the ink jet printer 1 instead of being mounted on the carriage 32.

As illustrated in FIG. 1, the transport mechanism 7 includes a transport motor 71 serving as a driving source for transporting the recording paper P and a motor driver 72 for driving the transport motor 71.

Further, as illustrated in FIG. 2, the transport mechanism 7 includes a platen 74 provided on the lower side (−Z direction in FIG. 4) of the carriage 32; a transport roller 73 rotating by the operation of the transport motor 71; a guide roller 75 provided so as to be freely rotatable around a Y axis in FIG. 2; and a storing unit 76 that stores the recording paper P in a state of winding the recording paper in a roll shape.

The transport mechanism 7 transports the recording paper P to a +X direction (to the downstream side from the upstream side) in the figure along a transport path regulated by the guide roller 75, the platen 74, and the transport roller 73 after the recording paper P is drawn out from the storing unit 76. In the present embodiment, the transport mechanism 7 transports the recording paper P to the +X direction (an example of a "first direction") at a transporting speed My in a case where the ink jet printer 1 performs the printing process.

The storage unit 62 includes an electrically erasable programmable read-only memory (EEPROM) which is a kind of non-volatile semiconductor memory that stores the print data PD supplied from the host computer 9, a random access memory (RAM) that temporarily stores data required to perform various processes such as a printing process and the like and temporarily develops a control program for executing various processes such as a printing process and the like, and a PROM which is a kind of non-volatile semiconductor memory that stores the control program for controlling respective units of the ink jet printer 1.

The control unit 6 includes the CPU or a field-programmable gate array (FPGA) and controls operations of respective units of the ink jet printer 1 by the CPU or the like being operated according to a control program stored in the storage unit 62.

Specifically, the control unit 6 controls execution of the printing process of forming an image on the recording paper P according to the print data PD by controlling the head unit 5 and the transport mechanism 7 based on the print data PD supplied from the host computer 9.

More specifically, the control unit 6 stores the print data PD and the printing mode data MD supplied from the host computer 9 in the storage unit 62. Next, the control unit 6 generates signals such as a printing signal SI and a driving waveform signal Com for driving the ejection unit D by controlling the operation of the head unit 5 based on various kinds of data stored in the storage unit 62 such as print data PD. Further, the control unit 6 generates the printing signal SI or signals for controlling the operation of the motor driver 72 based on the various kinds of data stored in the storage unit 62 and outputs the generated various signals. In addition, the driving waveform signals Com include driving waveform signals Com-A, Com-B, and Com-C according to the present embodiment and details will be described below.

As described above, the control unit 6 drives the transport motor 71 such that the recording paper P is transported to the +X direction by controlling the motor driver 72 and controls presence of ink ejection from the ejection unit D, the amount of an ink to be ejected, and the timing of ejecting an ink by controlling the head unit 5. In this manner, the control unit 6 adjusts the size and the arrangement of dots to be formed by the ink ejected on the recording paper P and controls execution of the printing process of forming an image corresponding to the print data PD on the recording paper P.

Moreover, the control unit 6 controls execution of various processes such as a complementing process, and an ejection state determining process in addition to the printing process and the above-described maintenance process.

Although the details will be described below, the complementing process is a process of complementing one ejection unit D with another ejection unit D which is different from the one ejection unit D in a case where ejection abnormality occurs in the one ejection unit D. More specifically, the complementing process is a process of complementing the one ejection unit D with another ejection unit D (allowing another ejection unit D to substitute the role of the one ejection unit D) by increasing the amount of an ink to be ejected from another ejection unit D different from the one ejection unit D instead of allowing the one ejection unit D to eject an ink. The control unit 6 is capable of continuously performing the printing process by controlling operation of respective units of the ink jet printer 1 such that the complementing process is performed without stopping the printing process and performing the maintenance process even when the ejection abnormality occurs.

Further, although the details will be described below, the ejection state determining process is a process of determining whether the ejection state of an ink ejected from each ejection unit D is normal.

Hereinafter, complementing one ejection unit D having one nozzle N with another ejection unit D having another nozzle N is referred to as "complementing one nozzle N with another nozzle N." In addition, the occurrence of ejection abnormality in one ejection unit D having one nozzle N is simply expressed as "ejection abnormality occurs in one nozzle N" in some cases.

In addition, in the case of complementing one ejection unit D with another ejection unit D, "increasing the amount of an ink to be ejected from another ejection unit D" includes a case in which another ejection unit D which is not expected to eject an ink when the complementing process is not performed ejects an ink due to the complementing process being performed.

As illustrated in FIG. 1, the head unit 5 includes a recording head 30 having 4M ejection units D and a head driver 50 that drives respective ejection units D included in the recording head 30 and detects ejection abnormality of the respective ejection units D (M is a natural number of 2 or higher). In addition, hereinafter, in order to distinguish each of the 4M ejection units D, expressions of a first stage, a second stage, . . . , and a 4M-th stage in sequence from the top are used.

Each of the 4M ejection units D receives supply of an ink from any of four ink cartridges 31.

The inside of each of the ejection units D is filled with an ink supplied from the ink cartridge 31 and the ink filling the inside thereof can be ejected from the nozzle N included in the ejection unit D. Further, each ejection unit D forms an image on the recording paper P by ejecting an ink onto the recording paper P at the timing at which the transport mechanism 7 transports the recording paper P to the platen 74. In this manner, four colors of inks of CMYK can be ejected from the 4M ejection units D as a whole, so that full color printing is realized.

The head driver 50 includes a driving signal generating unit 51, an ejection abnormality detecting unit 52, and a switching unit 53.

The driving signal generating unit 51 generates a driving signal Vin for driving each of the 4M ejection units D included in the recording head 30 based on signals such as the printing signal SI to be supplied from the control unit 6 and the driving waveform signal Com. When the driving signal Vin is supplied, each ejection unit D is driven based on the supplied driving signal Vin and an ink filling the inside thereof can be ejected onto the recording paper P.

The ejection abnormality detecting unit 52 detects, as a residual vibration signal Vout, a change of an internal pressure of the ejection unit D caused by vibration of the ink in the inside of the ejection unit D which is generated after the ejection unit D is driven by the driving signal Vin. Moreover, the ejection abnormality detecting unit 52 determines an ejection state of the ink in the ejection unit D such as whether the ejection abnormality occurs in the ejection unit D based on the detected residual vibration signal Vout, and outputs a determination result signal Rs representing the determination result.

The switching unit 53 electrically connects the respective ejection units D to any one of the driving signal generating unit 51 and the ejection abnormality detecting unit 52, based on the switching control signal Sw supplied from the control unit 6.

Further, the head driver 50 will be described in detail.

1.2. Configuration of Recording Head

Next, the recording head 30 and the ejection unit D provided in the recording head 30 will be described with reference to FIGS. 3 and 4.

Figure 3:
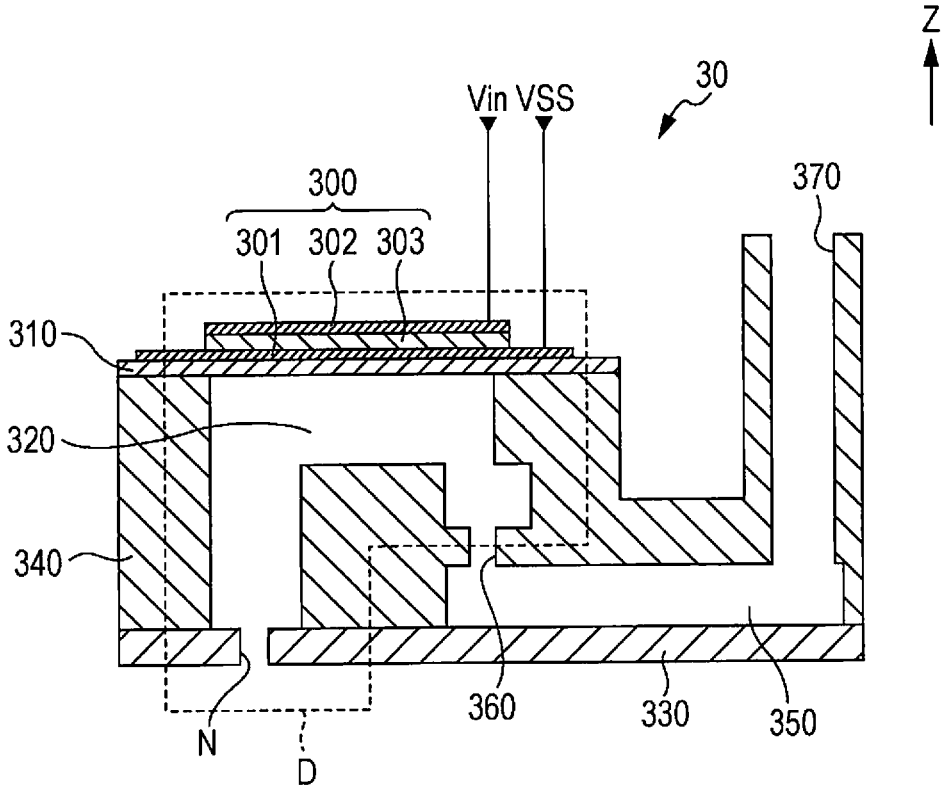
FIG. 3 is a cross-sectional view schematically illustrating a recording head.

FIG. 3 is an example of a partial cross-sectional view schematically illustrating the recording head 30. Further, for convenience of illustration, in the recording head 30, one ejection unit D among 4M ejection units D included in the recording head 30; a reservoir 350 communicating with the one ejection unit D through an ink supply port 360; and an ink inlet 370 for supplying an ink to the reservoir 350 from the ink cartridge 31 are illustrated in the figure.

As illustrated in FIG. 5, the ejection unit D includes a piezoelectric element 300; a cavity 320 whose inside is filled with an ink; the nozzle N communicating with the cavity 320;

and a vibration plate 310. In the ejection unit D, the ink in the cavity 320 is ejected from the nozzle N by the piezoelectric element 300 being driven by the driving signal Vin. The cavity 320 of the ejection unit D is a space divided by a cavity plate 340 formed to have a predetermined shape with a concave portion, a nozzle plate 330 on which the nozzle N is formed, and a vibration plate 310. The cavity 320 communicates with the reservoir 350 through the ink supply port 360. The reservoir 350 communicates with one ink cartridge 31 through the ink inlet 370.

In the present embodiment, a unimorph (monomorph) type as illustrated in FIG. 3 is employed as the piezoelectric element 300. The piezoelectric element 300 includes a lower electrode 301, an upper electrode 302, and a piezoelectric body 303 provided between the lower electrode 301 and the upper electrode 302. In addition, when a voltage is applied to a space between the lower electrode 301 and the upper electrode 302 by the lower electrode 301 being set to have a predetermined reference potential VSS and the driving signal Vin being supplied to the upper electrode 302, the piezoelectric element 300 is deflected in the vertical direction in response to the applied voltage and, as a result, the piezoelectric element 300 vibrates.

The vibration plate 310 is disposed in the opening portion of the upper surface of the cavity plate 340 and the lower electrode 301 is bonded to the vibration plate 310. Accordingly, when the piezoelectric element 300 vibrates due to the driving signal Vin, the vibration plate 310 vibrates. Further, the volume of the cavity 320 (pressure in the cavity 320) is changed due to the vibration of the vibration plate 310 and the ink filled in the cavity 320 is ejected by the nozzle N. In the case where the ink in the cavity 320 is reduced due to ejection of the ink, the ink is supplied from the reservoir 350. In addition, the ink is supplied to the reservoir 350 from the ink cartridge 31 through the ink inlet 370.

Figure 4:
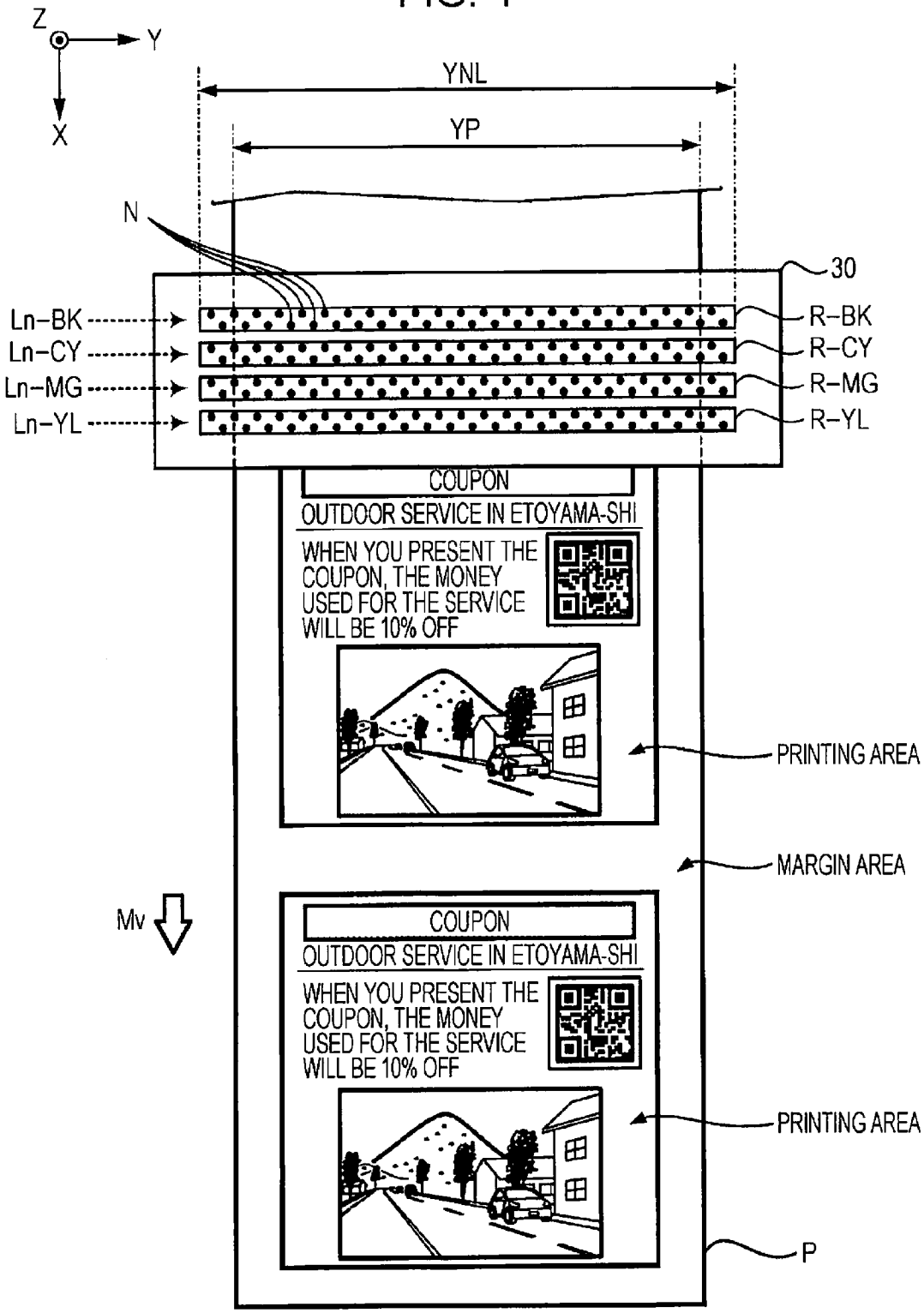
FIG. 4 is a plan view illustrating an arrangement example of nozzles in the recording head.

FIG. 4 is an explanatory diagram for describing an example of an arrangement of 4M nozzles N provided in the recording head 30 when the ink jet printer 1 is seen in a +Z direction or a −Z direction (hereinafter, seeing the ink jet printer 1 from the +Z direction or the −Z direction is referred to as "plan view").

As illustrated in FIG. 4, four nozzle arrays Ln (Ln-BK to Ln-YL) including a nozzle array Ln-BK formed of M nozzles N arranged in a nozzle forming area R-BK; a nozzle array Ln-CY formed of M nozzles N arranged in a nozzle forming area R-CY; a nozzle array Ln-MG formed of M nozzles N arranged in a nozzle forming area R-MG; and a nozzle array Ln-YL formed of M nozzles N arranged in a nozzle forming area R-YL are provided in the recording head 30. Each of M nozzles N belonging to the nozzle array Ln-BK is a nozzle N provided in an ejection unit D ejecting a black (BK) ink. Each of M nozzles N belonging to the nozzle array Ln-CY is a nozzle N provided in an ejection unit D ejecting a cyan (CY) ink. Each of M nozzles N belonging to the nozzle array Ln-MG is a nozzle N provided in an ejection unit D ejecting a magenta (MG) ink. Each of M nozzles N belonging to the nozzle array Ln-YL is a nozzle N provided in an ejection unit D ejecting a yellow (YL) ink.

Hereinafter, the nozzle forming areas R-BK to R-YL are also simply referred to as areas R-BK to R-YL. Each nozzle array Ln is an example of a "nozzle group."

Each of the four areas R-BK to R-YL are virtual areas having a rectangular shape divided by a long side extending in a Y axis direction (an example of a "second direction") and a short side extending in an X axis direction when seen in a plan view.

More specifically, as illustrated in FIG. 4, four areas R-BK to R-YL are provided so as to extend to the region YNL in the Y axis direction. As illustrated above, the ink jet printer 1 is a line printer. For this reason, the region YNL in which the nozzle N extends in the Y axis direction becomes larger than the region YP of the recording paper P in the Y axis direction in the case of printing on the recording paper P (accurately, recording paper P whose width in the Y axis direction is the maximum which can be printed on by the ink jet printer 1).

Further, positions of these four areas R-BK to R-YL in the X axis direction are different from one another and the four areas are arranged in order of the area R-BK, the area R-CY, the area R-MG, and the area R-YL toward the +X side (downstream side) from the −X side (upstream side).

As illustrated in FIG. 4, M nozzles N constituting each of the nozzle arrays Ln is arranged in a so-called zigzag shape such that the positions of the even-numbered nozzles N are differentiated from the positions of the odd-numbered nozzles N in the X axis direction from the left side (−Y side) in the figure. In each nozzle array Ln, the interval (pitch) between nozzles N in the Y axis direction can be suitably set according to the print resolution (dpi: dots per inch). In the present embodiment, in the four nozzle arrays Ln, pitches between nozzles N in the Y axis direction are approximately the same as one another. In addition, the 4M nozzles N provided in the recording head 30 are provided such that positions of four nozzles N in the Y axis direction at the mi-th position from the −Y side become approximately the same in each of the nozzle arrays Ln (mi is a natural number satisfying "$1 \leq mi \leq M$").

Further, in the present specification, "approximately the same" includes a case of the same when various kinds of errors such as production errors or errors caused by noise or the like are considered in addition to a case of completely the same.

The printing process of the present embodiment is performed with the assumption that a plurality of images in one-to-one correspondence with a plurality of printing areas are formed after the recording paper P is divided into a plurality of printing areas (for example, an A4-size square area in a case of printing an A4-size image on the recording paper P or a label in label paper) and a margin area for dividing each of the plurality of printing areas as illustrated in FIG. 4, without forming one long image across the entire recording paper P.

2. Operation of Ejection Unit and Residual Vibration

Next, an operation of ejecting an ink from the ejection unit D and the residual vibration generated in the ejection unit D will be described with reference to FIGS. 5A to 13.

Figure 5A:
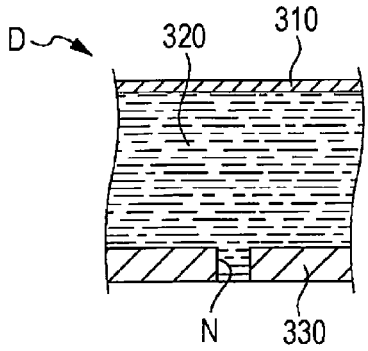
FIGS. 5A to 5C are explanatory diagrams for describing a change in the shape of a cross section of an ejection unit when a driving signal is supplied.
Figure 5B:
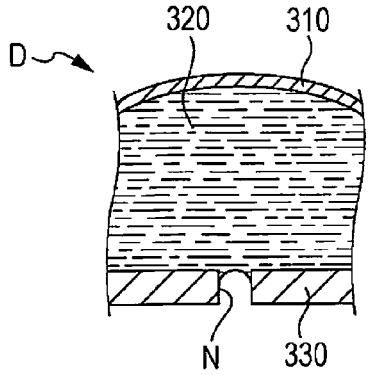
Figure 5C:
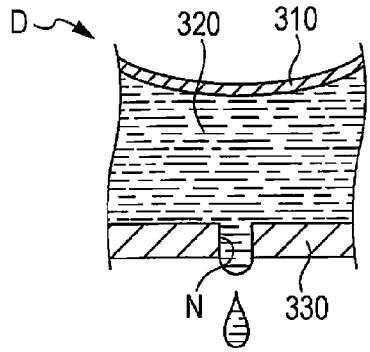

FIGS. 5A to 5C are explanatory diagrams for describing the operation of ejecting an ink from the ejection unit D.

When the driving signal Vin is supplied to the piezoelectric element 300 included in the ejection unit D from the head driver 50 in the state illustrated in FIG. 5A, distortion is generated in response to an electric field applied to a space between electrodes in the piezoelectric element 300, and the vibration plate 310 of the ejection unit D is deflected toward the upper direction in FIG. 5A. In this manner, the volume of the cavity 320 of the ejection unit D expands as illustrated in FIG. 5B compared to the initial state illustrated in FIG. 5A. In this state illustrated in FIG. 5B, when the potential indicated by the driving signal Vin is changed, the vibration plate 310 is restored by an elastic restoring force and moves toward the lower direction in the figure over the position of the vibration plate 310 in the initial state, and the volume of the cavity 320 illustrated in FIG. 5C is rapidly contracted. At this time, some of the ink filling the cavity 320 is ejected as ink droplets from the nozzles N communicating with the cavity 320 by the compressed pressure generated in the cavity 320.

The vibration plate 310 of the cavity 320 damping-vibrates, that is, residual-vibrates until the subsequent ink ejecting operation starts after a series of ink ejecting operations are finished. It is assumed that the residual vibration of the vibration plate 310 has a natural vibration frequency determined by shapes of the nozzles N and the ink supply port 360, or acoustic resistance r due to ink viscosity, an inertance m due to the ink weight within a flow path, and a compliance Cm of the vibration plate 310.

A calculation model of the residual vibration of the vibration plate 310 based on the assumption will be described.

Figure 6:
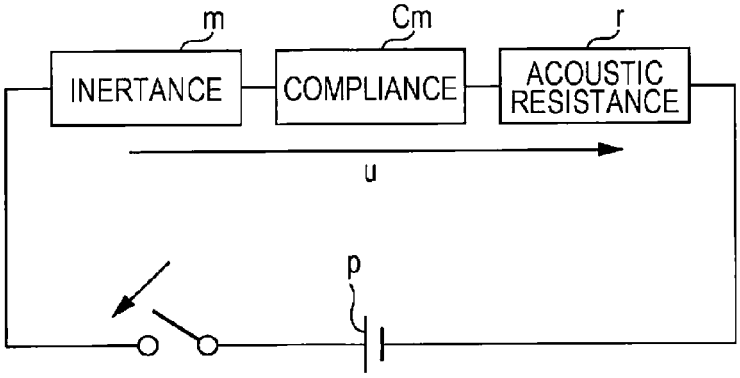
FIG. 6 is a circuit diagram illustrating a model of simple vibration showing residual vibration in the ejection unit.

FIG. 6 is a circuit diagram illustrating the calculation model of simple vibration which assumes the residual vibration of the vibration plate 310. As described above, the calculation model of the residual vibration of the vibration plate 310 is expressed by an acoustic pressure p, the above-described inertance m, the compliance Cm, and the acoustic resistance r. Further, if a step response is calculated for a volume velocity u when the acoustic pressure p is applied to the circuit of FIG. 6, the following equation is obtained.

$$u=\{p/(\omega\cdot m)\}e^{-\sigma t}\cdot\sin(\omega t)$$

$$\omega=\{1/(m\cdot Cm)-\alpha^2\}^{1/2}$$

$$\sigma=r/(2m)$$

The calculation result (calculated value) obtained from the equation is compared with a test result (test value) in the test of the residual vibration of the ejection unit D, which is separately performed. In addition, the test of residual vibration is a test of detecting residual vibration generated in the vibration plate 310 of the ejection unit D after an ink is ejected from the ejection unit D whose ejection state of the ink is normal.

Figure 7:
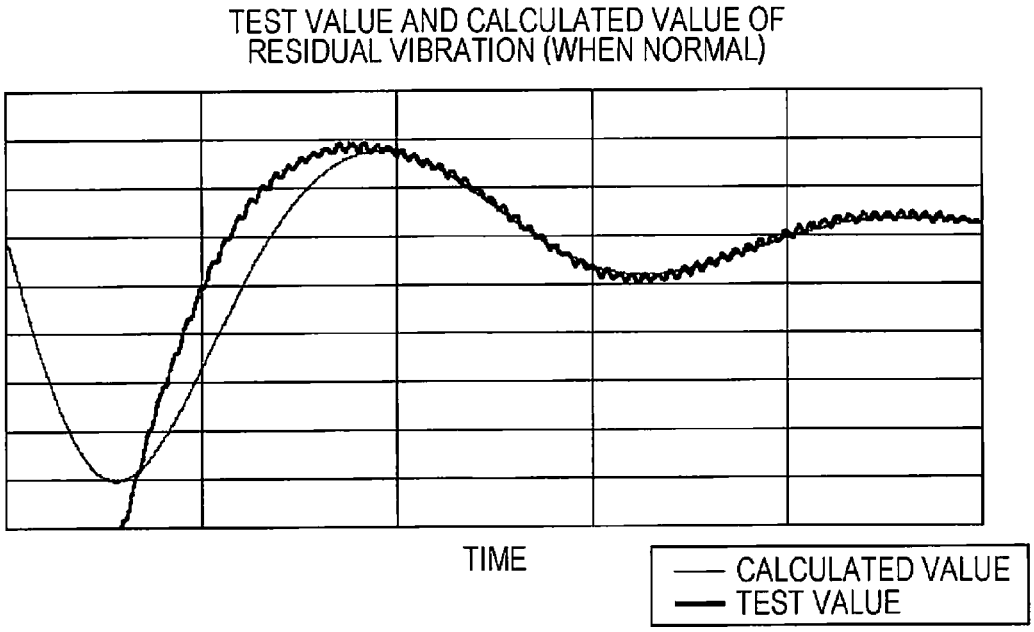
FIG. 7 is a graph illustrating a relationship between a test value and a calculated value of residual vibration in a case where the ejection state of the ejection unit is normal.

FIG. 7 is a graph illustrating a relation between test values and calculated values of the residual vibration. As understood from the graph of FIG. 7, two waveforms of the test values and the calculated values substantially coincide with each other in the case where the ejection state of the ink in the ejection unit D is normal.

There is a case in which the ejection state of the ink in the ejection unit D is abnormal and ink droplets are not normally ejected from the nozzle N of the ejection unit D, that is, ejection abnormality occurs even though the ink ejecting operation is performed by the ejection unit D. As a cause by which the ejection abnormality is generated, (1) mixing of bubbles into the cavity 320, (2) thickening or fixing of the ink in the cavity 320 caused by drying or the like of the ink in the cavity 320, or (3) attaching of paper powder to the vicinity of the outlet of the nozzle N can be exemplified.

As described above, the ejection abnormality typically means a state in which an ink cannot be ejected from the nozzle N, that is, a non-ejection phenomenon of the ink is exhibited. In this case, dot omission of a pixel in an image printed on the recording paper P occurs. Moreover, when the ejection abnormality occurs, even though the ink is ejected from the nozzle N, the amount of the ink is extremely small or a scattering direction (a trajectory) of the ejected ink droplets is shifted. Thus, since impact is not appropriately performed, the dot omission of the pixel appears. In this way, in the following description, the ejection abnormality is also simply referred to as "dot omission" and the nozzle included in the ejection unit D, in which ejection abnormality occurs is also referred to as a "nozzle omission."

In the following description, based on the comparison result illustrated in FIG. 7, at least one value of the acoustic resistance r and the inertance m is adjusted so as to allow the calculated values and the test values of the residual vibration to substantially coincide with each other for each cause of the ejection abnormality occurring in the ejection unit D.

Figure 8:
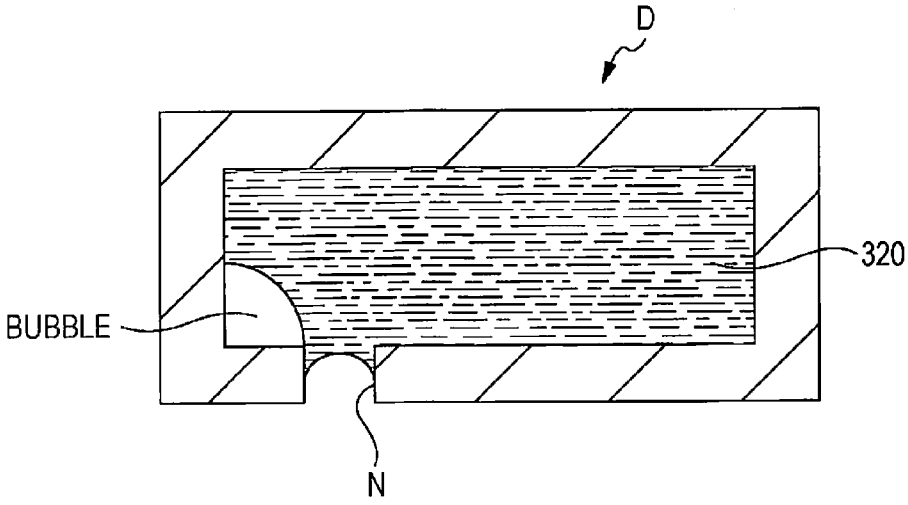
FIG. 8 is an explanatory diagram illustrating the state of the ejection unit in a case where bubbles are mixed into the inside of the ejection unit.

First, (1) the mixing of bubbles into the cavity 320 which is one cause of the ejection abnormality is inspected. FIG. 8 is a conceptual view for describing the case in which bubbles are mixed into the cavity 320. As illustrated in FIG. 8, in the case where bubbles are mixed into the cavity 320, it is considered that the total weight of the ink filled in the cavity 320 is reduced and the inertance m is decreased. Moreover, as illustrated in FIG. 8, in the case where a bubble is adhered to the vicinity of the nozzle N, it is considered that the diameter of the nozzle N becomes larger by the diameter of the bubble and the acoustic resistance r is decreased.

Figure 9:
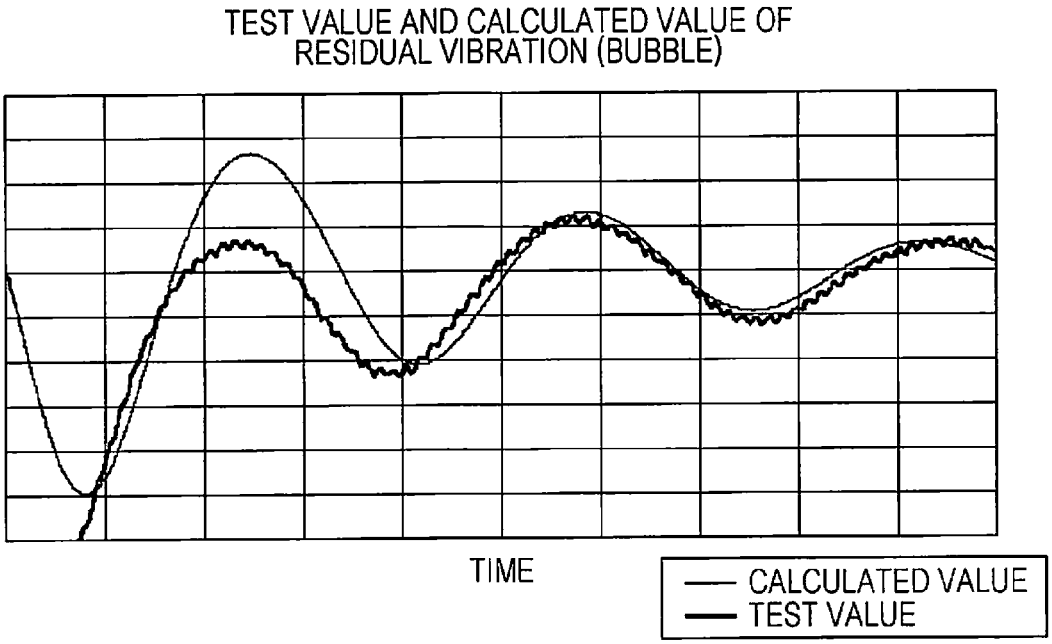
FIG. 9 is a graph illustrating the test value and the calculated value of the residual vibration in the state in which bubbles are mixed into the inside of the ejection unit.

Accordingly, the acoustic resistance r and the inertance m are set to be small to match the test values of the residual vibration when bubbles are mixed in, compared to the case where the ejection state of the ink is normal as illustrated in FIG. 7, so that a result (a graph) illustrated in FIG. 9 is obtained. As can be seen from FIGS. 7 and 9, in the case where bubbles are mixed into the cavity 320 and thus the ejection abnormality occurs, the frequency of the residual vibration becomes higher compared to the case where the ejection state is normal. Further, it can be recognized that a damping rate of an amplitude of the residual vibration is also decreased due to a decrease in the acoustic resistance r, so that the amplitude of the residual vibration is slowly decreased.

Figure 10:
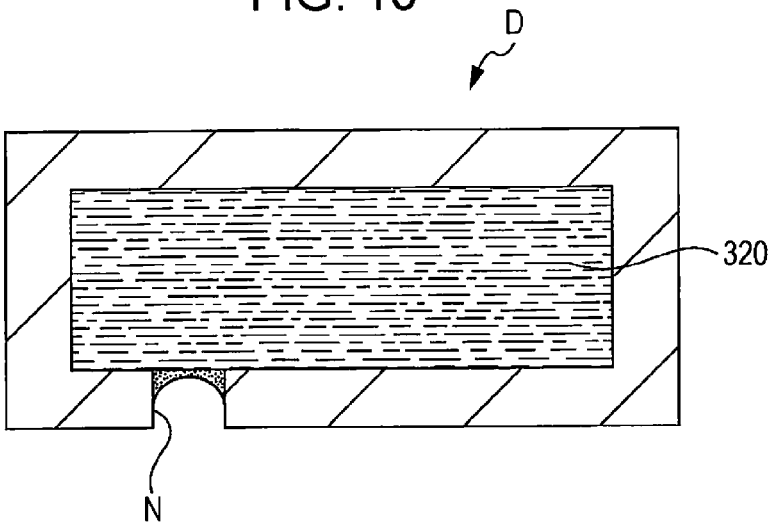
FIG. 10 is an explanatory diagram illustrating the state of the ejection unit in a case where the ink is fixed in the vicinity of a nozzle.

Next, (2) thickening or fixing of the ink in the cavity 320 which is another cause of the ejection abnormality is inspected. FIG. 10 is a conceptual view for describing the case in which an ink is fixed to the vicinity of the nozzle N of the cavity 320 due to drying. As illustrated in FIG. 10, when the ink in the vicinity of the nozzle N is dried and fixed, the ink in the cavity 320 is enclosed in the cavity 320. In such a case, it is considered that the acoustic resistance r is increased.

Figure 11:
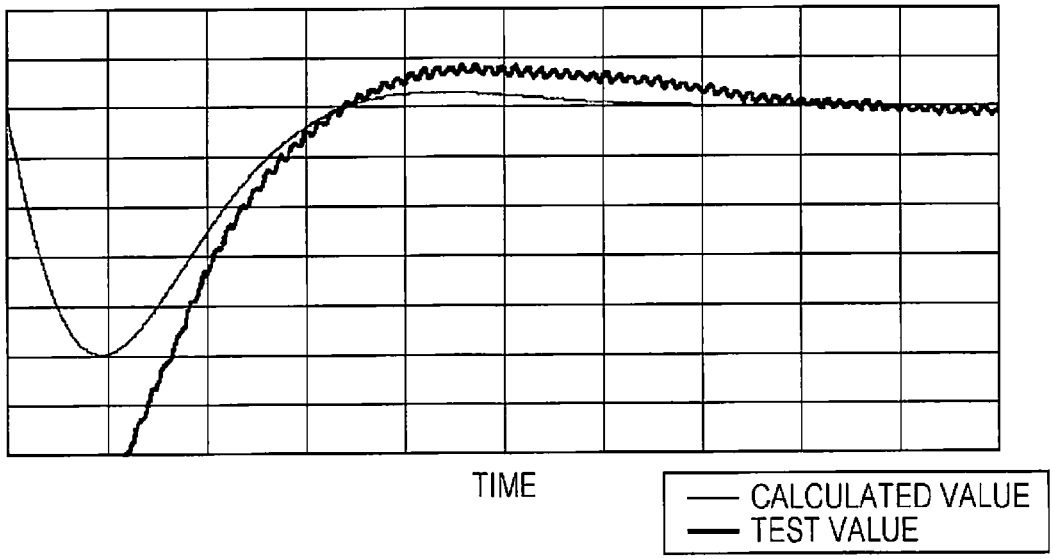
FIG. 11 is a graph illustrating the test value and the calculated value of the residual vibration in a state in which the ink cannot be ejected due to the fixation of the ink in the vicinity of the nozzle.

Accordingly, the acoustic resistance r is set to be large to match the test values of the residual vibration when the ink in the vicinity of the nozzle N is fixed or thickened compared to the case where the ejection state of the ink is normal as illustrated in FIG. 7, so that a result (a graph) as in FIG. 11 is obtained. Further, the test values illustrated in FIG. 11 are obtained by measuring the residual vibration of the vibration plate 310 in a state in which the ejection unit D stands still without mounting a cap (not illustrated) for several days and the ink in the vicinity of the nozzle N is fixed. As illustrated in FIGS. 7 and 11, when the ink is fixed to the vicinity of the nozzle N in the cavity 320, the frequency of the residual vibration is extremely decreased when compared to the case where the ejection state is normal, and a distinctive waveform in which the residual vibration is over-damped is obtained. This is because it is difficult for the vibration plate 310 to rapidly vibrate (due to the over-damping) since there is no retreat route of the ink in the cavity 320 at the time of the vibration plate 310 moving in the −Z direction (downwards) after the ink is allowed to flow into the cavity 320 from the reservoir by pulling the vibration plate 310 in the +Z direction (upwards) in order to eject the ink.

Figure 12:
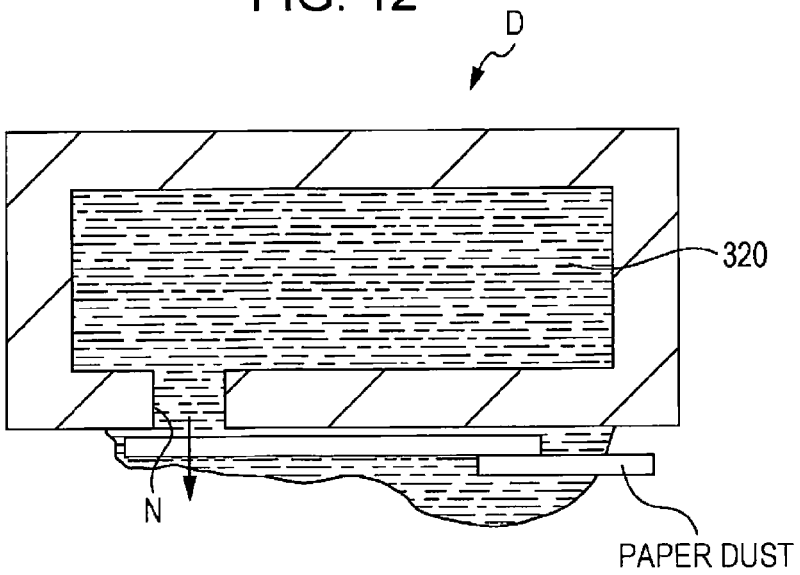
FIG. 12 is an explanatory diagram illustrating the state of the ejection unit in a case where paper dust adheres to the vicinity of an outlet of the nozzle.

Next, (3) adhering of paper dust to the vicinity of the outlet of the nozzle N which is one cause of the ejection abnormality is inspected. FIG. 12 is a conceptual view for describing the case where paper dust is adhered to the vicinity of the outlet of the nozzle N.

As illustrated in FIG. 12, when the paper dust is adhered to the vicinity of the outlet of the nozzle N, the ink is exuded from the inside of the cavity 320 through the paper dust and the ink cannot be ejected from the nozzle N. In the case where paper dust is adhered to the vicinity of the outlet of the nozzle N and the ink is exuded from the nozzle N, since the exuded ink from the cavity 320 is more increased compared to the case where the ejection state is normal when viewed from the vibration plate 310, the inertance m is increased. Moreover, it is considered that the acoustic resistance r is increased by fibers of the paper dust adhered to the vicinity of the outlet of the nozzle N.

Figure 13:
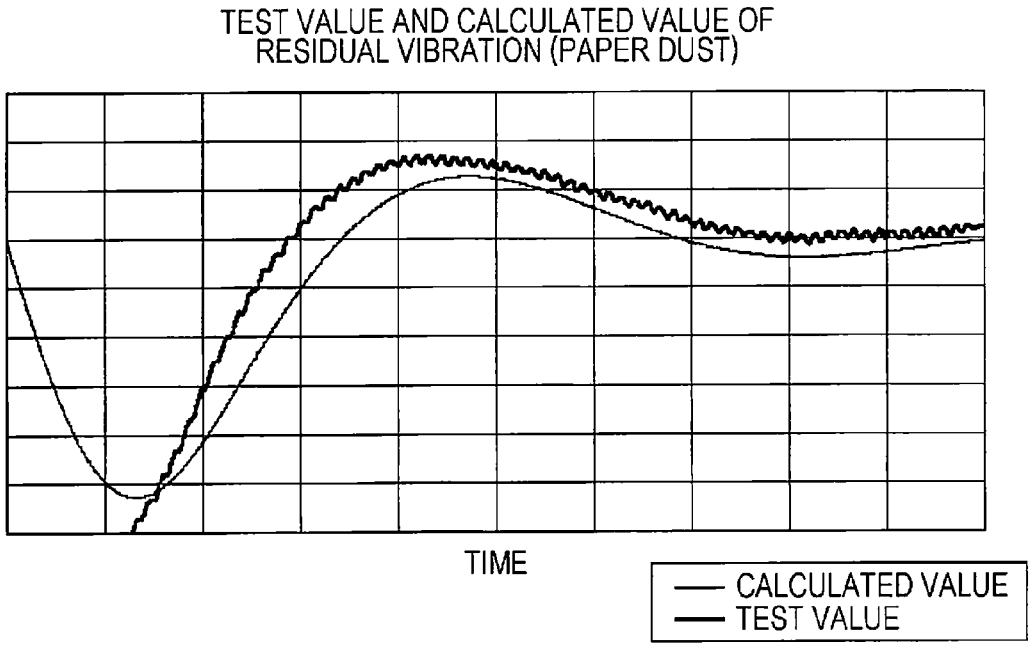
FIG. 13 is a graph illustrating the test value and the calculated value of the residual vibration in a state in which the ink cannot be ejected due to the adhesion of paper dust to the vicinity of the outlet of the nozzle.

Accordingly, the inertance m and the acoustic resistance r are set to be large to match the test values of the residual vibration when the paper dust is adhered to the vicinity of the outlet of the nozzle N compared to the case where the ejection state of an ink is normal as illustrated in FIG. 7, so that a result (a graph) of FIG. 13 is obtained. As can be seen from the graphs of FIGS. 7 and 13, when the paper dust is adhered to the vicinity of the outlet of the nozzle N, the frequency of the residual vibration becomes lower compared to the case in which the ejection state is normal.

In addition, it is understood that the frequency of the residual vibration is high in the case where (3) paper dust is adhered to the vicinity of the outlet of the nozzle N from the graphs of FIGS. 11 and 13 compared to the case where (2) the ink in the cavity 320 is thickened.

Here, in both cases of (2) thickening of an ink and (3) adhering paper dust to the vicinity of the outlet of the nozzle N, the frequency of the residual vibration is low compared to the case where the ejection state of the ink is normal. The two causes of the ejection abnormality can be distinguished from each other by comparing the waveform of the residual vibration, specifically, the frequency or the cycle of the residual vibration with a predetermined threshold value.

As is obvious from the above description, it is possible to determine the ejection state of the respective ejection units D based on the waveform, particularly, the frequency or the cycle of the residual vibration generated when the respective ejection units D are driven. More specifically, based on the frequency or the cycle of the residual vibration, it is possible to determine whether the ejection state in each of the ejection units D is normal and to determine to which numbers of (1) to (3) the cause of the ejection abnormality corresponds when the ejection state in each of the respective ejection units D is abnormal.

The ink jet printer 1 according to the present embodiment performs the ejection state determining process of determining the ejection state by analyzing the residual vibration.

3. Configurations and Operations of Head Driver

Next, the configurations and the operations of the head driver 50 (the driving signal generating unit 51, the ejection abnormality detecting unit 52, and the switching unit 53) will be described with reference to FIGS. 14 to 21.

Figure 16:
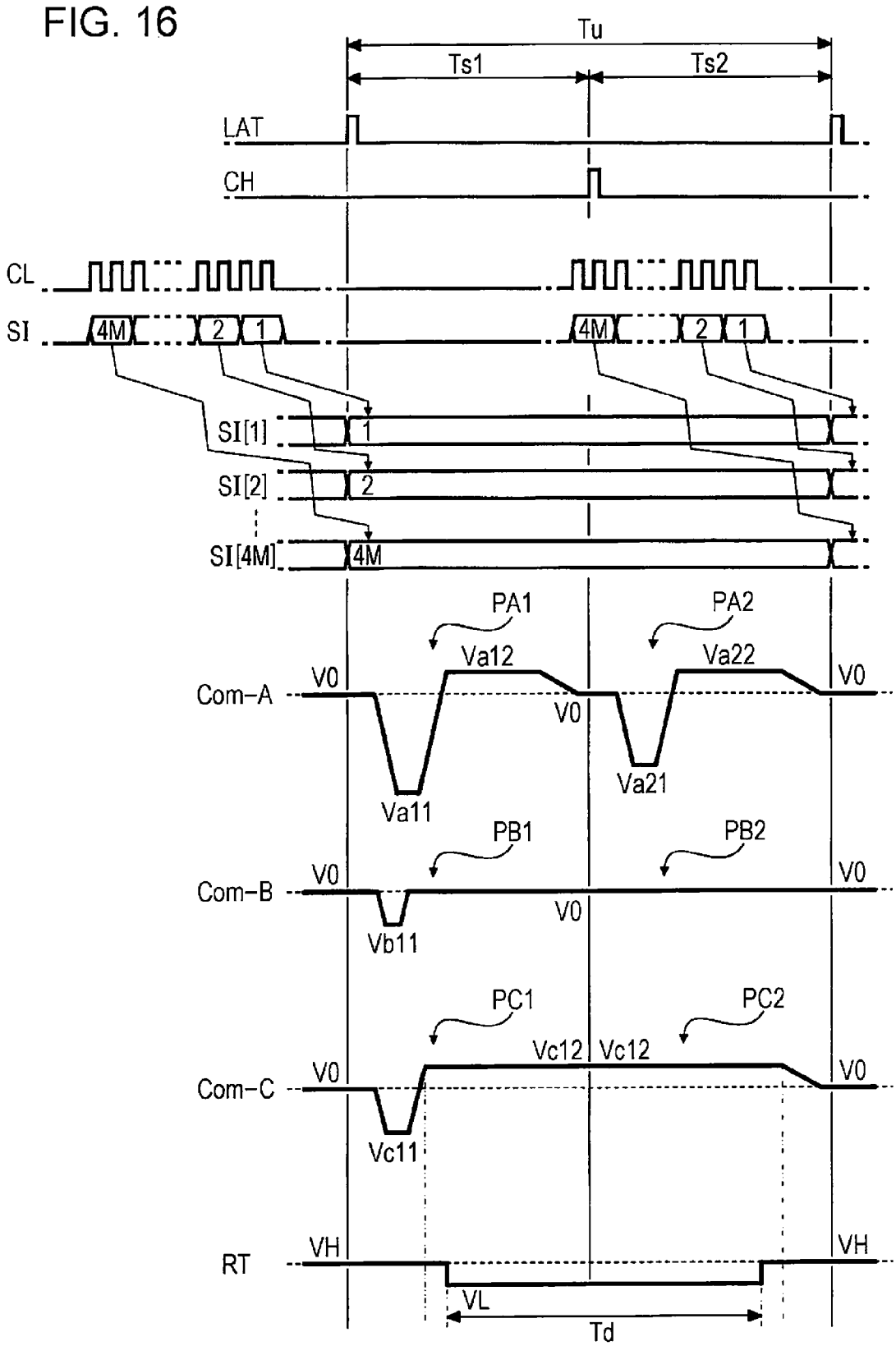
FIG. 16 is a timing chart illustrating an operation of the driving signal generating unit.

FIG. 16 is a block diagram illustrating the configuration of the driving signal generating unit 51 of the head driver 50.

As illustrated in FIG. 16, the driving signal generating unit 51 has 4M sets including shift registers SR, latch circuits LT, decoders DC, and transmission gates TGa, TGb and TGc so as to be in one-to-one correspondence with the 4M ejection units D. In the following description, the respective elements constituting the 4M sets are referred to as a first stage, a second stage, . . . , and a 4M-th stage in order from the top in the drawing.

Further, although details will be described below, the ejection abnormality detecting unit 52 includes 4M ejection abnormality detection circuits CT (CT[1], CT[2], . . . , and CT[4M]) so as to be in one-to-one correspondence with the 4M ejection units D.

Clock signals CL, printing signals SI, latch signals LAT, change signals CH, and driving waveform signals Com (Com-A, Com-B and Com-C) are supplied to the driving signal generating unit 51 from the control unit 6.

Here, the printing signal SI is a digital signal that regulates the amount of ink ejected from each ejection unit D (each nozzle N) at the time of forming one dot of an image. More specifically, the printing signals SI according to the present embodiment are signals that regulate the amount of ink ejected from each ejection unit D by 3 bits of a high-order bit b1, a middle-order bit b2 and a low-order bit b3, and are serially supplied to the driving signal generating unit 51 in synchronization with the clock signals CL from the control unit 6. By controlling the amount of ink ejected from each ejection unit D by the printing signals SI, it is possible to express four gradation steps of a non-recording state, a small dot, a medium dot and a large dot in the respective dots of the recording paper P, and it is possible to generate the residual vibration to generate the driving signal Vin for inspection in order to inspect the ejection state of the ink.

The respective shift registers SR temporarily hold the printing signals SI for 3 bits corresponding to the respective ejection units D. Specifically, the 4M shift registers SR of the first stage, the second stage, . . . , and the 4M-th stage in one-to-one correspondence with the 4M ejection units D are cascade-connected to each other, and the printing signals SI serially supplied are sequentially transferred to the subsequent stage in response to the clock signals CL. Furthermore, the supply of the clock signals CL is stopped when the printing signals SI are transferred to all of the 4M shift registers SR, and each of the 4M shift registers SR maintains a state where each of the 4M shift registers holds data of 3 bits corresponding to each shift register among the printing signals SI.

Figure 14:
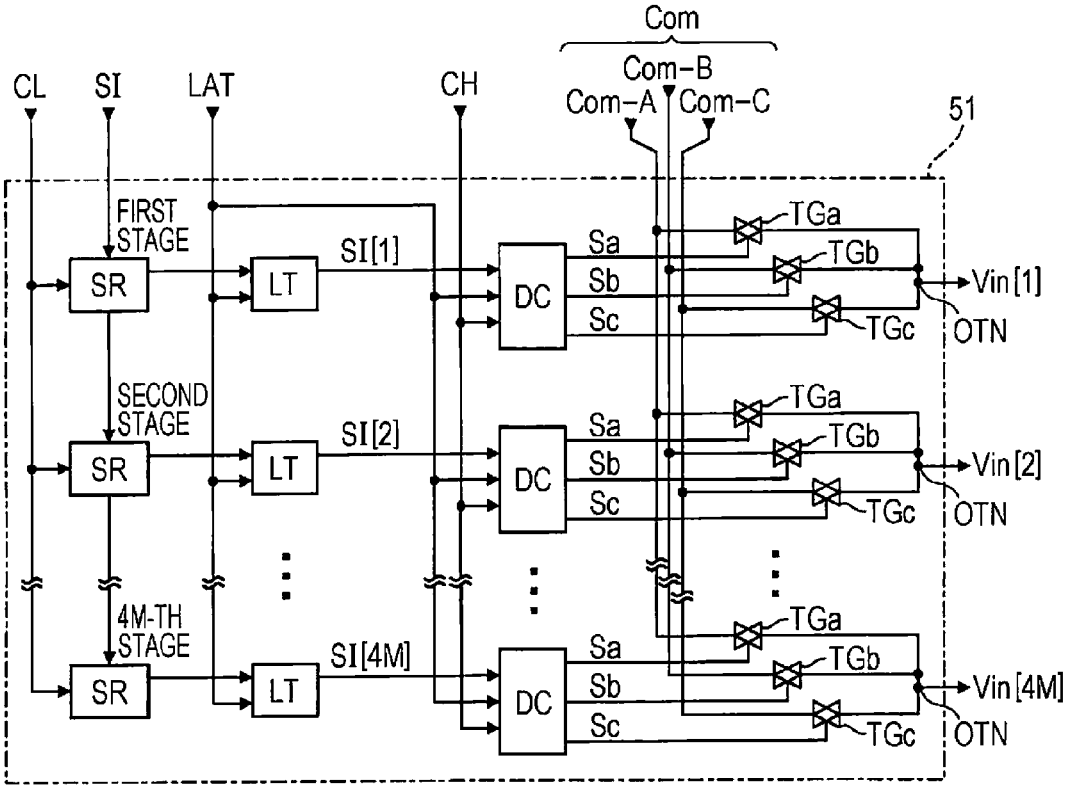
FIG. 14 is a block diagram illustrating a configuration of a driving signal generating unit.

The 4M latch circuits LT simultaneously latch the printing signals SI of 3 bits corresponding to the respective stages held by the respective 4M shift registers SR at the timing when the latch signals LAT rise. In FIG. 14, SI[1], SI[2], . . . , and SI[4M] indicate the printing signals SI of 3 bits latched by the latch circuits LT corresponding to the shift registers SR of the first stage, the second stage, . . . and the 4M-th stage.

On the other hand, the operation period which is a period for which the ink jet printer 1 operates at least one process among the printing process and the ejection state determining process is formed of a plurality of unit operation periods Tu. The respective unit operation periods Tu are formed of a control period Ts1 and a control period Ts2 which follows the control period Ts1. In the present embodiment, the control periods Ts1 and Ts2 have the equivalent time length to each other.

In addition, in the present embodiment, a plurality of unit operation periods Tu constituting the operation period are classified into two unit operation periods Tu, which are a unit operation period Tu for which the printing process is performed and a unit operation period Tu for which the ejection state determination process is performed.

As described above, the ink jet printer 1 according to the present embodiment divides the long recording paper P into a plurality of printing areas and a margin area for dividing each of the plurality of printing areas and then forms one image with respective printing areas.

Specifically, the control unit 6 classifies the period for which at least a part of the printing area of the recording paper P is positioned on the lower side (−Z side) of the recording head 30 into the unit operation period TU for which the printing process is performed, among the plurality of unit operation periods Tu constituting the operation period and controls operations of the respective units of the ink jet printer 1 such that the printing process is performed during the unit operation period Tu.

Meanwhile, the control unit 6 classifies the period for which only the margin area the recording paper P is positioned on the lower side (−Z side) of the recording head 30 into the unit operation period Tu for which the ejection state determining process is performed, among the plurality of unit operation periods Tu constituting the operation period and controls operations of the respective units of the ink jet printer 1 such that the ejection state determining process is performed during the unit operation period Tu.

The control unit 6 supplies the printing signals SI to the driving signal generating unit 51 for each unit operation period Tu and supplies the latch signals LAT such that the latch circuits LT latch the printing signals SI[1], SI[2], . . . , SI[4M] for each unit operation period Tu. That is, the control unit 6 controls the driving signal generating unit 51 to supply the driving signals Vin to the 4M ejection units D for each unit operation period Tu.

More specifically, the control unit 6 controls the driving signal generating unit 51 such that the driving signals Vin for printing are supplied to the respective 4M ejection units D during the unit operation period Tu for which the printing process is performed. Accordingly, the 4M ejection units D eject the ink with an amount according to print data PD on the recording paper P and an image corresponding to the print data PD is formed on the recording paper P.

The control unit 6 controls the driving signal generating unit 51 such that the driving signals Vin for inspection are supplied to the respective 4M ejection units D during the unit operation period Tu for which the ejection state determining process is performed. In this manner, it is determined whether the ejection abnormality occurs in each of the ejection units D.

The decoder DC decodes the printing signal SI of 3 bits latched by the latch circuit LT, and outputs selection signals Sa, Sb and Sc during each of the control periods Ts1 and Ts2.

FIG. 15 is an explanatory diagram illustrating contents of decoding performed by the decoder DC. As illustrated in the figure, when the printing signals SI [m] corresponding to the m stages (m is a natural number which satisfies $1 \leq m \leq 4M$) indicate, for example, (b1, b2, b3)=(1, 0, 0), the decoders DC of m stages set the selection signal Sa to a high level H and set the selection signals Sb and Sc to a low level L during the control period Ts1. In addition, the decoders set the selection signals Sb to a high level H and set the selection signal Sa and Sc to a low level L during the control period Ts2.

Moreover, when the low-order bit b3 is "1," that is, (b1, b2, b3)=(0, 0, 1), the decoders DC of m stages set the selection signal Sc to a high level H and set the selection signals Sa and Sb to a low level L during the control periods Ts1 and Ts2.

The description returns to FIG. 14.

As illustrated in FIG. 14, the driving signal generating unit 51 includes 4M sets of transmission gates TGa, TGb, and TGc. The 4M sets of transmission gates TGa, TGb, and TGc are provided in one-to-one correspondence with the 4M ejection units D.

The transmission gate TGa is turned on when the selection signal Sa is in a high level H, and is turned off when the selection signal Sa is in a low level L. The transmission gate TGb is turned on when the selection signal Sb is in a high level H, and is turned off when the selection signal Sb is in a low level L. The transmission gate TGc is turned on when the selection signal Sc is in a high level H, and is turned off when the selection signal Sc is in a low level L.

For example, in the m-th stage, when the content indicated by the printing signal Si[m] is (b1, b2, b3)=(1, 0, 0), the transmission gate TGa is turned on and the transmission gates TGb and TGc are turned off during the control period Ts1, and the transmission gate TGb is turned on and the transmission gates TGb and TGc are turned off during the control period Ts2.

The driving waveform signal Com-A is supplied to one terminal of the transmission gate TGa, the driving waveform signal Com-B is supplied to one terminal of the transmission gate TGb, and the driving waveform signal Com-C is supplied to one terminal of the transmission gate TGc. Moreover, the other terminals of the transmission gates TGa, TGb and TGc are commonly connected to an output terminal OTN to the switching unit 53.

The transmission gates TGa, TGb and TGc are exclusively turned on, and the driving waveform signal Com-A, Com-B or Com-C selected for the control periods Ts1 and Ts2 are output to the m-th stage output terminal OTN, as the driving signals Vin[m], and supplied to the ejection unit D of the m-th stage through the switching unit 53.

FIG. 16 is a timing chart for describing the operation of the driving signal generating unit 51 during the unit operation period Tu. As illustrated in FIG. 16, the unit operation period Tu is a period regulated by the latch signal LAT output from the control unit 6. Moreover, the control periods Ts1 and Ts2 included in the unit operation period Tu are periods regulated by the latch signal LAT and the change signal CH output from the control unit 6.

The driving waveform signal Com-A supplied from the control unit 6 during the unit operation period Tu is a signal for generating the driving signal Vin for printing, and has a waveform that continuously connects a unit waveform PA1 arranged in the control period Ts1 of the unit operation period Tu and a unit waveform PA2 arranged in the control period Ts2 as illustrated in FIG. 16. Potentials at a timing when the unit waveform PA1 and the unit waveform PA2 start and end are both reference potentials V0. Moreover, a potential difference between a minimum potential Va11 and a maximum potential Va12 of the unit waveform PA1 is larger than a potential difference between a minimum potential Va21 and a maximum potential Va22 of the unit waveform PA2. For this reason, the amount of ink ejected from the nozzles N included in the ejection unit D when the piezoelectric elements 300 included in the respective ejection units D are driven by the unit waveform PA1 is larger than the amount of ink ejected when the piezoelectric elements are driven by the unit waveform PA2.

The driving waveform signal Com-B supplied from the control unit 6 during the unit operation period Tu is a signal for generating the driving signal Vin for printing, and has a waveform that continuously connects a unit waveform PB1 arranged in the control period Ts1 and a unit waveform PB2 arranged in the control period Ts2. Potentials at a timing when the unit waveform PB1 starts and ends are both reference potentials V0, and the unit waveform PB2 is maintained at the reference potential V0 over the control period Ts2. Moreover, a potential difference between the minimum potential Vb11 and the maximum potential (reference potential V0 in the example of the figure) of the unit waveform PB1 is smaller than a potential difference between the minimum potential Va21 and the maximum potential Va22 of the unit waveform PA2. In addition, even when the piezoelectric elements 300 included in the respective ejection unit D are driven by the unit waveform PB1, the ink is not ejected from the nozzles N included in the ejection units D. Similarly, even when the unit waveform PB2 is supplied to the piezoelectric elements 300, the ink is not ejected from the nozzles N.

The driving waveform signal Com-C supplied from the control unit 6 during the unit operation period Tu is a signal for generating the driving signal Vin for inspection, and has a waveform that continuously connects a unit waveform PC1 arranged in the control period Ts1 and a unit waveform PC2 arranged in the control period Ts2. The unit waveform PC1 is changed from the reference potential V0 to the minimum potential Vc11, and then changed from the minimum potential Vc11 to the maximum potential Vc12. Thereafter, the potential of the unit waveform PC1 is maintained at the maximum potential Vc12 until the control period Ts1 ends. Moreover, the potential of the unit waveform PC2 is maintained at the maximum potential Vc12, and then changed from the maximum potential Vc12 to the reference potential V0 before the control period Ts2 ends.

In the present embodiment, the potential difference between the minimum potential Vc11 and the maximum potential Vc12 in the unit waveform PC1 is smaller than the potential difference between the minimum potential Va21 and the maximum potential Va22 in the unit waveform PA2, and set to a potential such that the ink is not ejected from the ejection unit D in a case where the ejection unit D is driven by the driving signal Vin for inspection having the unit waveform PC1.

That is, in the present embodiment, the ejection state determining process assumes so-called "non-ejection inspection" in which the ejection state of the ink in the ejection unit D is determined based on the residual vibration generated in the ejection unit D when the ejection unit D is driven such that the ink is not ejected.

As illustrated in FIG. 16, the 4M latch circuits LT output the printing signals SI[1], SI[2], . . . , and SI [4M] at the timing when the latch signals LAT rise, that is, at the timing when the unit operation period Tu starts.

Further, the m-th stage decoder DC outputs selection signals Sa, Sb, and Sc based on the decoding contents illustrated in FIG. 15 in respective control periods Ts1 and Ts2 according to the printing signal SI[m] as described above.

Moreover, as described above, the transmission gates TGa, TGb and TGc of the m-th stage select any one of the driving waveform signals Com-A, Com-B and Com-C based on the selection signals Sa, Sb, and Sc, and output the selected driving waveform signal Com as the driving signal Vin[m].

Further, a switching period designation signal RT illustrated in FIG. 16 is a signal that regulates a switching period Td. The switching period designation signal RT and the switching period Td will be described below.

A waveform of the driving signal Vin output from the driving signal generating unit 51 during the unit operation period Tu will be described with reference to FIG. 17 in addition to FIGS. 14 to 16.

Since the printing signal SI[m] supplied during the unit operation period Tu indicates (b1, b2, b3)=(1, 1, 0), since the selection signals Sa, Sb and Sc are in a high level H, a low level L, and a low level L during the control period Ts1, the driving waveform signal Com-A is selected by the transmission gate TGa, and the unit waveform PA1 is output as the driving signal Vin[m]. Similarly, during the control period Ts2, the driving waveform signal Com-A is selected, and the unit waveform PA2 is output as the driving signal Vin[m]. Accordingly, in this case, the driving signal Vin[m] supplied to the ejection unit D of the m-th stage during the unit operation period Tu is the driving signal Vin for printing, and as illustrated in FIG. 17, a waveform thereof is a waveform DpAA including the unit waveform PA1 and the unit waveform PA2. As a result, during the unit operation period Tu, the ejection unit D of the m-th stage performs ejection of the medium amount of ink based on the unit waveform PA1 and ejection of the small amount of ink based on the unit waveform PA2, and the inks ejected twice are united on recording paper P, so that a large dot is formed on the recording paper P.

When the content of the printing signal SI[m] supplied during the unit operation period Tu indicates (b1, b2, b3)=(1, 0, 0), since the driving waveform signal Com-A is selected during the control period Ts1 and the driving waveform signal Com-B is selected during the control period Ts2, the driving signal Vin[m] supplied to the ejection unit D of the m-th stage during the unit operation period Tu is the driving signal Vin for printing, and a waveform thereof is a waveform DpAB including the unit waveform PA1 and the unit waveform PB2. As a result, the ejection unit D of the m-th stage performs ejection of the medium amount of ink based on the unit waveform PA1 during the unit operation period Tu, so that a medium dot is formed on the recording paper P.

When the contents of the printing signal SI[m] supplied during the unit operation period Tu indicate (b1, b2, b3)=(0, 1, 0), since the driving waveform signal Com-B is selected in the control period Ts1 and the driving waveform signal Com-A is selected in the control period Ts2, the driving signal Vin[m] supplied to the ejection unit D of the m-th stage in the unit operation period Tu and the waveform thereof is a waveform DpAB including the unit waveform PB1 and the unit waveform PA2. As a result, the ejection unit D of the m-th stage ejects the ink in a small amount based on the unit waveform PA2 in the unit operation period Tu and small dots are formed on the recording paper P.

When the contents of the printing signal SI[m] supplied during the unit operation period Tu indicate (b1, b2, b3)=(0, 0, 0), since the driving waveform signal Com-B is selected in the control period Ts1 and the control period Ts2, the driving signal Vin[m] supplied to the ejection unit D of the m-th stage in the unit operation period Tu and the waveform thereof is a waveform DpBB including the unit waveform PB1 and the unit waveform PB2. As a result, the ink is not ejected from the ejection unit D of the m-th stage in the unit operation period Tu and dots are not formed on the recording paper P (enters a non-recording state).

When the contents of the printing signal SI[m] supplied during the unit operation period Tu indicate (b1, b2, b3)=(0, 0, 1), since the driving waveform signal Com-C is selected in the control period Ts1 and the control period Ts2, the driving signal Vin[m] supplied to the ejection unit D of the m-th stage in the unit operation period Tu is a driving signal Vin for inspection and the waveform thereof is a waveform DpT including the unit waveform PC1 and the unit waveform PC2.

Figure 18:
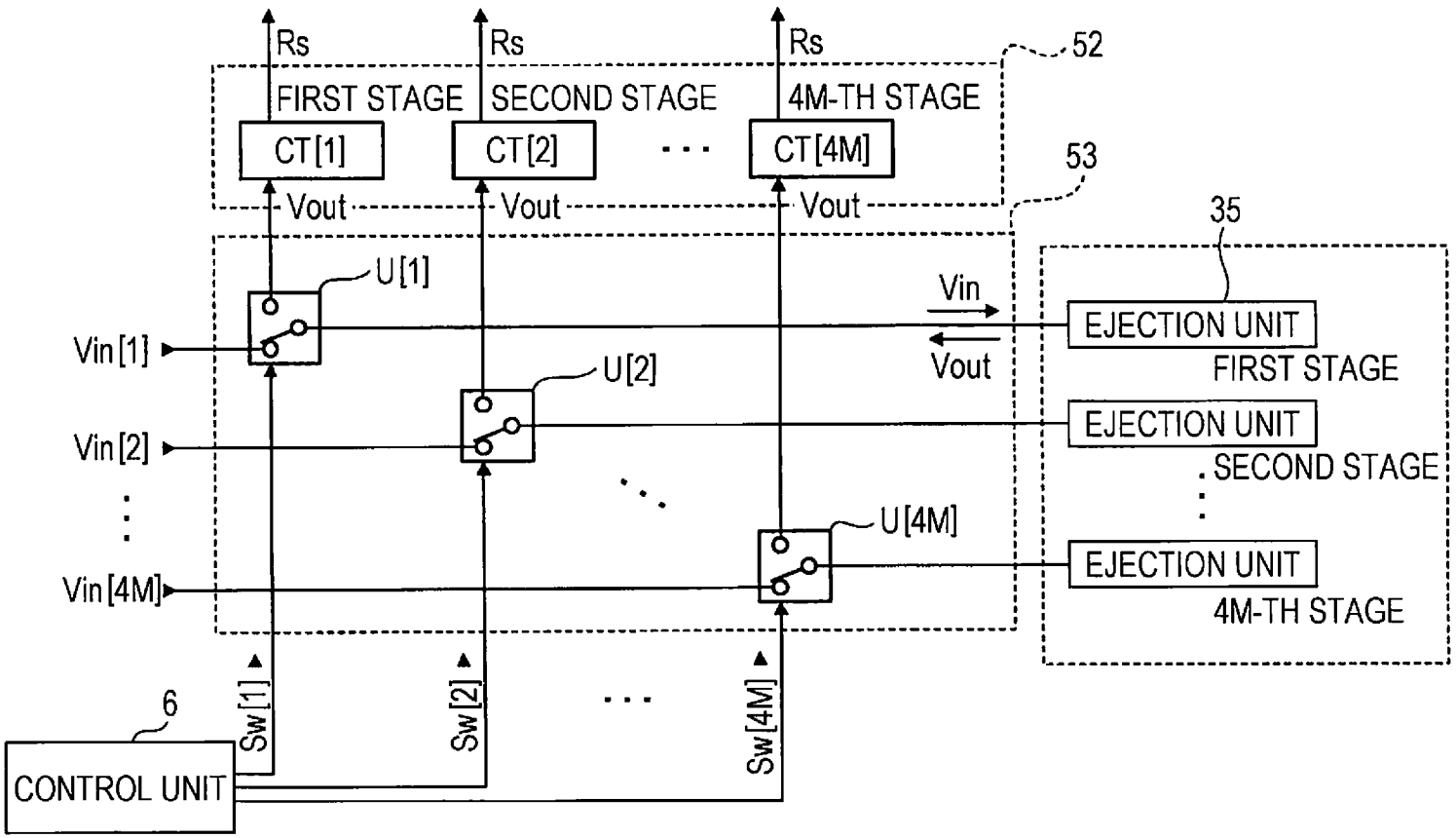
FIG. 18 is a block diagram illustrating a configuration of a switching unit.

FIG. 18 is a block diagram illustrating a configuration of the switching unit 53 of the head driver 50. In FIG. 18, electric connection relations between the switching unit 53, the ejection abnormality detecting unit 52, the ejection unit D, and the driving signal generating unit 51 are illustrated.

As illustrated in FIG. 18, the switching unit 53 includes 4M switching circuits U (U[1], U[2], . . . , and U[4M]) having first to 4M-th stages in one-to-one correspondence with the 4M ejection units D. Moreover, the ejection abnormality detecting unit 52 includes 4M ejection abnormality detection circuits CT (CT[1], CT[2], . . . , and CT[4M]) of the first to 4M-th stages in one-to-one correspondence to the 4M ejection units D.

The switching circuit U[m] of the m-th stage electrically connects the piezoelectric elements 300 of the ejection unit D of the m-th stage to any one of an output terminal OTN of the m-th stage included in the driving signal generating unit 51 and the ejection abnormality detection circuit CT[m] of the m-th stage included in the ejection abnormality detecting unit 52.

In the following description, in the respective switching circuits U, a state where the ejection unit D and the output terminal OTN of the driving signal generating unit 51 are electrically connected is referred to as a first connection state. Moreover, a state where the ejection unit D and the ejection abnormality detection circuit CT of the ejection abnormality detecting unit 52 are electrically connected is referred to as a second connection state.

The control unit 6 outputs the switching control signals Sw for controlling the connection states of the respective switching circuits U to the respective switching circuits U.

Specifically, when the ejection unit D of the m-th stage is used to perform the printing process during the unit operation period Tu, the control unit 6 supplies the switching control signal Sw[m] to the switching circuit U[m] so as to allow the switching circuit U[m] corresponding to the ejection unit D of the m-th stage to maintain the first connection state over the entire period of the unit operation period Tu. For this reason, when the ejection unit D of the m-th stage is used to perform the printing process during the unit operation period Tu, the control unit 6 supplies the driving signal Vin to the ejection unit D from the driving signal generating unit 51 over the entire period of the unit operation period Tu.

Meanwhile, when the ejection unit D of the m-th stage is a target of the ejection state determining process during the unit operation period Tu, the control unit 6 supplies the switching control signal Sw[m] to the switching circuit U[m] so as to allow the switching circuit U[m] corresponding to the ejection unit D of the m-th stage to enter the first connection state during a period other than the switching period Td of the unit operation period Tu and to enter the second connection state during the switching period Td of the unit operation period Tu. For this reason, the driving signal Vin is supplied to the ejection unit D of the m-th stage from the driving signal generating unit 51 during the period other than the switching period Td of the unit operation period Tu, and the residual vibration signal Vout is supplied to the ejection abnormality detection circuit CT[m] from the ejection unit D of the m-th stage during the switching period Td in a case where the ejection unit D of the m-th stage becomes a target of the ejection state determining process during the unit operation period Tu.

Further, as illustrated in FIG. 16, the switching period Td is a period for which the switching period designation signal RT generated by the control unit 6 is set to a potential VL. Specifically, the switching period Td is a period determined such that a period of the unit operation period Tu becomes a partial or entire period for which the driving waveform signal Com-C (that is, the waveform DpT) maintains the potential Vc12.

The ejection abnormality detection circuit CT detects a change of electromotive force of the piezoelectric elements 300 of the ejection unit D during the switching period Td, as the residual vibration signal Vout.

Figure 19:
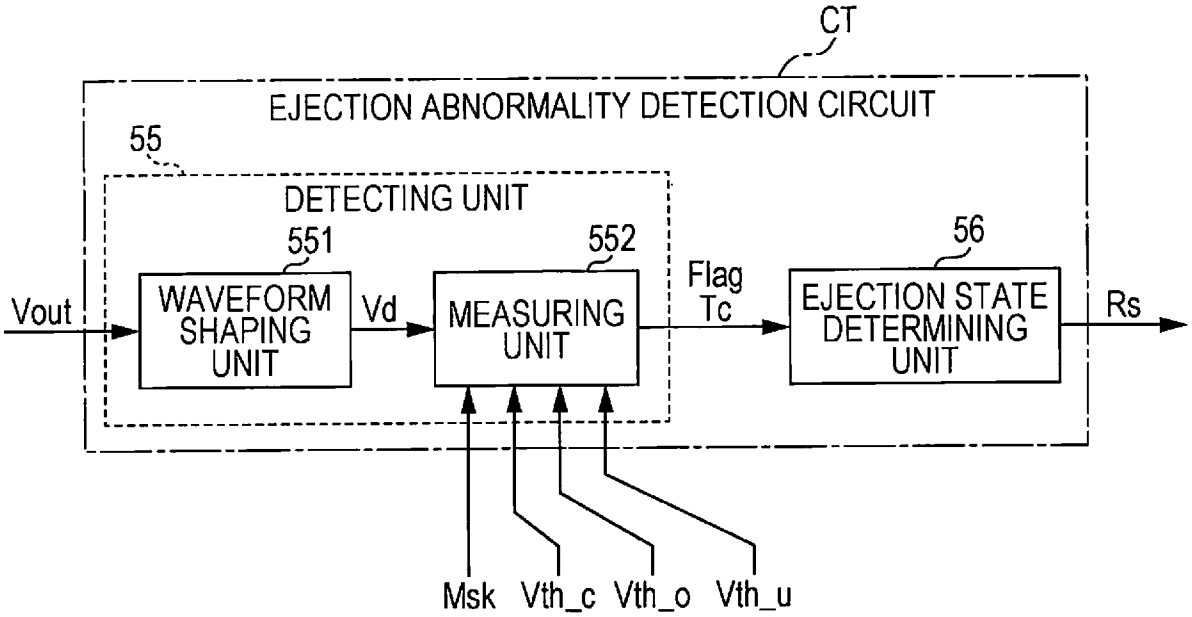
FIG. 19 is a block diagram illustrating a configuration of an ejection abnormality detection circuit.

FIG. 19 is a block diagram illustrating a configuration of the ejection abnormality detection circuit CT included in the ejection abnormality detecting unit 52.

As illustrated in FIG. 19, the ejection abnormality detection circuit CT includes a detecting unit 55 that outputs a detection signal Tc representing a time length corresponding to one cycle of the residual vibration of the ejection unit D based on the residual vibration signal Vout, and an ejection state determining unit 56 that determines the ejection state in the ejection unit D (that is, determines the presence of the ejection abnormality, and determine the causes of the ejection abnormality when the ejection abnormality is present) to output a determination result signal Rs representing the determination result.

The detecting unit 55 includes a waveform shaping unit 551 that generates a shaping waveform signal Vd obtained by removing a noise component or the like from the residual vibration signal Vout output from the ejection unit D, and a measuring unit 552 that generates the detection signal Tc based on the shaping waveform signal Vd.

The waveform shaping unit 551 includes a high-pass filter for outputting a signal in which a low-band frequency component lower than a frequency bandwidth of the residual vibration signal Vout is damped, and a low-pass filter for outputting a signal in which a high-band frequency component is higher than the frequency band of the residual vibration signal Vout, and a configuration capable of outputting the shaping waveform signal Vd from which the noise component is removed by limiting a frequency range of the residual vibration signal Vout. Moreover, the waveform shaping unit 551 may include a negative feedback type amplifier for adjusting the amplitude of the residual vibration signal Vout and a voltage follower for converting an impedance of the residual vibration signal Vout to output the shaping waveform signal Vd of a low impedance.

The shaping waveform signal Vd obtained by shaping the residual vibration signal Vout in the waveform shaping unit 551, a mask signal Msk generated by the control unit 6, a threshold potential Vth_c determined as a potential of an amplitude center level of the shaping waveform signal Vd, a threshold potential Vth_o determined as a high potential higher than the threshold potential Vth_c, and a threshold potential Vth_u determined as a low potential lower than the threshold potential Vth_c are supplied to the measuring unit 552. The measuring unit 552 outputs the detection signal Tc and an effective flag Flag indicating whether the detection signal Tc is an effective value based on these signals.

Figure 20:
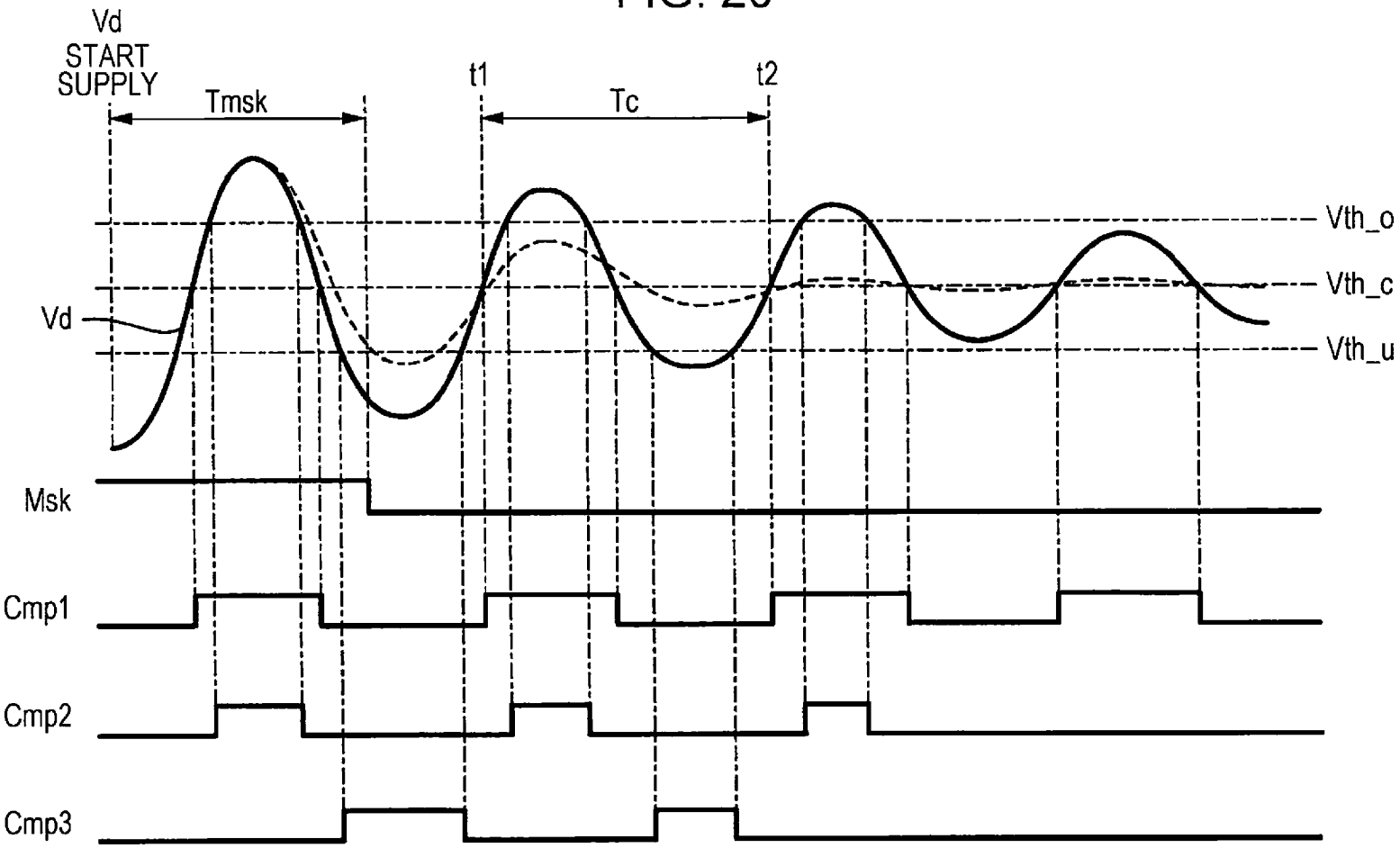
FIG. 20 is a timing chart illustrating an operation of the ejection abnormality detection circuit.

FIG. 20 is a timing chart illustrating an operation of the measuring unit 552.

As illustrated in the figure, the measuring unit 552 compares a potential indicated by the shaping waveform signal Vd with the threshold potential Vth_c, and generates a comparison signal Cmp1 which is in a high level when the potential indicated by the shaping waveform signal Vd is equal to or more than the threshold potential Vth_c and is in a low level when the potential indicated by the shaping waveform signal Vd is less than the threshold potential Vth-c.

Moreover, the measuring unit 552 compares the potential indicated by the shaping waveform signal Vd with the threshold potential Vth_o, and generates a comparison signal Cmp2 which is in a high level when the potential indicated by the shaping waveform signal Vd is equal to or more than the threshold potential Vth_o and is in a low level when the potential indicated by the shaping waveform signal Vd is less than the threshold potential Vth_o.

Moreover, the measuring unit 552 compares the potential indicated by the shaping waveform signal Vd with the threshold potential Vth_u, and generates a comparison signal Cmp3 which is in a high level when the potential indicated by the shaping waveform signal Vd is less than the threshold potential Vth_u and is in a low level when the potential indicated by the shaping waveform signal Vd is equal to or more than the threshold potential Vth_u.

The mask signal Msk is a signal which is in a high level only during a predetermined period Tmsk after the supply of the shaping waveform signal Vd from the waveform shaping unit 551 is started. In the present embodiment, it is possible to obtain a high-accuracy detection signal Tc from which the superimposed noise components are removed immediately after the residual vibration starts by generating the detection signal Tc with only the shaping waveform signal Vd after the period Tmsk elapses as a target among the shaping waveform signals Vd.

The measuring unit 552 includes a counter (not illustrated). After the mask signal Msk falls to a low level, the counter starts to count the clock signal (not illustrated) at a time t1 which is a timing when the potential indicated by the shaping waveform signal Vd becomes equivalent to the threshold potential Vth_c for the first time. That is, after the mask signal Msk falls to the low level, the counter starts to count at a time t1 which is an earlier timing between a timing when the comparison signal Cmp1 rises to a high level for the first time and a timing when the comparison signal Cmp1 falls to a low level for the first time.

In addition, after the counter starts counting, the counter stops counting the clock signal at a time t2 which is a timing when the potential indicated by the shaping waveform signal Vd becomes the threshold potential Vth_c for the second time, and outputs the obtained count value as the detection signal Tc. That is, after the mask signal Msk falls to the low level, the counter stops counting at a time t2 which is an earlier timing between a timing when the comparison signal Cmp1 rises to a high level for the second time and a timing when the comparison signal Cmp1 falls to a low level for the second time. In this manner, the measuring unit 552 generates the detection signal Tc by measuring a time length from the time t1 to the time t2 as a time length corresponding to one cycle of the shaping waveform signal Vd.

In addition, when the amplitude of the shaping waveform signal Vd is small as indicated by a dashed line in FIG. 20, the possibility that the detection signal Tc cannot be accurately measured becomes high. Moreover, when the amplitude of the shaping waveform signal Vd is small, even when it is determined that the ejection state of the ejection unit D is normal based on only the result of the detection signal Tc, it is likely that the ejection abnormality may occur. For example, when the amplitude of the shaping waveform signal Vd is small, it is considered that the ink cannot be ejected because the ink is not injected into the cavity 320.

Here, in the present embodiment, it is determined whether the amplitude of the shaping waveform signal Vd has a magnitude sufficient to measure the detection signal Tc to output the determination result as the effective flag Flag.

Specifically, the measuring unit 552 outputs the effective flag Flag by setting a value of the effective flag Flag to a value "1" indicating that the detection signal Tc is effective when the potential indicated by the shaping waveform signal Vd is more than the threshold potential Vth_o and is less than the threshold potential Vth_u and by setting the value of the effective flag to "0" in other cases during the period for which the counting is performed by the counter, that is, the period from the time t1 to the time t2. More specifically, the measuring unit 552 sets the value of the effective flag Flag to "1" when the comparison signal Cmp2 rises to the high level from the low level and then falls to the low level again and the compassion signal Cmp3 rises to the high level from the low level and then falls to the low level again during the period from the time t1 to the time t2, and sets the value of the effective flag Flag to "0."

In the present embodiment, since the measuring unit 552 determines whether the shaping waveform signal Vd has the amplitude of magnitude sufficient to measure the detection signal Tc in addition to generating the detection signal Tc indicating the time length corresponding to the one cycle of the shaping waveform signal Vd, it is possible to more accurately detect the ejection abnormality.

The ejection state determining unit 56 determines the ejection state of the ink in the ejection unit D based on the detection signal Tc and the effective flag Flag, and outputs the determination result as the determination result signal Rs.

FIG. 21 is an explanatory diagram for describing the contents of determination of the ejection state determining unit 56. As illustrated in the figure, the ejection state determining unit 56 compares the time length indicated by the detection signal Tc with three threshold values (alternatively, any threshold value among these three threshold values) of a threshold value Tth1, a threshold value Tth2 representing a time length longer than the threshold value Tth1, and a threshold value Tth3 representing a time length longer than the threshold value Tth2.

Here, the threshold value Tth1 is a value for indicating a boundary between a time length corresponding to one cycle of the residual vibration when bubbles are generated in the cavity 320 so that the frequency of the residual vibration increases and a time length corresponding to one cycle of the residual vibration when the ejection state is normal.

Moreover, the threshold value Tth2 is a value for indicating a boundary between a time length corresponding to one cycle of the residual vibration when paper dust is adhered to the vicinity of the outlet of the nozzle N so that the frequency of the residual vibration decreases and a time length corresponding to one cycle of the residual vibration when the ejection state is normal.

Moreover, the threshold value Tth3 is a value for indicating a boundary between a time length corresponding to one cycle of the residual vibration when the frequency of the residual vibration becomes further smaller than that when paper dust is adhered due to fixation or thickening of the ink in the vicinity of the nozzle N and a time length corresponding to one cycle of the residual vibration when paper dust is adhered to the vicinity of the outlet of the nozzle N.

As illustrated in FIG. 21, when the value of the effective flag Flag is "1" and satisfies "TTH1≤Tc≤TTH2," the ejection state determining unit 56 determines that the ejection state of the ink in the ejection unit D is normal, and sets the determination result signal Rs to a value "1" indicating that the ejection state is normal. Moreover, when the value of the effective flag Flag is "1" and satisfies "Tc<TTH1," the ejection state determining unit 56 determines that the ejection abnormality occurs due to bubbles generated in the cavity 320, and sets the determination result signal Rs to a value "2" indicating that the ejection abnormality occurs due to the bubbles. Moreover, when the value of the effective flag Flag is "1" and satisfies "TTH2<Tc≤TTH3," the ejection state determining unit 56 determines that the ejection abnormality occurs due to paper dust adhered to the vicinity of the outlet of the nozzle N, and sets the determination result signal Rs to a value "3" indicating that the ejection abnormality occurs due to the paper dust. Moreover, when the value of the effective flag Flag is "1" and satisfies "TTH3<Tc," the ejection state determining unit 56 determines that the ejection abnormality occurs due to thickening of the ink in the vicinity of the nozzles N, and sets the determination result signal Rs to a value "4" indicating that the ejection abnormality occurs due to the thickening of the ink. Moreover, when the value of the effective flag Flag is "0," the ejection state determining unit 56 sets the determination result signal Rs to a value "5" indicating that the ejection abnormality occurs due to some causes such as non-injection of the ink to the determination result signal Rs.

As described above, the ejection state determining unit 56 determines the ejection state in the ejection unit D, and outputs the determination result as the determination result signal Rs. For this reason, the control unit 6 can grasp the ejection unit D in which ejection abnormality occurs, from among 4M ejection units D based on the determination result signal Rs.

The control unit 6 stores the determination result signal Rs output by the ejection state determining unit 56 in the storage unit 62 in correspondence with information (for example, the number of stages) for recognizing the ejection unit D corresponding to the determination result signal Rs.

In addition, although the details will be described below, the control unit 6 controls the operation of the ink jet printer 1 such that the printing process is stopped and the maintenance process is performed or controls the operation of the ink jet printer 1 such that the printing process is continued and the complementing process is performed in the case where ejection abnormality occurs. In this manner, in the ink jet printer 1 according to the present embodiment, it is possible to minimize a decrease in the print quality caused by ejection abnormality.

4. Complementing Process

Next, the complementing process performed by the ink jet printer 1 will be described with reference to FIGS. 22 to 27.

4.1. Outline of Complementing Process

As described above, the ink jet printer 1 performs a complementing process of complementing one nozzle N with another nozzle N in a case where ejection abnormality occurs in the one nozzle N. A plurality of nozzles N may complement a nozzle N in which ejection abnormality occurs and the nozzle N in which ejection abnormality occurs in the present embodiment is complemented with three nozzles N.

Hereinafter, the nozzle N in which ejection abnormality occurs is referred to as an ejection abnormality nozzle N-TG (or simply referred to as a "nozzle N-TG"). In the present embodiment, the complementing process is performed in a case where the nozzle N-TG is a nozzle N that belongs to the nozzle array Ln-BK and ejects a black (BK) ink.

In addition, hereinafter, a nozzle N complementing the nozzle N-TG is collectively referred to as a complementation nozzle N-D (or simply referred to as a "nozzle N-D").

In the present embodiment, the nozzle N-CY belonging to the nozzle array Ln-CY, the nozzle N-MG belonging to the nozzle array Ln-MG, and the nozzle N-YL belonging to the nozzle array Ln-YL are employed as a nozzle N-D. Further, in the present embodiment, the nozzle N-D (N-CY, N-MG, and N-YL) is a nozzle N whose position is approximately the same as that of the nozzle N-TG in the Y axis direction as illustrated in FIG. 22.

In this manner, the ink jet printer 1 according to the present embodiment performs the complementing process of complementing the nozzle N-TG with three nozzles N-D (nozzle N-CY, N-MG, and N-YL) in a case where ejection abnormality occurs in the nozzle N-TG.

Figure 22:
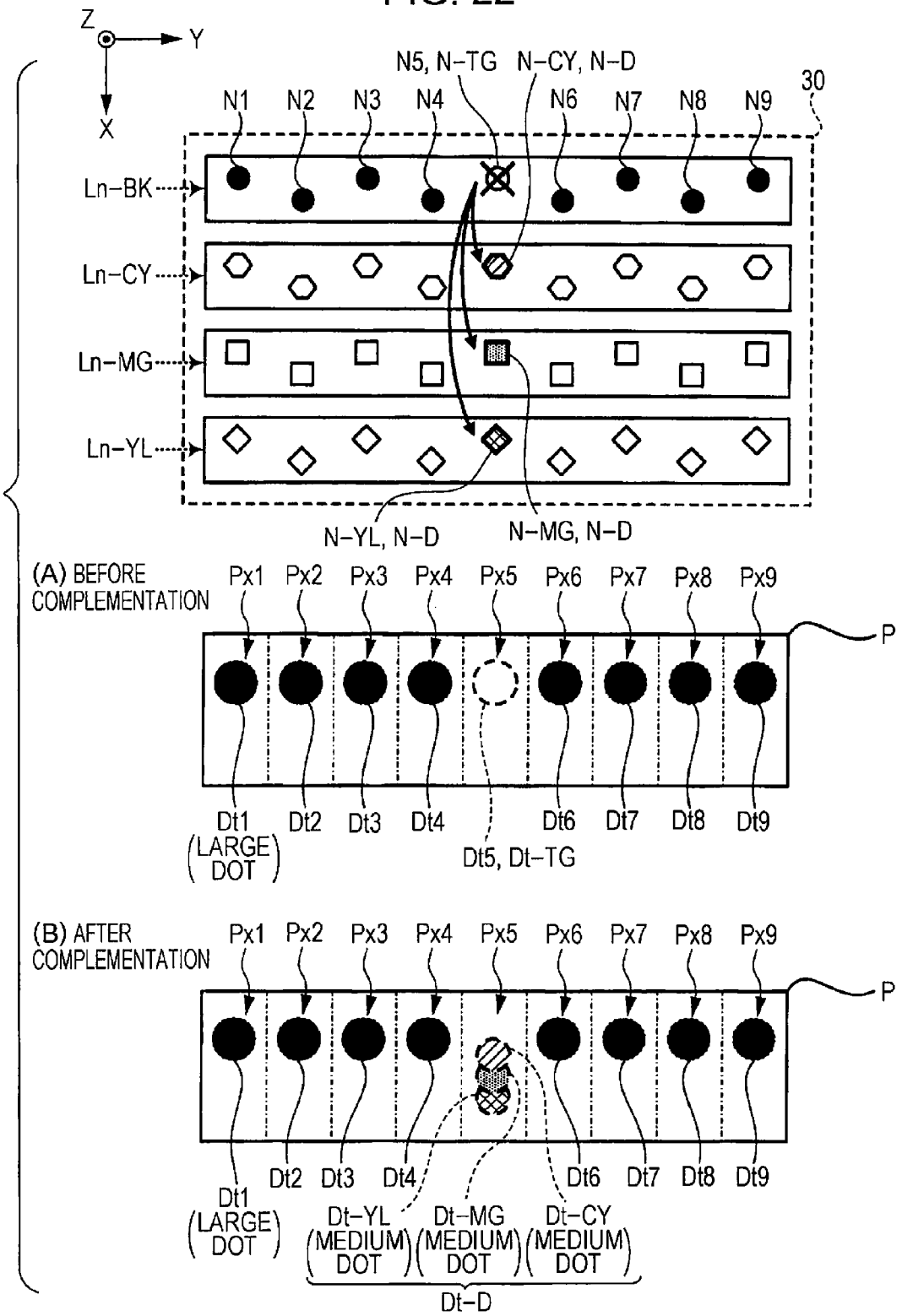
FIG. 22 is an explanatory diagram for describing a complementing process.

FIG. 22 illustrates the complementing process in a case where each of the four nozzle arrays Ln-BK to Ln-YL includes nine nozzles N (that is, M is nine).

More specifically, as illustrated in (A) of FIG. 22, in a case where black (BK) dots Dt1 to Dt9 which are large dots are formed in the pixels Px1 to Px9 of the recording paper P by allowing each of the nine nozzles N1 to N9 belonging to the nozzle array Ln-BK to eject an ink of a large amount in order to form an image shown by the print data PD onto the recording paper P, a case where ejection abnormality occurs in the nozzle N5 and thus the dot Dt5 cannot be formed in the pixel Px5 by ejection of an ink from the nozzle N5 is assumed. That is, in the example of FIG. 22, the nozzle N5 corresponds to the ejection abnormality nozzle N-TG.

In addition, as illustrated in (B) of FIG. 22, a case of forming a medium-sized dot Dt-CY formed by a cyan (CY) ink ejected from the nozzle N-CY; a medium-sized dot Dt-MG formed by a magenta (MG) ink ejected from the nozzle N-MG; and a medium-sized dot Dt-YL formed by a yellow (YL) ink ejected from the nozzle N-YL are formed by performing the complementing process in the pixel Px5 instead of a dot Dt5 which is expected to be formed by an ink ejected from the nozzle N5 is exemplified.

Hereinafter, the dot Dt which is expected to be formed by an ink ejected from the nozzle N-TG is referred to as a "complemented dot Dt-TG" (or simply referred to as a "dot Dt-TG"). In addition, the dot Dt to be formed by an ink ejected from each nozzle N-D is referred to as a "complemented dot Dt-D" (or simply referred to as a "dot Dt-D").

In the example of FIG. 22, the dot Dt5 corresponds to the dot Dt-TG and each of the dots Dt-CY, Dt-MG, and Dt-YL corresponds to the dot Dt-D.

Further, in FIG. 22, a case where the nozzle N-D is a nozzle N which is expected not to eject an ink when the complementing process is not performed is exemplified, but the nozzle N-D may be a nozzle N which is expected to eject an ink even when the complementing process is not performed.

As described above, the case where "the amount of an ink ejected from the nozzle N-D is increased" includes a case where the ejection amount of an ink when the complementing process is performed is adjusted to be larger than the ejection amount of an ink when the complementing process is not performed in the nozzle N which is expected to eject an ink even when the complementing process is not performed and a case where an ink is ejected to perform the complementing process in a nozzle N which is expected not to eject the ink when the complementing process is not performed. That is, the ink jet printer 1 performs the complementing process by increasing the amount of an ink ejected from the nozzle N-D compared to a case where it is assumed that the complementing process is not performed.

Hereinafter, in a case where it is assumed that ejection abnormality has not occurred, the amount of an ink which is expected to be ejected from the nozzle N-TG is referred to as an ejection amount Q-TG. That is, the ejection amount Q-TG is an amount of an ink to be ejected from the nozzle N-TG in order to form an image shown by the print data PD.

Further, a difference between the amount of an ink to be ejected from the nozzle N-D when the complementing process is performed (hereinafter, also referred to as an "ejection amount after complementation") and the amount of an ink ejected from the nozzle N-D which is expected to be used when it is assumed that the complementing process is not performed (hereinafter, also referred to as an "ejection amount before complementation") is referred to as an increase amount Q-D. That is, the ejection amount before complementation is an amount of an ink to be ejected from the nozzle N-D in order to form an image shown by the print data PD, the ejection amount after complementation is an amount of an ink to be actually ejected from the nozzle N-D when the complementing process is performed, and the increase amount Q-D is an amount of increase accompanied by the complementing process in the amount of an ink ejected from the nozzle N-D.

Further, when distinction is particularly needed, in the increase amount Q-D, a difference between the ejection amount after complementation and the ejection amount before complementation in the nozzle N-CY is referred to as an increase amount Q-CY (that is, an increase amount accompanied by the complementing process in the amount of an ink to be ejected from the nozzle N-CY); a difference between the ejection amount after complementation and the ejection amount before complementation in the nozzle N-MG is referred to as an increase amount Q-MG (that is, an increase amount accompanied by the complementing process in the amount of an ink to be ejected from the nozzle N-MG); and a difference between the ejection amount after complementation and the ejection amount before complementation in the nozzle N-YL is referred to as an increase amount Q-YL (that is, an increase amount accompanied by the complementing process in the amount of an ink to be ejected from the nozzle N-YL). That is, the increase amount Q-D is a general term of the increase amounts Q-CY, Q-MG, and Q-YL.

In the ink jet printer 1 according to the present embodiment, the complementing process is performed such that each increase amount Q-D (Q-CY, Q-MG, and Q-YL) becomes smaller than the ejection amount Q-TG.

In the case where an ink with an amount larger than or equal to the amount which can be accepted by the recording paper P is ejected to the recording paper P, wavy cockling is generated on the recording paper P or an ink which has not been accepted by the recording paper P is diffused on the surface or the inside of the recording paper P and then bleeding of the ink occurs. Such cockling of the recording paper P or bleeding of an ink is a factor of degradation of the image quality of an image to be formed on the recording paper P.

Particularly, in a case where three dots Dt-D are formed instead of forming one dot Dt-TG or the size of three dots Dt-D is adjusted to be larger instead of forming one dot Dt-TG in the complementing process, since the total amount of an ink to be ejected onto the recording paper P becomes larger when a plurality of nozzles N-TG having ejection abnormality are present, the possibility that the image quality is degraded caused by cockling of the recording paper P or bleeding of an ink becomes higher.

Meanwhile, in the present embodiment, since the complementing process is performed such that the increase amount Q-D becomes smaller than the ejection amount Q-TG, it is possible to minimize the extent of an increase in the total amount of an ink to be ejected onto the recording paper P accompanied by the complementing process and to suppress the possibility that degradation of the image quality occurs caused by cockling of the recording paper P or bleeding of an ink compared to the case where the increase amount Q-D is equal to or larger than the ejection amount Q-TG.

4.2. Operation of Control Unit in Complementing Process

The control unit 6 controls execution of the complementing process described above.

Figure 23:
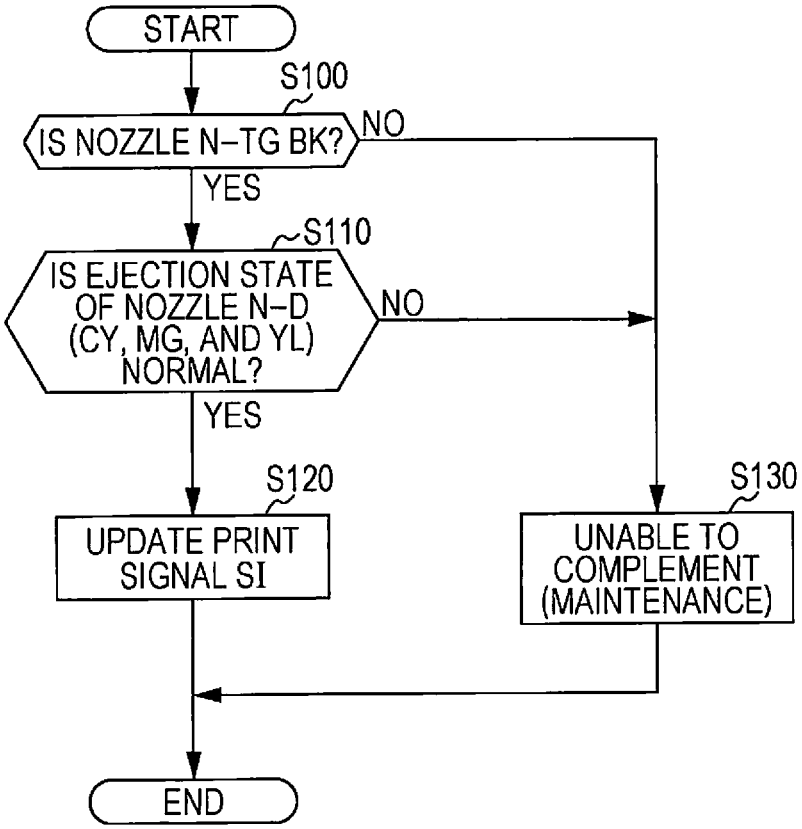
FIG. 23 is a timing chart illustrating an operation of a control unit during the complementing process.

FIG. 23 is a flowchart for describing an example of the flow of the process performed by the control unit 6 during the complementing process. Hereinafter, an example of the flow of the process performed by the control unit 6 during the complementing process will be described with reference to FIG. 23.

The control unit 6 starts the process illustrated in FIG. 23 in a case where the ejection abnormality nozzle N-TG in which ejection abnormality occurs in the ejection state determining process is detected. Further, the control unit 6 performs the process illustrated in FIG. 23 with respect to each of a plurality of nozzles N-TG in a case where the plurality of nozzles N-TG detected in the ejection state determining process are present.

As illustrated in FIG. 23, first, the control unit 6 determines whether the nozzle N-TG is a nozzle N ejecting a black (BK) ink (Step S100).

The control unit 6 determines whether the ejection state of three nozzles N-D (the nozzles N-CY, N-MG, and N-YL) corresponding to the nozzle N-TG is normal, that is, whether complementation of the nozzle N-TG with the three nozzles N-D (nozzles N-CY, N-MG, and N-YL) is possible by referring to the determination result signal Rs stored in the storage unit 62 in a case where the determination result in Step S100 is positive, that is, the nozzle N-TG is a nozzle N ejecting a black (BK) ink (Step S110).

In a case where the determination result in Step S100 or S110 is negative, complementation of the nozzle N-TG with the three nozzles N-D (nozzles N-CY, N-MG, and N-YL) is not possible. For this reason, the control unit 6 controls operations of respective units of the ink jet printer 1 such that the maintenance process is performed with respect to the nozzle N-TG in a case where the determination result in Step S100 or S110 is negative (Step S130).

In addition, the maintenance process with respect to the nozzle N-TG may be performed immediately after the determination result in Step S100 or S110 is negative or may be performed after a series of printing processes with respect to the recording paper P is completed. In this case, in a case where the printing process is performed in a state in which the ejection state of the ejection unit D is abnormal, the image quality of an image to be printed in the printing process is degraded. For this reason, it is preferable that the maintenance process is performed until the printing process is initially started after the ejection state determining process is performed.

The control unit 6 updates values shown by the printing signal SI based on the information stored in the printing signal conversion table TBL stored in the storage unit 62 in a case where the determination result in Step S110 is positive (Step S120).

FIG. 24 is an explanatory diagram illustrating an example of a data structure of the printing signal conversion table TBL. As illustrated in FIG. 24, the printing signal conversion table TBL stores the ejection amount Q-TG which is expected to be ejected when ejection abnormality has not occurred in the nozzle N-TG, the ejection amount before complementation in the nozzle N-D (N-CY, N-MG, and N-YL), and the ejection amount after complementation in the nozzle N-D (N-CY, N-MG, and N-YL) in an associated manner.

Further, in FIG. 24, for the sake of convenience of description, a case where the printing signal conversion table TBL stores the increase amount Q-D which is a difference between the ejection amount after complementation and the ejection amount before complementation in the nozzle N-D is exemplified, but the printing signal conversion table TBL may not store the ejection amount Q-D.

Further, in FIG. 24, a case where the ejection amount (weight) of an ink necessary for forming small dots is 10 ng, a case where the ejection amount (weight) of an ink necessary for forming medium dots is 20 ng, and a case where the ejection amount (weight) of an ink necessary for forming large dots is 30 ng are assumed. In addition, a case where the printing signal conversion table TBL stores various ejection amounts such as the ejection amount Q-TG, the ejection amount before complementation in the nozzle N-D, and the ejection amount after complementation in the nozzle N-D with values showing the weight of an ink is exemplified. In this case, the printing signal conversion table TBL may express various ejection amounts with values showing the kind of dot. For example, the printing signal conversion table TBL may express the non-recording state as "0," a small dot as "1," a medium dot as "2," and a large dot as "3."

The control unit 6 generates the printing signal SI based on the print data PD before the control unit 6 performs the process in Step S120.

Specifically, the control unit 6 generates the printing signal SI including a value showing the ejection amount Q-TG which is the amount of an ink to be ejected from the nozzle N-TG in order to form an image shown by the print data PD and a value showing the amount (ejection amount before complementation) of an ink to be ejected from the nozzle N-D in order to form an image shown by the print data PD based on the print data PD before the control unit performs the process in Step S120.

Further, first, the control unit 6 accesses the printing signal conversion table TBL and specifies a record in which the ejection amount Q-TG of the nozzle N-TG shown by the printing signal SI is recorded and the ejection amount before complementation of the nozzle N-D shown by the printing signal SI is recorded from a plurality of records stored in the printing signal conversion table TBL in Step S120.

Next, the control unit 6 updates values shown by the printing signal SI such that the ejection amount of an ink ejected from the nozzle N-D becomes the ejection amount after complementation stored in the specified record in Step S120.

Moreover, the control unit 6 updates values of the printing signal SI such that the ejection amount of an ink ejected from the nozzle N-TG enters the non-recording state (0 ng) in Step S120.

In addition, the control unit 6 performs the process of Step S120 described above with respect to each of the three nozzles N-D (N-CY, N-MG, and N-YL).

In this manner, the control unit 6 updates values shown by the printing signal SI such that the amount of an ink ejected from the nozzle N-TG becomes 0 ng (the non-recording state) or updates values shown by the printing signal SI such that the amounts of inks ejected from the three nozzles N-D (N-CY, N-MG, and N-YL) complementing the nozzle N-TG are increased in a case where the nozzle N-TG in which ejection abnormality has occurred is a nozzle N to eject a black (BK) ink. In addition, the control unit 6 controls execution of the complementing process by supplying the updated printing signal SI with respect to the head unit 5.

Meanwhile, values shown by the printing signal SI are generally updated such that the amount of an ink to be ejected from the nozzle N-D is increased in Step S120.

In this case, in the present embodiment, as illustrated in FIG. 24, there are two exceptions that do not update values showing the amount of an ink ejected from the nozzle N-D among values shown by the printing signal SI in Step S120.

As illustrated in FIG. 24, the first exception is a case where the dot Dt-TG which is expected to be formed by the nozzle N-TG is a small-sized dot. In this case, the amount of an ink ejected from the nozzle N-D is not changed regardless of whether the complementing process is performed. That is, in a case of the first exception, complementation is not substantially performed with respect to the nozzle N-TG.

In a case where the dot Dt-TG is a small-sized dot, influence on the image quality caused by the dot Dt-TG being not formed is small compared to a case where the dot Dt-TG is a medium-sized dot or a large-sized dot. For this reason, even when the first exception is present, the extent of degradation in the image quality is small.

The second exception is a case where the ejection amounts before complementation of the three nozzles N-D complementing the nozzle N-TG are all amounts corresponding to large-sized dots. In this case, the amount of an ink to be ejected from the nozzle N-D is not changed regardless of whether the complementing process is performed. That is, in the case of the second exception, complementation with respect to the nozzle N-TG is not substantially performed.

In a case where the ejection amounts before complementation of the three nozzles N-D are all amounts corresponding to the large-sized dots. Even when the amount of an ink ejected from each nozzle N-D is not increased, three large-sized dots Dt-D are formed. That is, in this case, it is possible to show a black (BK) dot Dt-TG using three dots Dt-D. Therefore, even when the second exception is present, the extent of degradation of the image quality is small.

Further, as described above, the nozzles N-CY, N-MG, and N-YL are employed as the nozzle N-D in the present embodiment. For this reason, at least one dot from among the three dots Dt-D (dots Dt-CY, Dt-MG, and Dt-YL) is not a large-sized dot, and the amount of an ink ejected from the nozzle N-D corresponding to the dot Dt-D which is not a large-sized dot is increased in Step S120.

As described above, in step S120, the control unit 6 updates values shown by the printing signal SI based on information stored in the printing signal conversion table TBL illustrated in FIG. 24. For this reason, it is possible to reduce the increase amount Q-D more than the ejection amount Q-TG and to suppress the possibility of a decrease of the image quality caused by cockling of the recording paper P or bleeding of an ink.

In addition, the information stored in the printing signal conversion table TBL described with reference to FIG. 24 is merely an example and the information stored in the printing signal conversion table TBL may be suitably changed according to the characteristics of an ink, the characteristics of the recording paper P, and the image quality required for printing.

For example, the printing signal conversion table TBL may store the ejection amount after complementation of the nozzle N-D in which the first exception and the second exception described above are not generated. Specifically, the printing signal conversion table TBL may store the ejection amount after complementation of the nozzle N-D in such that the increase amount Q-D becomes smaller than the ejection amount Q-TG and the ejection amount from the nozzle N-D in the complementing process is increased even when the ejection amount before complementation of the nozzle N-D is any value in a case where the ejection amount Q-TG is a value other than the non-recording value as illustrated in FIG. 25.

In addition, in the case illustrated in FIG. 25, the control unit 6 and the head driver 50 may generate various signals such as the driving waveform signal Com, the printing signal SI, and the driving signal Vin such that the ejection units D can form eight kinds of dot Dt, for example, the non-recording state (0 ng); a dot smaller than a small-sized dot (for example, 5 ng); a small-sized dot (for example, 10 ng); a dot between a small-sized dot and a medium-sized dot (for example, 15 ng), a medium-sized dot (for example, 20 ng), a dot between a medium-sized dot and a large-sized dot (for example, 25 ng), a large-sized dot (for example, 30 ng); and a dot larger than a large-sized dot (for example, 35 ng).

Further, in the present embodiment, the ejection amount after complementation of the nozzle N-D is determined such that the increase amount Q-D becomes smaller than the ejection amount Q-TG in the complementing process, but an exception (third exception) may be present such that the increase amount Q-D becomes equal to or more than the ejection amount Q-TG.

Specifically, the printing signal conversion table TBL may store the ejection amount after complementation of the nozzle N-D so as to include the third exception in which the increase amount Q-D becomes equal to or more than the ejection amount Q-TG as illustrated in FIG. 26.

4.3. Relationship Between Complementing Process and Ink Color

Figure 27:
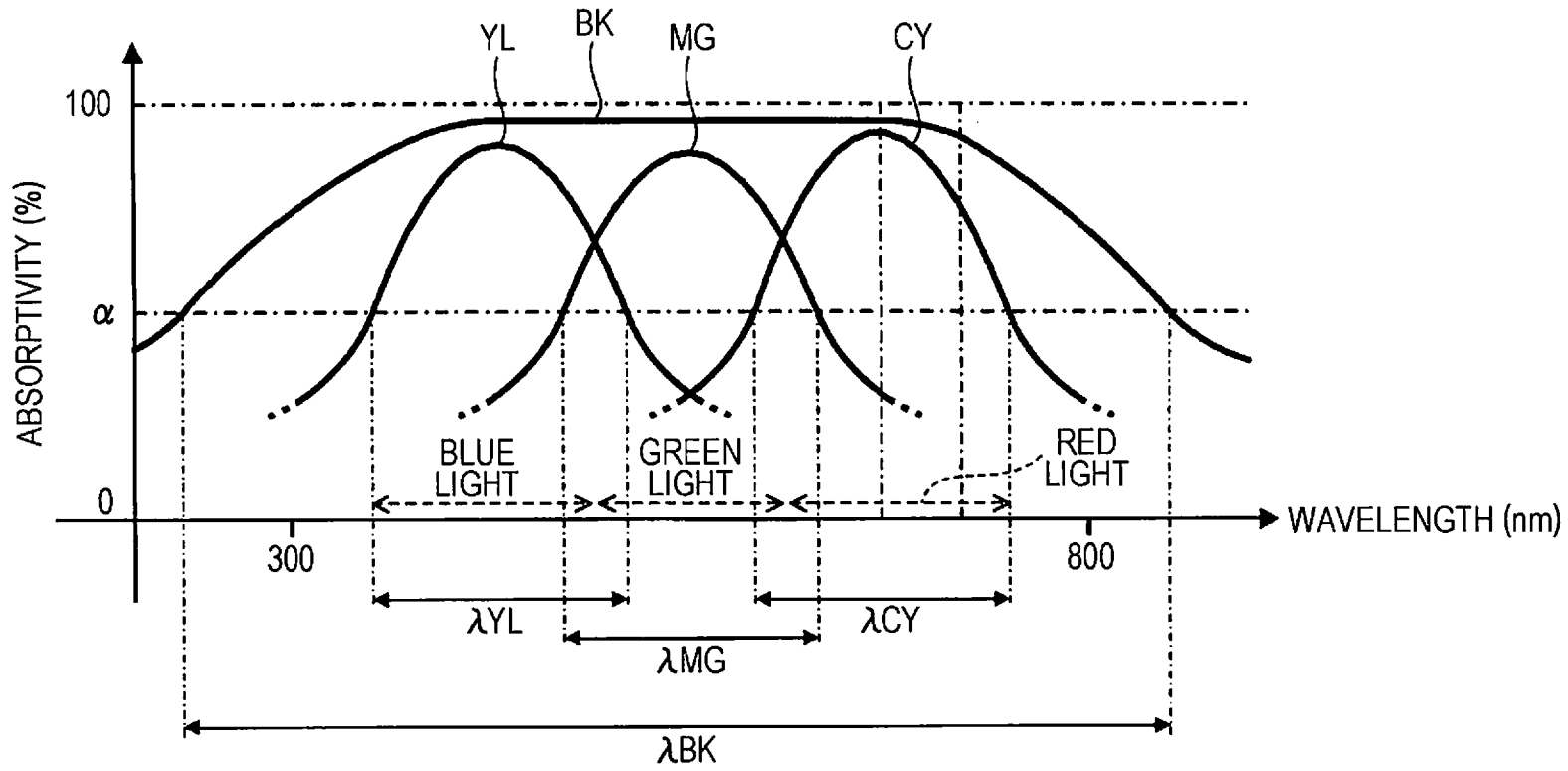
FIG. 27 is an explanatory diagram for describing absorption characteristics of an ink with respect to light.

FIG. 27 is an explanatory diagram for describing the absorption characteristics (accurately, light absorption characteristics of an ink per unit volume or unit weight) of light of a cyan (CY) ink, a magenta (MG) ink, a yellow (YL) ink and a black (BK) ink, that is, the wavelength of light absorbed by each color of ink.

As illustrated in FIG. 27, a yellow (YL) ink absorbs blue light (light having a wavelength of approximately 380 nm to 500 nm) in visible light (light having a wavelength of approximately 380 nm to 750 nm); a magenta (MG) ink absorbs green light (light having a wavelength of approximately 500 nm to 600 nm) in visible light; a cyan (CY) ink absorbs red light (light having a wavelength of approximately 600 nm to 750 nm) in visible light; and a black (BK) ink absorbs the entire spectrum of visible light.

That is, a yellow (YL) ink is recognized as yellow (YL) for reflection of green light and red light; a magenta (MG) ink is recognized as magenta (MG) for reflection of blue light and red light; a cyan (CY) ink is recognized as cyan (CY) for reflection of blue light and green light; and a black (BK) ink is recognized as black (BK) since the black ink does not reflect any of blue light, green light, and red light.

As illustrated in FIG. 27, a wavelength region of visible light absorbed by a cyan (CY) ink is referred to as a wavelength region λCY; a wavelength region of visible light absorbed by a magenta (MG) ink is referred to as a wavelength region λMG; a wavelength region of visible light absorbed by a yellow (YL) ink is referred to as a wavelength region λYL; and a wavelength region of visible light absorbed by a black (BK) ink is referred to as a wavelength region λBK.

Moreover, in the present specification, "absorbing light" is not necessarily limited to a case of absorbing light at a rate of 100% and includes a case of absorbing light at a rate equal to or more than a predetermined rate a. In addition, "reflecting light" includes a case of absorbing light in the light at a rate less than the predetermined rate a and reflecting the remaining light.

Here, the predetermined rate a may be suitably determined according to the characteristics of the ink to be used in the ink jet printer 1, the characteristics of the recording paper P or the image quality of an image to be printed and, for example, may be an arbitrary value in the range of 30% to 100%. In the present embodiment, the predetermined rate a is set to 50% as an example.

As illustrated in FIG. 27, a part of the wavelength region λBK overlaps at least a part of the wavelength region λCY, a part of the wavelength region λBK overlaps at least a part of the wavelength region λMG, and a part of the wavelength region λBK overlaps at least a part of the wavelength region λYL. In addition, at least a part of the wavelength region in which the wavelength region λCY is removed from the wavelength region λBK overlaps at least a part of the wavelength region λMG or at least a part of the wavelength region λYL, at least a part of the wavelength region in which the wavelength region λMG is removed from the wavelength region λBK overlaps at least a part of the wavelength region λCY or at least a part of the wavelength region λYL, and at least a part of the wavelength region in which the wavelength region λYL is removed from the wavelength region λBK overlaps at least a part of the wavelength region λCY or at least a part of the wavelength region λMG.

As described above, most of the light of the wavelength region λBK to be absorbed by a black (BK) ink can be absorbed by three kinds of inks which are a cyan (CY) ink, a magenta (MG) ink, and a yellow (YL) ink. For this reason, even in a case where the nozzle N-TG that ejects a black (BK) ink is complemented with three kinds of nozzles N-D which are the nozzle N-CY that ejects a cyan (CY) ink, the nozzle N-MG that ejects a magenta (MG) ink, and the nozzle N-YL that ejects a yellow (YL) ink, that is, a cyan (CY) dot Dt-CY, a magenta (MG) dot Dt-MG, and a yellow (YL) dot Dt-YL are formed instead of a black (BK) dot Dt-TG, the user of the ink jet printer 1 can recognize that a black (BK) dot Dt-TG is formed.

Further, in the complementing process according to the present embodiment, as illustrated in FIGS. 24 to 26, in a case where the ejection amounts before complementation of the nozzles N-CY, N-MG, and N-YL are the same as one another, the ejection amounts after complementation from the nozzles N-D (N-CY, N-MG, and N-YL) are determined such that the increase amounts Q-CY, Q-MG, and Q-YL become the same as one another. In other words, as illustrated in FIGS. 24 to 26, it is determined that the ejection amounts after complementation of the nozzles N-CY, N-MG, and N-YL in each record of the printing signal conversion table TBL become the same as one another.

However, the invention is not limited to such an aspect and the ejection amounts after complementation of the nozzles N-CY, N-MG, and N-YL in each record of the printing signal conversion table TBL may not become the same as one another. That is, the increase amounts Q-CY, Q-MG, and Q-YL may not be the same as one another in the case where the ejection amounts before complementation of the nozzles N-CY, N-MG, and N-YL are the same as one another.

For example, the ejection amounts after complementation in each record of the printing signal conversion table TBL may be determined such that the increase amount Q-D from the nozzle N-D ejecting an ink corresponding to a wavelength region having a widest width among the wavelength regions λCY, λMG, and λYL becomes larger than the increase amount Q-D from another nozzle N-D. In this case, the increase amounts Q-CY, Q-MG, and Q-YL can be reduced as a whole and a black (BK) dot Dt-TG can be efficiently reproduced.

5. Conclusion of First Embodiment

As described above, in the present embodiment, the ejection abnormality nozzle N-TG that ejects a black (BK) ink is complemented with three complementation nozzles N-D (N-CY, N-MG, and N-YL). For this reason, even when ejection abnormality occurs in the nozzle N-TG and a black (BK) dot Dt-TG is not formed, it is possible to prevent the unformed dot Dt-Tg from being recognized as "dot omission" and to prevent degradation of the image quality of an image to be formed on the recording paper P.

Further, in the present embodiment, the increase amount Q-D (Q-CY, Q-MG, and Q-YL) of an ink ejected from the nozzle N-D is adjusted to be smaller than the ejection amount Q-TG of an ink which is expected to be ejected from the nozzle N-TG when ejection abnormality has not occurred in the complementing process. For this reason, it is possible to minimize the extent of an increase of the total amount of an ink ejected onto the recording paper P accompanied by the complementing process and to suppress the possibility that the image quality is degraded due to cockling of the recording paper P or bleeding of an ink compared to a case where the increase amount Q-D is equal to or more than the ejection amount Q-TG.

Moreover, in the present embodiment, it is possible to reduce the coating rate of an ink in the recording paper P in order to reduce the total amount of the ink ejected onto the recording paper P and possible to prevent the entire image from becoming dark compared to a case where the increase amount Q-D of an ink is adjusted to be smaller than the ejection amount Q-TG and the increase amount Q-D is equal to or more than the ejection amount Q-TG.

In addition, in the first embodiment described above, black (BK) corresponds to the "first color," one color from among three colors (CMY) of cyan (CY), magenta (MG), and yellow (YL) corresponds to the "second color," and any color between two colors obtained by removing the second color from the three colors (CMY) corresponds to the "third color." Moreover, the "second color" may be a color of an ink having a wavelength region with a widest width from among the wavelength regions λCY, λMG, and λYL.

In addition, in the first embodiment described above, the ejection abnormality nozzle N-TG that ejects a black (BK) ink which is the first color is an example of the "first nozzle" and the nozzle array Ln to which a nozzle N ejecting an ink having the first color belongs, and the nozzle array Ln-BK which is the nozzle array Ln to which the first nozzle belongs is an example of the "first nozzle group." Further, the nozzle array Ln having a nozzle N that ejects an ink having the second color is an example of the "second nozzle group" and the nozzle N-D belonging to the second nozzle group and complementing the first nozzle (nozzle N-TG) is an example of the "second nozzle." Further, the nozzle array Ln having a nozzle N that ejects an ink having the third color is an example of the "third nozzle group" and the nozzle N-D belonging to the third nozzle group and complementing the first nozzle (nozzle N-TG) is an example of the "third nozzle."

Further, the area R-BK on the recording head 30 in which the nozzle array Ln-BK which is an example of the first nozzle group is provided is an example of the "first area," an area (area in which the nozzle array Ln to which a nozzle N ejecting an ink having the second color belongs is provided from among the areas R-CY, R-MG, and R-YL) on the recording head 30 in which the nozzle array Ln corresponding to the second nozzle group is provided is an example of the "second area," and an area (area in which the nozzle array Ln to which a nozzle N ejecting an ink having the third color belongs is provided from among the areas R-CY, R-MG, and R-YL) on the recording head 30 in which the nozzle array Ln corresponding to the third nozzle group is provided is an example of the "third area."

Moreover, the wavelength region λBK which is a wavelength region of visible light absorbed by a black (BK) ink corresponding to the first color is an example of the "first wavelength region," the wavelength region of visible light absorbed by an ink having the second color is an example of the "second wavelength region," and the wavelength region of visible light absorbed by an ink having the third color is an example of the "third wavelength region."

Further, the ejection amount Q-TG as an amount of an ink which is expected to be ejected when it is assumed that ejection abnormality has not occurred in the first nozzle is an example of the "first ejection amount," the increase amount Q-D increased by the complementing process of an ink to be ejected from the second nozzle is an example of the "second ejection amount," and the increase amount Q-D increased by the complementing process of an ink to be ejected from the third nozzle is an example of the "third ejection amount."

B. SECOND EMBODIMENT

The ink jet printer 1 according to the first embodiment described above can eject four colors (CMYK) of inks which are cyan (CY), magenta (MG), yellow (YL), and black (BK) and the nozzle N-TG can be complemented with the nozzle N-CY ejecting a cyan (CY) ink, the nozzle N-MG ejecting a magenta (MG) ink, and the nozzle N-YL ejecting a yellow (YL) ink in a case where the ejection abnormality nozzle N-TG is a nozzle N ejecting a black (BK) ink. That is, in the first embodiment, the nozzle N-TG is limited to a nozzle N that ejects a black (BK) ink and the nozzles N-CY, N-MG, and N-YL are employed as the complementation nozzles N-D complementing the nozzle N-TG.

Meanwhile, in a second embodiment, even in a case where an ink jet printer 1 can eject an ink having a color other than four colors of CMYK and th ejection abnormality nozzle N-TG is a nozzle N that ejects an ink having a color other than black (BK), it is possible to perform the complementing process of complementing the nozzle N-TG with two or more nozzles N-D.

Hereinafter, the ink jet printer according to the second embodiment will be described with reference to FIGS. 28 to 32B.

In the second embodiment described below, elements whose operations and functions are the same as those in the first embodiment are denoted by the same reference numerals described above and the description thereof will not be repeated (the same applies to modification examples described below).

The ink jet printer according to the second embodiment can eject ten colors of ink in total which are four colors (hereinafter, referred to as "base colors") of black (BK), cyan (CY), magenta (MG), and yellow (YL), four special colors of green (GR), blue (BL), red (RD), and violet (VL), and two light colors of light cyan (CYL) and light magenta (MGL).

Specifically, the ink jet printer according to the second embodiment includes ten ink cartridges 31 corresponding to ten colors of inks and a recording head 30A having ten nozzle arrays Ln corresponding to ten colors of inks. Each nozzle array Ln includes M nozzles N similar to the first embodiment. That is, the ink jet printer according to the second embodiment includes 10M ejection units D (nozzles N). Further, a head unit included in the ink jet printer according to the second embodiment includes constituent elements of the 10M-th stage so as to correspond to the 10M ejection units D.

In this manner, the ink jet printer according to the second embodiment is configured in the same manner as the ink jet printer 1 according to the first embodiment except that the recording head 30A is included in place of the recording head 30, ten ink cartridges 31 corresponding to ten colors of inks are included, and a head unit having constituent elements of the 10M-th stage is included in place of the head unit 5 (see FIGS. 14 and 18) having constituent elements of the 4M-th stage.

Further, an ink having a light color is an ink whose weight ratio of coloring components, which express colors included in all inks, is small compared to an ink having a basic color or an ink having a special color, that is, an ink whose weight ratio of water or other solvent components other than the coloring components included in all inks is large.

Specifically, a light cyan (CYL) ink is an ink (ink whose weight ratio of the solvent components is increased) whose weight ratio of the coloring components is reduced with respect to a cyan (CY) ink and a light magenta (MGL) ink is an ink (ink whose weight ratio of the solvent components is increased) whose weight ratio of the coloring components is increased with respect to a magenta (MG) ink.

Figure 28:
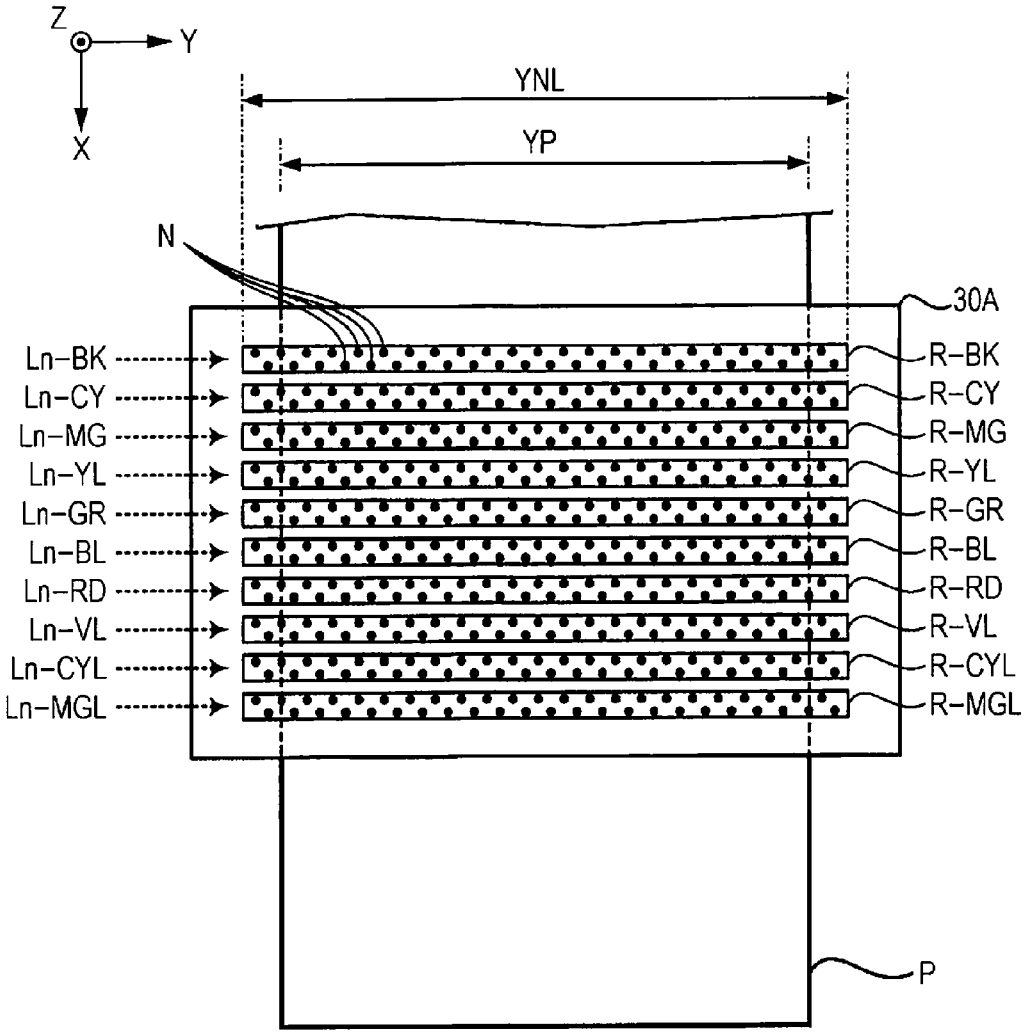
FIG. 28 is a plan view illustrating an arrangement example of nozzles in a recording head according to a second embodiment of the invention.

FIG. 28 is an explanatory diagram for describing arrangement of 10M nozzles provided in the recording head 30A in a case where the ink jet printer according to the second embodiment is seen in a plan view.

As illustrated in FIG. 28, instead of the nozzle arrays Ln-BK, Ln-CY, Ln-MG, and Ln-YL, ten nozzle arrays Ln formed of a nozzle array Ln-GR having M nozzles N that eject a green (GR) ink which are arranged in a nozzle forming area R-GR (area R-GR); a nozzle array Ln-BL having M nozzles N that eject a blue (BL) ink which are arranged in a nozzle forming area R-BL (area R-BL); a nozzle array Ln-RD having M nozzles N that eject a red (RD) ink which are arranged in a nozzle forming area R-RD (area R-RD); a nozzle array Ln-VL having M nozzles N that eject a violet (VL) ink which are arranged in a nozzle forming area R-VL (area R-VL); a nozzle array Ln-CYL having M nozzles N that eject a light cyan (CYL) ink which are arranged in a nozzle forming area R-CYL (area R-CYL); and a nozzle array Ln-MGL having M nozzles N that eject a light magenta (MGL) ink which are arranged in a nozzle forming area R-MGL (area R-MGL) are provided in the recording head 30 A.

The ink jet printer according to the second embodiment can perform the complementing process with respect to the ejection abnormality nozzle N-TG to eject an ink other than black (BK). Hereinafter, various aspects of the complementing process according to the second embodiment will be described.

First, the first aspect of the complementing process according to the second embodiment is a process of complementing the ejection abnormality nozzle N-TG that ejects an ink having a base color with two or more complementation nozzles N-D ejecting an ink having a special color.

Specifically, the ink jet printer according to the second embodiment performs the complementing process by employing a nozzle N that ejects a blue (BL) ink and a nozzle N that ejects a green (GR) ink as the nozzles N-D in a case where the nozzle N-TG is a nozzle N ejecting a cyan (CY) ink. In addition, for example, the ink jet printer according to the second embodiment performs the complementing process by employing a nozzle N that ejects a blue (BL) ink and a nozzle N that ejects a red (RD) ink as the nozzles N-D in a case where the nozzle N-TG is a nozzle N ejecting a magenta (MG) ink. Further, for example, the ink jet printer according to the second embodiment performs the complementing process by employing a nozzle N that ejects a red (RD) ink and a nozzle N that ejects a green (GR) ink as the nozzles N-D in a case where the nozzle N-TG is a nozzle N ejecting a yellow (YL) ink.

Next, the complementing process according to a second aspect of the second embodiment is a process of complementing the ejection abnormality nozzle N-TG that ejects an ink having a special color with two or more complementation nozzles N-D that eject an ink having a base color (see FIGS. 29 and 30 described below).

Specifically, the ink jet printer according to the second embodiment performs the complementing process by employing a nozzle N that ejects a magenta (MG) ink and a nozzle N that ejects a yellow (YL) ink as the nozzles N-D in a case where the nozzle N-TG is a nozzle N ejecting a red (RD) ink. Further, for example, the ink jet printer according to the second embodiment performs the complementing process by employing a nozzle N that ejects a cyan (CY) ink and a nozzle N that ejects a yellow (YL) ink as the nozzles N-D in a case where the nozzle N-TG is a nozzle N ejecting a green (GR) ink. Further, for example, the ink jet printer according to the second embodiment performs the complementing process by employing a nozzle N that ejects a cyan (CY) ink and a nozzle N that ejects a magenta (MG) ink as the nozzles N-D in a case where the nozzle N-TG is a nozzle N ejecting a blue (BL) ink. Further, for example, the ink jet printer according to the second embodiment performs the complementing process by employing a nozzle N that ejects a cyan (CY) ink and a nozzle N that ejects a magenta (MG) ink as the nozzles N-D in a case where the nozzle N-TG is a nozzle N ejecting a violet (VL) ink.

In addition, the complementing process according to a third aspect of the second embodiment is a complementing process in which the complementation nozzle N-D ejecting a light color of ink is employed instead of the complementation nozzle N-D ejecting a base color of ink (see FIG. 31 described below).

Specifically, the ink jet printer according to the second embodiment can perform the complementing process in which a nozzle N ejecting a light cyan (CYL) ink is employed instead of a nozzle N ejecting a cyan (CY) ink as the nozzle N-D and can perform the complementing process in which a nozzle N ejecting a light magenta (MGL) ink is employed instead of a nozzle N ejecting a magenta (MG) ink as the nozzle N-D.

Hereinafter, several aspects among various aspects of the complementing process according to the second embodiment will be described with reference to FIGS. 29 to 32B.

Figure 29:
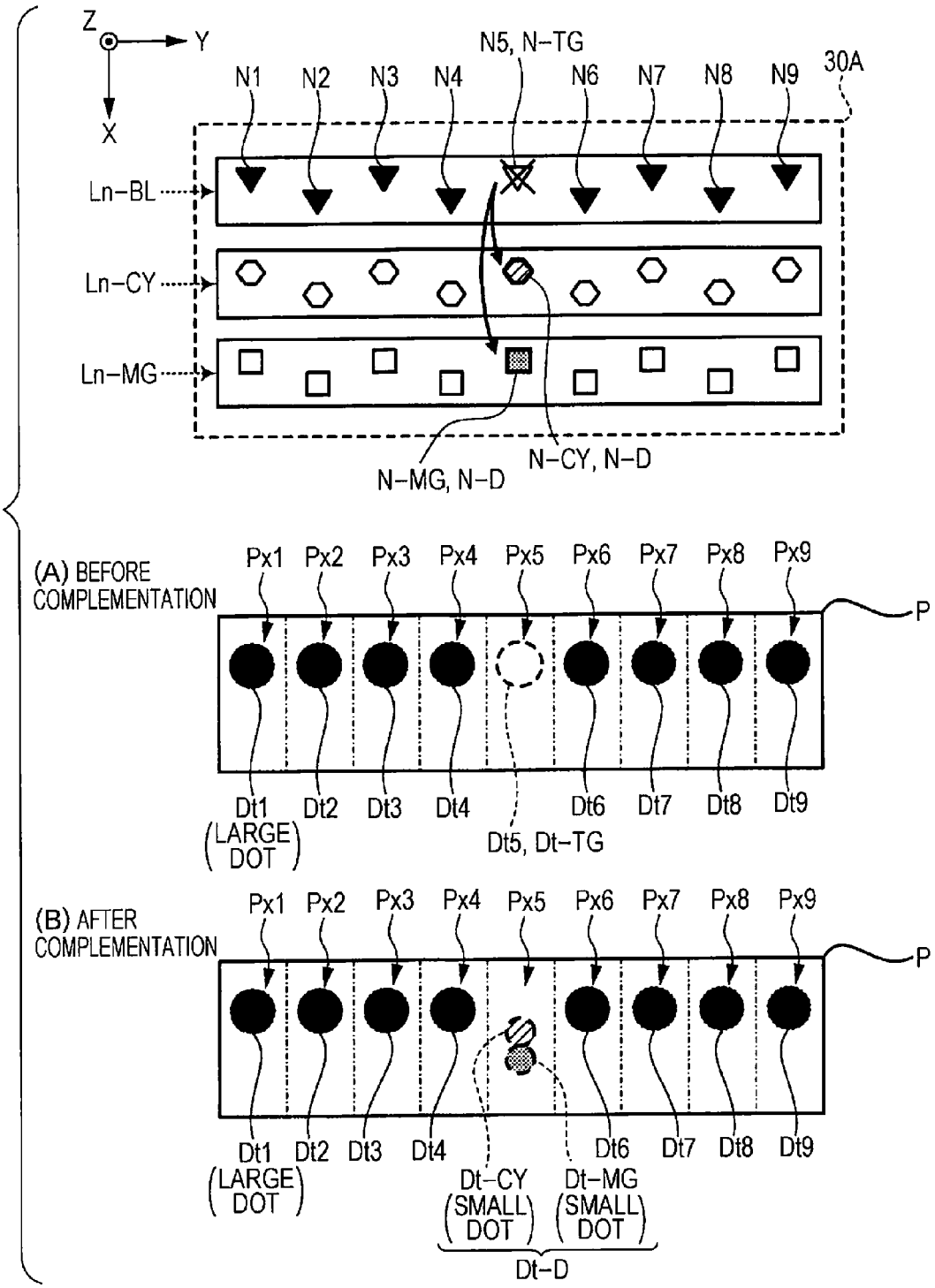
FIG. 29 is an explanatory diagram for describing a complementing process according to the second embodiment.
Figure 30:
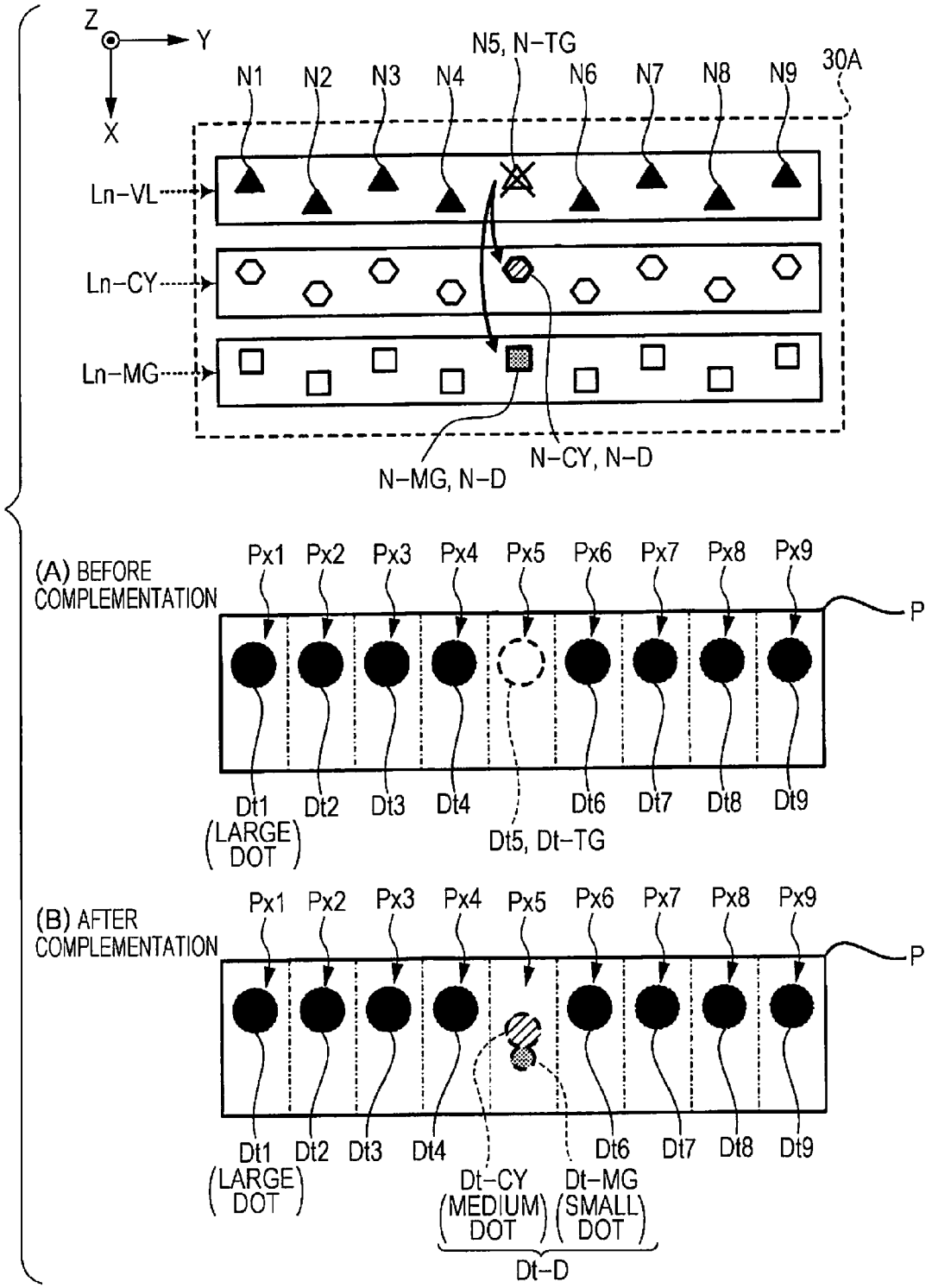
FIG. 30 is an explanatory diagram for describing the complementing process according to the second embodiment.
Figure 31:
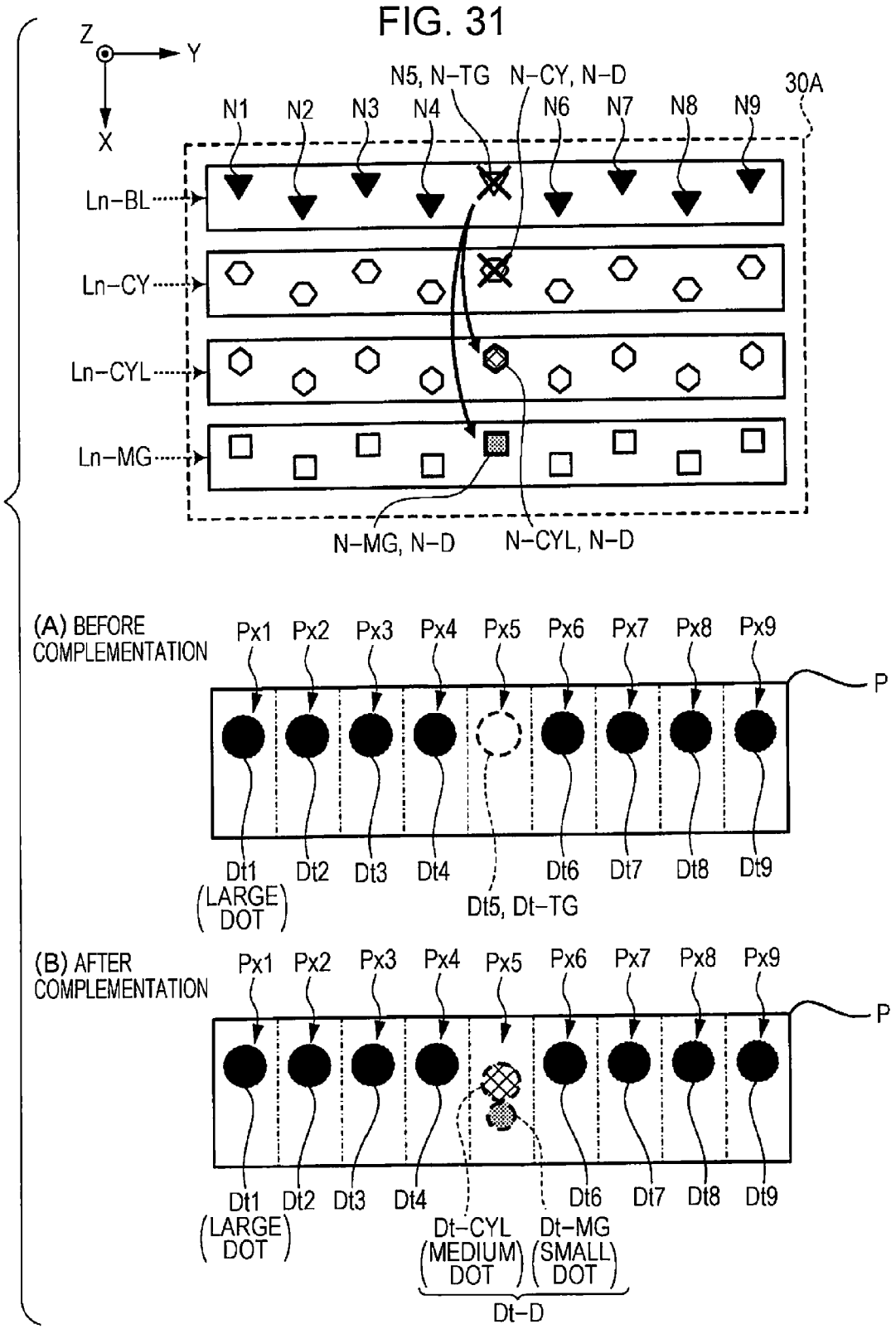
FIG. 31 is an explanatory diagram for describing the complementing process according to the second embodiment.

In addition, FIGS. 29 to 31 illustrate only some of the nozzle arrays Ln among ten nozzle arrays Ln related to the complementing process. Further, FIGS. 29 to 31 illustrate a case where each nozzle array Ln includes nine nozzle arrays N (that is, M is 9).

FIG. 29 is an explanatory diagram for describing the complementing process of complementing the ejection abnormality nozzle N-TG ejecting a blue (BL) ink with the nozzle N-CY ejecting a cyan (CY) ink and the nozzle N-MG ejecting a magenta (MG) ink among the above-described complementing processes according to the second aspect.

As illustrated in FIG. 29, in a case where a nozzle N5 ejecting a blue (BL) ink is the ejection abnormality nozzle N-TG, two complementation dots Dt-D which are a small-sized dot Dt-CY formed by a cyan (CY) ink ejected from the nozzle N-CY and a small-sized dot Dt-MG formed by a magenta (MG) ink ejected from the nozzle N-MG are formed by performing the complementing process instead of a large-sized dot Dt-TG which is expected to be formed by the nozzle N-TG.

That is, FIG. 29 illustrates a case where the increase amount Q-D of a cyan (CY) ink to be ejected from the nozzle N-CY is substantially the same as the increase amount Q-D of a magenta (MG) ink to be ejected from the nozzle N-MG.

FIG. 30 is an explanatory diagram for describing the complementing process of complementing the ejection abnormality nozzle N-TG ejecting a violet (VL) ink with the nozzle N-CY ejecting a cyan (CY) ink and the nozzle N-MG ejecting a magenta (MG) ink among the above-described complementing processes according to the second aspect.

As illustrated in FIG. 30, in a case where a nozzle N5 ejecting a violet (VL) ink is the ejection abnormality nozzle N-TG, two complementation dots Dt-D which are a medium-sized dot Dt-CY formed by a cyan (CY) ink ejected from the nozzle N-CY and a small-sized dot Dt-MG formed by a magenta (MG) ink ejected from the nozzle N-MG are formed by performing the complementing process instead of a large-sized dot Dt-TG which is expected to be formed by the nozzle N-TG.

That is, FIG. 30 illustrates a case where the increase amount Q-D of a cyan (CY) ink to be ejected from the nozzle N-CY is larger than the increase amount Q-D of a magenta (MG) ink to be ejected from the nozzle N-MG.

Further, in FIG. 30, violet (VL) corresponds to the "first color," magenta (MG) corresponds to the "second color," and cyan (CY) corresponds to the "third color."

That is, in FIG. 30, the ejection abnormality nozzle N-TG that ejects a violet (VL) ink corresponds to the "first nozzle," the nozzle N-MG complementing the nozzle N-TG corresponds to the "second nozzle," the nozzle N-CY complementing the nozzle N-TG corresponds to the "third nozzle," the nozzle array Ln-VL to which the nozzle N-TG belongs is an example of the "first nozzle group," the nozzle array Ln-MG to which the nozzle N-MG belongs is an example of the "second nozzle group," the nozzle array Ln-CY to which the nozzle N-CY belongs is an example of the "third nozzle group," the wavelength region λVL described below corresponds to the "first wavelength region," the wavelength region λMG corresponds to the "second wavelength region," and the wavelength region A=corresponds to the "third wavelength region."

Further, in FIG. 30, the ejection amount Q-TG of the nozzle N-TG corresponds to the "first ejection amount," the increase amount Q-D (increase amount Q-MG) of the nozzle N-MG corresponds to the "second ejection amount," and the increase amount Q-D (increase amount Q-CY) of the nozzle N-CY corresponds to the "third ejection amount."

FIG. 31 is an explanatory diagram for describing the complementing process of complementing the ejection abnormality nozzle N-TG that ejects a blue (BL) ink with the nozzle N-CYL that ejects a light cyan (CYL) ink and the nozzle N-MG that ejects a magenta (MG) ink among the above-described complementing processes according to the third aspect.

As illustrated in FIG. 31, in a case where a nozzle N5 ejecting a blue (BL) ink is the ejection abnormality nozzle N-TG and ejection abnormality has occurred in the nozzle N-CY complementing the nozzle N-TG, the complementing process in which the nozzle N-CYL belonging to the nozzle array Ln-CYL corresponding to a light cyan (CYL) ink instead of the nozzle N-CY corresponding to a cyan (CY) ink as the complementation nozzle N-D is employed. In this manner, two complementation dots Dt-D which are a medium-sized dot Dt-CYL formed by a light cyan (CYL) ink ejected from the nozzle N-CYL and a small-sized dot Dt-MG formed by a magenta (MG) ink ejected from the nozzle N-MG are formed instead of a large-sized dot Dt-TG which is expected to be formed by the nozzle N-TG.

That is, FIG. 31 illustrates a case in which the increase amount Q-D of a light cyan (CYL) ink ejected from the nozzle N-CYL is larger than the increase amount Q-D of a magenta (MG) ink ejected from the nozzle N-MG.

In addition, in FIG. 31, blue (BL) corresponds to the "first color," light cyan (CYL) corresponds to the "second color," and magenta (MG) corresponds to the "third color."

That is, in FIG. 31, the ejection abnormality nozzle N-TG that ejects a blue (BL) ink corresponds to the "first nozzle," the nozzle N-CYL complementing the nozzle N-TG corresponds to the "second nozzle," the nozzle N-MG complementing the nozzle N-TG corresponds to the "third nozzle," the nozzle array Ln-BL to which the nozzle N-TG belongs is an example of the "first nozzle group," the nozzle array Ln-CYL to which the nozzle N-CYL belongs is an example of the "second nozzle group," the nozzle array Ln-MG to which the nozzle N-MG belongs is an example of the "third nozzle group," the wavelength region λBL described below corresponds to the "first wavelength region," the wavelength region λCYL described below corresponds to the "second wavelength region," and the wavelength region λMG described below corresponds to the "third wavelength region."

Further, in FIG. 31, the ejection amount Q-TG of the nozzle N-TG corresponds to the "first ejection amount," the increase amount Q-D (increase amount Q-CYL) of the nozzle N-CYL corresponds to the "second ejection amount," and the increase amount Q-D (increase amount Q-MG) of the nozzle N-MG corresponds to the "third ejection amount."

Figure 32A:
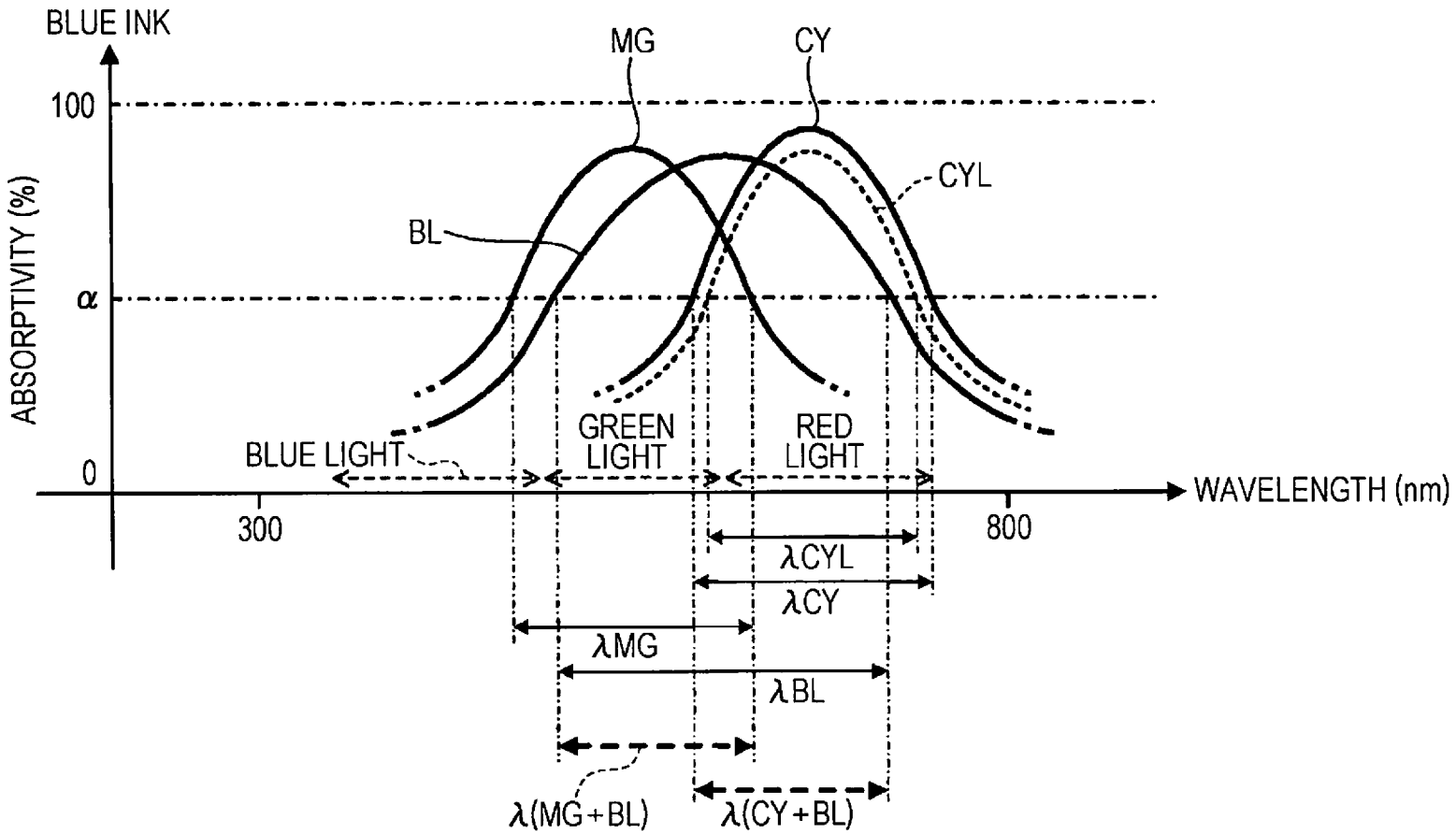
FIGS. 32A and 32B are explanatory diagrams for describing absorption characteristics using an ink.

FIGS. 32A and 323 are explanatory diagrams for describing the absorption characteristics of light of a blue (BL) ink and a violet (VL) ink.

As illustrated in FIG. 32A, since a blue (BL) ink absorbs green light and red light in visible light at a ratio equal to or more than a predetermined ratio α and reflects blue light, the color of the ink is recognized as blue (BL).

Hereinafter, a wavelength region of visible light absorbed by a blue (BL) ink is referred to as the wavelength region λBL. Further, a wavelength region in which the wavelength region λMG overlaps the wavelength region λBL is referred to as a wavelength region λ(MG+BL) and a wavelength region in which the wavelength region λCY overlaps the wavelength region λBL is referred to as a wavelength region λ(CY+BL).

In the present embodiment, the width of the wavelength region λ(MG+BL) is substantially the same as that of the wavelength region λ(CY+BL). Accordingly, an ink having absorption characteristics close to blue (BL) can be reproduced using the substantially the same amount of a magenta (MG) ink and a cyan (CY) ink.

For this reason, in the present embodiment, in a case where the nozzle N-TG that ejects a blue (BL) ink is complemented with the nozzle N-CY that ejects a cyan (CY) ink and the nozzle N-MG that ejects a magenta (MG) ink, the increase amount Q-D of a cyan (CY) ink ejected from the nozzle N-CY is adjusted to be substantially the same as the increase amount Q-D of a magenta (MG) ink ejected from the nozzle N-MG.

Figure 32B:
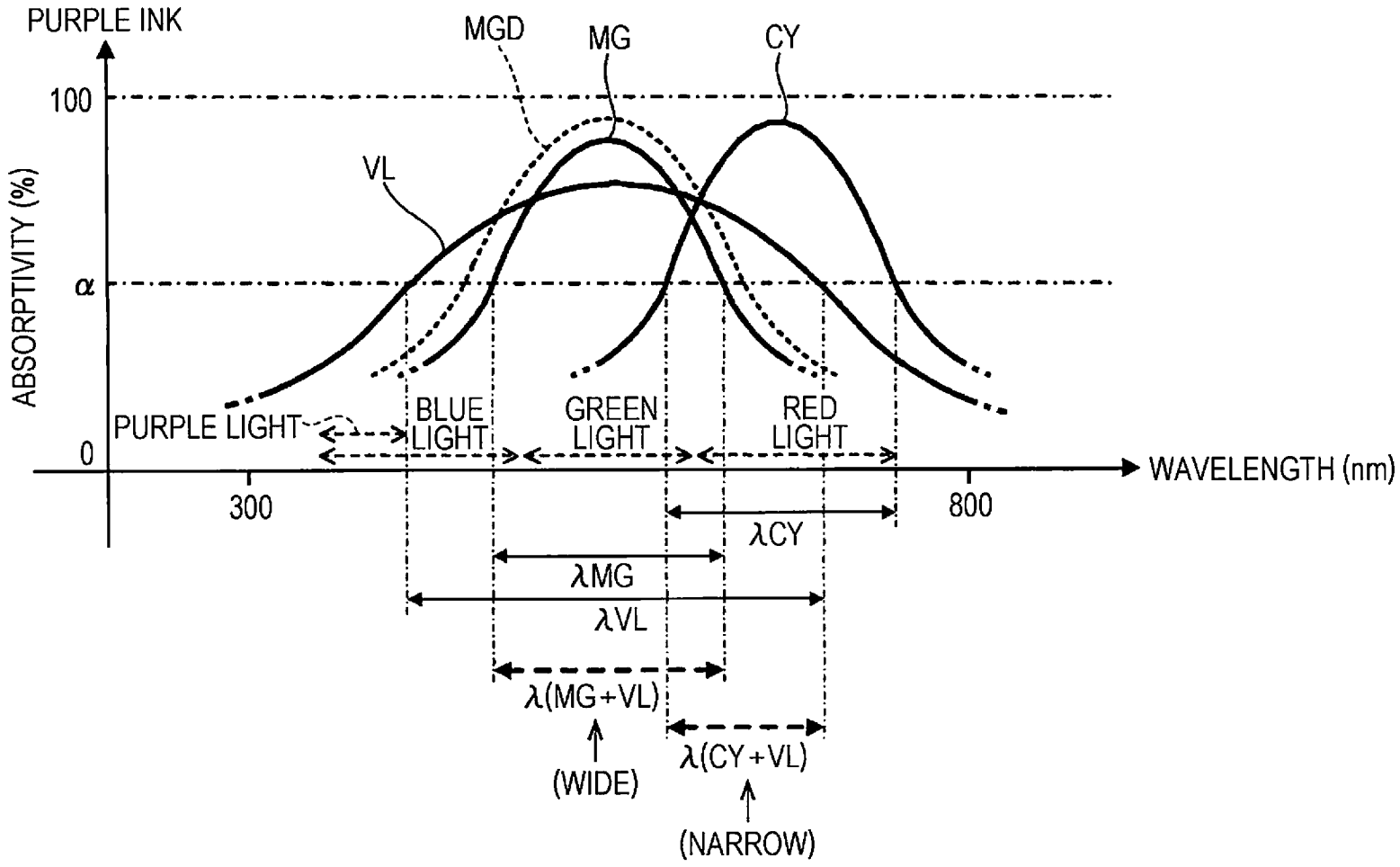

As illustrated in FIG. 32B, since a violet (VL) ink absorbs green light, red light, light having a wavelength other than blue light to violet light (light having a wavelength approximately 380 nm to 450 nm) at a ratio equal to or more than a predetermined ratio α and reflects violet light, the color of the ink is recognized as violet (VL).

Hereinafter, a wavelength region of visible light absorbed by a violet (VL) ink is referred to as the wavelength region λVL. Further, a wavelength region in which the wavelength region λMG overlaps the wavelength region λVL is referred to as a wavelength region λ(MG+VL) and a wavelength region in which the wavelength region λCY overlaps the wavelength region λVL is referred to as a wavelength region λ(CY+VL).

In the present embodiment, the width of the wavelength region λ(MG+VL) is larger than that of the wavelength region λ(CY+VL). Accordingly, an ink having absorption characteristics close to violet (VL) illustrated in FIG. 32B cannot be reproduced even when the same amount of a magenta (MG) ink and a cyan (CY) ink are used and an ink having absorption characteristics close to blue (BL) illustrated in FIG. 32A is reproduced.

When an ink having absorption characteristics close to violet (VL) is reproduced, a magenta (MG) ink is used with an amount larger than that of a cyan (CY) ink.

Even when a magenta (MG) ink is used with an amount larger than that of a cyan (CY) ink, light absorption characteristics of a magenta (MG) ink per unit volume are not changed. However, in the case where a magenta (MG) ink is used with an amount larger than that of a cyan (CY) ink, it is possible to increase the absorption rate of light using a magenta (MG) ink in a relative relationship with the light absorption characteristics of a cyan (CY) ink. Specifically, in the case where a magenta (MG) ink is used with an amount larger than that of a cyan (CY) ink, it is possible to consider that two dots Dt-D (Dt-CY and Dt-MG) are formed using an ink having a high light absorption rate than a magenta (MG) ink shown by a curve MG and having absorption characteristics shown by a curve MGD (see FIG. 32B). For this reason, an ink having absorption characteristics close to violet (VL) can be reproduced using a magenta (MG) ink with an amount larger than that of a cyan (CY) ink.

In this manner, in a case where a violet (VL) ink is reproduced using a magenta (MG) ink and a cyan (CY) ink, a magenta (MG) ink is used with an amount larger than that of a cyan (CY) ink when the width of the wavelength region λ(MG+VL) is wider than that of the wavelength region λ(CY+VL). For this reason, in a case where the nozzle N-TG that ejects a violet (VL) ink is complemented with the nozzle N-MG that ejects a magenta (MG) ink and the nozzle N-CY that ejects a cyan (CY) ink, the increase amount Q-D of a magenta (MG) ink ejected from the nozzle N-MG is adjusted to be larger than the increase amount Q-D of a cyan (CY) ink ejected from the nozzle N-CY.

Further, the wavelength region λ(MG+VL) is an example of a "first overlapping wavelength region" and the wavelength region λ(CY+VL) is an example of a "second overlapping wavelength region."

However, the absorption rate of light using a light cyan (CYL) ink is smaller than the absorption rate of light using a cyan (CY) ink. That is, as illustrated in FIG. 32A, the wavelength region λCYL of visible light absorbed by a light cyan (CYL) ink becomes narrower than the wavelength region λCY of visible light absorbed by a cyan (CY) ink.

Accordingly, an ink having absorption characteristics close to blue (BL) is not reproduced in some cases even the same amount of a light cyan (CYL) ink and a magenta (MG) ink are used. For this reason, in a case where an ink having absorption characteristics close to blue (BL) is reproduced, a light cyan (CYL) ink is used with an amount larger than that of a magenta (MG) ink.

The absorption rate of light using a light cyan (CYL) ink can be increased using a light cyan (CYL) ink with an amount larger than that of a magenta (MG) ink in a relative relationship with light absorption characteristics of a magenta (MG) ink. Specifically, an ink to be reproduced using substantially the same amount of a cyan (CY) ink and a magenta (MG) ink, that is, a blue (BL) ink can be reproduced using a light cyan (CYL) ink with an amount larger than that of a magenta (MG) ink.

In the present embodiment, in a case where the nozzle N-TG that ejects a blue (BL) ink is complemented with the nozzle N-CYL that ejects a light cyan (CYL) ink and the nozzle N-MG that ejects a magenta (MG) ink, the user can recognize that a blue (BL) dot Dt-TG is formed by adjusting the increase amount Q-D of a light cyan (CYL) ink ejected from the nozzle N-CYL to be larger than the increase amount Q-D of a magenta (MG) ink ejected from the nozzle N-MG.

That is, in a case where the nozzle N-TG is complemented with the nozzle N-D that ejects a light ink and the nozzle N-D that ejects an ink having a base color or a special color, it is possible to prevent degradation of the image quality caused by the complementing process by adjusting the increase amount Q-D of the ink in the nozzle N-D ejecting a light ink to be larger than the increase amount Q-D of the ink in the nozzle N-D ejecting an ink having a base color or a special color.

C. MODIFICATION EXAMPLE

The above-described respective aspects may be variously modified. Aspects of specific modifications will be exemplified below. Two or more aspects which are randomly selected from the following exemplified modifications may be appropriately combined with each other within the scope without mutual conflict.

Modification Example 1

In the above-described first embodiment, a case where the ink jet printer 1 can eject inks having four colors CMYK is exemplified. Further, in the above-described second embodiment, a case where the ink jet printer can eject inks having ten colors is exemplified, but the invention is not limited these aspects, and the ink jet printer may eject three or more colors of inks.

In this case, the recording head 30 (recording head 30A) may include three or more nozzle arrays Ln in one-to-one correspondence with three or more colors of inks.

Modification Example 2

In the above-described embodiments and Modification Example, the position of the ejection abnormality nozzle N-TG is substantially the same as the position of the complementation nozzle N-D, in the Y-axis direction, that complements the ejection abnormality nozzle N-TG, but the invention is not limited to the aspect and the position of the nozzle N-TG may be different from the position of the nozzle N-D in the Y-axis direction. That is, the nozzle N-D may be a nozzle N belonging to the nozzle array Ln which is different from that of the nozzle N-TG and may be a nozzle N ejecting an ink having a color different from that of the nozzle N-TG.

In this case, the nozzle N-D is a nozzle N for forming the dot Dt-D in place of the dot Dt-TG to be formed by the nozzle N-TG when ejection abnormality has occurred in the nozzle N-TG. For this reason, in a case where the amount of an ink ejected from the nozzle N-D is increased in the complementing process, it is preferable that the nozzle N-D may be a nozzle N present in a position close to the position of the nozzle N-TG in the Y axis direction to the extent that the user can recognize that the dot Dt-TG which is expected to be formed through ejection from the nozzle N-TG is formed.

For example, it is preferable that the nozzle N-D is a nozzle N in which the distance between the nozzle N-D and the nozzle N-TG in the Y axis direction is equal to or shorter that the distance from a nozzle N that belongs to the nozzle array Ln which is the same as that of the nozzle N-TG and is further adjacent to the nozzle N-TG in the Y axis direction than the adjacent nozzle which is adjacent to the nozzle N-TG in the Y axis direction. That is, it is preferable that the nozzle N-D is a nozzle N within the distance corresponding to two nozzles (two pitch) from the nozzle N-TG in the Y axis direction.

Modification Example 3

In the above-described embodiments and Modification Examples, the recording head 30 (recording head 30A) includes nozzle arrays Ln made by M nozzles N as nozzle groups (Ln-BK1 to Ln-YK2) formed in the nozzle forming area (area R-BK or the like) being arranged in a zigzag has been described, but the invention is not limited thereto and the M nozzles N constituting the nozzle groups may be arranged in any form in the nozzle forming area.

For example, M nozzles N constituting nozzle groups may be linearly arranged in one array in the nozzle forming area in the Y axis direction. Further, the M nozzles N constituting the nozzle groups may be arranged in a matrix in the nozzle forming area.

Modification Example 4

In the above-described embodiments and Modification Examples, the operation periods of the ink jet printer are formed of the unit operation period Tu for which the printing process is performed and the unit operation period Tu for which the ejection state determining process is performed, but the invention is not limited to the aspect and the printing process and the ejection state determining process may be performed at the same unit operation period Tu. That is, the operation periods of the ink jet printer may include a unit operation period Tu for which both of the printing process and the ejection state determining process are performed.

Figure 17:
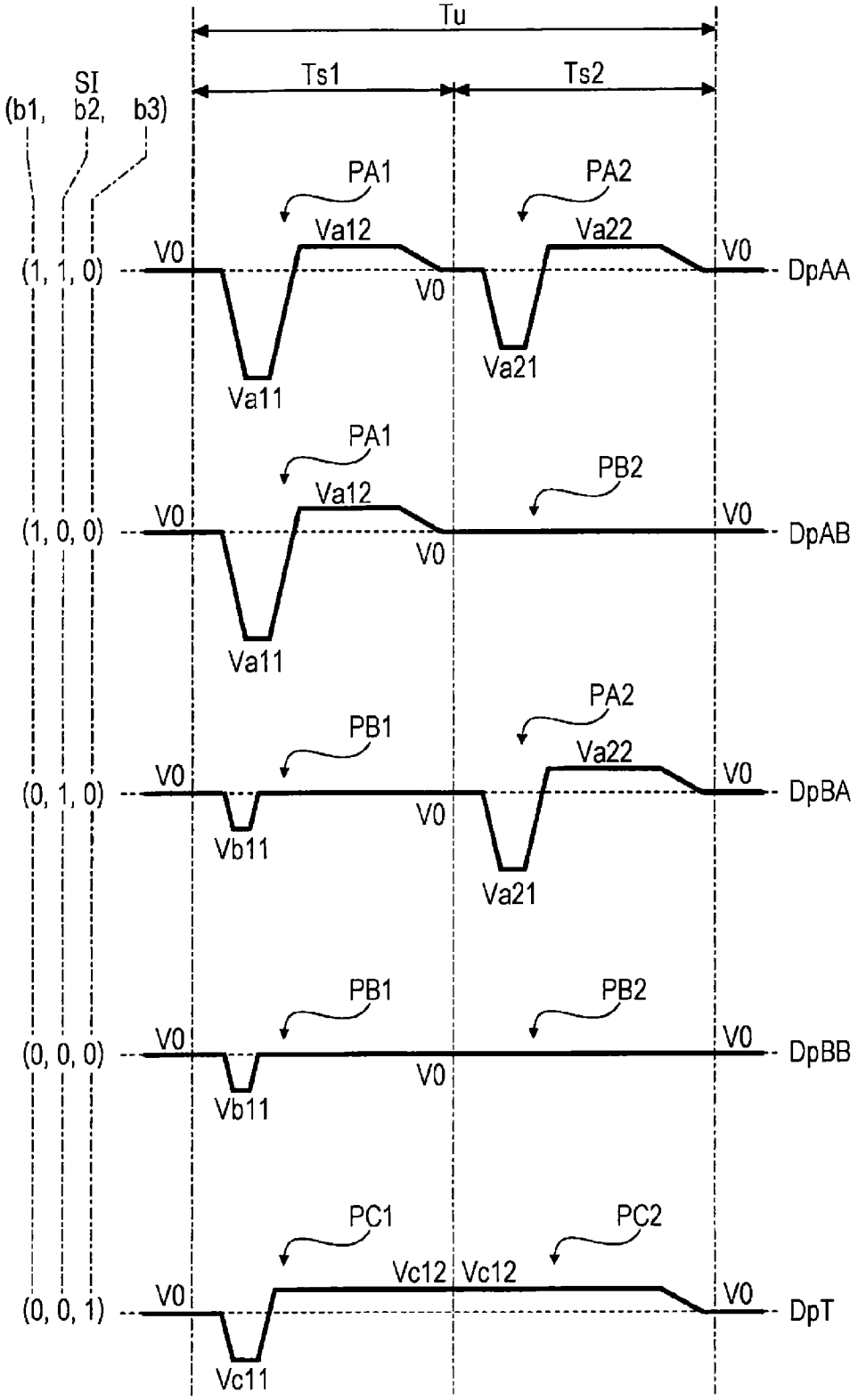
FIG. 17 is a timing chart illustrating a waveform of a driving signal.

In this case, for example, the ejection state determining process may be performed only with respect to non-recording ejection units D by supplying the driving signal Vin for printing to ejection units D forming dots and supplying the driving signal Vin for inspection having the waveform DpT instead of the driving signal Vin for printing having the waveform DpBB formed of the unit waveform PB1 and the unit waveform PB2 to non-recording ejection units D which do not form dots (see FIG. 17).

Further, the operation period of the ink jet printer may include the unit operation period Tu for which at least two processes are performed among the printing process, the ejection state determining process, and the complementing process.

Modification Example 5

The ink jet printer according to the above-described embodiments and Modification Examples forms images in each printing area by dividing the recording paper P into a plurality of printing areas and the margin area partitioning the plurality of printing areas during the printing process, but the invention is not limited to the aspect and one image may be formed in the entire recording paper P.

The recording paper P according to the above-described embodiments and Modification Examples has a long shape but may have a square shape such as A4-size paper. In this case, the transport mechanism 7 may supply a plurality sheets of recording paper P to the platen 74 intermittently when the printing process is performed. In this case, one image may be formed on one sheet of recording paper P during the printing process. Further, in this case, the unit operation period Tu for which the ejection state determining process is performed may be a period (that is, a period for which the recording paper P is not present on the platen 74) from when one sheet of recording paper P is supplied to the platen 74 to when different recording paper P is supplied to the platen 74 for the first time after the one sheet of recording paper P.

Modification Example 6

In the above-described embodiments and Modification Examples, the ejection state determining process is performed with the assumption of so-called "non-ejection inspection" which means that determination on the ejection state of an ink in the ejection unit D is made based on the residual vibration generated in the ejection unit D when the ejection unit D is driven such that the ink is not ejected, but the invention is not limited to the aspect and the ejection state determining process is performed with the assumption of so-called "ejection inspection" which means that determination on the ejection state of an ink in the ejection unit D is made based on the residual vibration generated in the ejection unit D when the ejection unit D is driven such that the ink is ejected.

For example, the following two aspects can be exemplified as specific aspects in a case of performing the ejection state determining process using the ejection inspection.

A first aspect of ejection inspection is an aspect in which the ejection state determining process is performed by detecting the residual vibration generated in the ejection unit D when an ejection unit D ejects an ink for forming an image shown by the print data PD during the printing process. In the first aspect of the ejection inspection, the ejection state determining process is performed during the printing process.

The second aspect of the ejection inspection is that, in the timing the printing process is not performed, the ejection state determining process is performed by ejecting the ink from the ejection unit D and detecting the residual vibration generated in the ejection unit D.

In the second aspect of the ejection inspection, when the ink ejected from the ejection unit D for the ejection state determining process is adhered to the printing area of the recording paper P, the image quality of an image to be formed on the recording paper P is degraded. For this reason, in the second aspect of the ejection inspection, it is necessary for the ink ejected from the ejection unit D for ejection state determining process by the ejection inspection not to impact on the printing area of the recording paper P. In order for the ink ejected from the ejection unit D not to impact on the printing area when the ejection state determining process is performed through ejection inspection, for example, the ink jet printer includes a moving mechanism that moves the carriage 32 on which the head unit 5 having the recording head 30 is mounted and then the ejection state determining process is performed after the carriage 32 is moved, by the moving mechanism, to a position in which the ink ejected from the ejection unit D is not impacted on the printing area. Further, in order for the ink ejected from the ejection unit D not to impact on the printing area during the ejection state determining process by the ejection inspection, for example, the ejection state determining process may be performed at the timing other than the unit operation period Tu for which the printing process is performed.

Modification Example 7

In the above-described embodiments and Modification Examples, the head driver 50 generates the driving signals Vin supplied to a plurality (4M) of ejection units D based on the same driving waveform signals Com, but the invention is not limited to the aspect.

The head driver 50 may generate the driving signals Vin for each nozzle group based on a plurality of driving waveform signals Com in one-to-one correspondence with the plurality of nozzle groups (nozzle array Ln). In this case, the control unit 6 may supply the plurality of driving waveform signals Com in one-to-one correspondence with the plurality of nozzle groups to the head driver 50. Moreover, in this case, the head driver 50 may include a plurality of driving signal generating units 51 in one-to-one correspondence with the plurality of nozzle groups. Further, in this case, the timing (that is, timing at which the latch signal LAT becomes active) at which the unit operation period Tu is started may be different for each nozzle group.

Further, the head driver 50 may generate driving signals Vin for each color of ink based on the plurality of driving waveform signals Com in one-to-one correspondence with plural colors of inks which can be ejected by the ink jet printer. In this case, the control unit 6 may supply the plurality of driving waveform signals Com in one-to-one correspondence with the plural colors of inks to the head driver 50. Further, in this case, the head driver 50 may include a plurality of driving signal generating units 51 in one-to-one correspondence with plural colors of inks.

Modification Example 8

In the above-described embodiments and Modification Examples, the ejection abnormality detecting unit 52 includes a plurality of ejection abnormality detection circuit CT in one-to-one correspondence with a plurality (4M) of ejection units D, but the invention is not limited to the aspect and the ejection abnormality detecting unit 52 may include at least one ejection abnormality detection circuit CT.

In this case, the control unit 6 selects one ejection unit D from the plurality of ejection units D as a target of the ejection state determining process during one unit operation period Tu for which the ejection state determining process is performed and may supply the switching control signal Sw to the switching unit 53 such that the selected ejection unit D is electrically connected with the ejection abnormality detection circuit CT.

Modification Example 9

In the above-described embodiments and Modification Examples, determination of the ejection state of an ink in the ejection unit D is performed by the ejection state determining unit 56, but the invention is not limited to the aspect, and the ejection state may be determined in the control unit 6.

In a case where the control unit 6 determines the ejection state, the ejection abnormality detection circuit CT may not include the ejection state determining unit 56, and a detection signal Tc generated by the detecting unit 55 may be output to the control unit 6.

Modification Example 10

In the above-described embodiments and Modification Examples, driving signal waveform signals Com includes three signals of Com-A, Com-B, and Com-C, but the invention is not limited to the aspect. The driving signal waveform signal Com may include one signal (for example, only Com-A) or may include two or more signals (for example, Com-A and Com-B).

For example, as illustrated in FIG. 25, in a case of printing eight kinds of dots Dt, the driving waveform signal Com may have four signals.

In addition, in the above-described embodiments and Modification Examples, the control unit 6 simultaneously supplies, as the driving waveform signals Com, the driving waveform signals Com-A and Com-B (hereinafter, referred to as driving waveform signals for printing) for generating a driving signal Vin for printing along with the driving waveform signal Com-C (hereinafter, referred to as a "driving waveform signal for inspection") for generating a driving signal Vin for inspection in each unit operation period Tu, and the invention is not limited to the aspect.

For example, in a case where the printing process is performed in a certain unit operation period Tu, the control unit 6 supplies the driving waveform signal Com (for example, the driving waveform signals Com including only Com-A and Com-B) including the driving waveform signals for printing and, in a case where the ejection state determining process is performed in a certain unit operation period Tu, the control unit supplies the driving waveform signals Com (for example, the driving waveform signal Com including only Com-C) including only the driving waveform signal for inspection. As described above, a waveform of each signal included in the driving waveform signals Com may be changed depending on the type of process performed in each unit operation period Tu.

Further, in the above-described embodiments and Modification Examples, the unit operation period Tu includes two control periods Ts which are the control period Ts1 and the control period Ts2, but the invention is not limited to the aspect and the unit operation period Tu may include one or more control periods Ts.

In addition, the number of bits of the printing signal SI is not limited to 3 bits, and may be appropriately determined according to the grayscale to be displayed or the number of signals included in the driving waveform signal Com.

Modification Example 11

In the above-described embodiments and Modification Examples, the ink jet printer ejects an ink from a nozzle N by vibrating the vibration plate 310 of the piezoelectric element 300, but the invention is not limited to the aspect. For example, a so-called thermal system in which an ink is ejected by heating a heating element (not illustrated) provided in the cavity 320 to generate bubbles in the cavity 320 and increasing the pressure in the inside of the cavity 320 may be employed.

Modification Example 12

In the above-described embodiments and Modification Example, the ink jet printer is a line printer, but the invention is not limited to the aspect and the ink jet printer may be a serial printer. That is, the ink jet printer may be an ink jet printer which includes the recording head 30 whose width in the Y axis direction is narrower than the width of the recording paper P and in which the main scanning direction of the carriage 32 is the Y axis direction.

What is claimed is:

1. A liquid ejecting apparatus that ejects a liquid onto a medium from a nozzle and forms an image on the medium, the apparatus comprising:

a head unit that includes a first nozzle group including first nozzles which eject a liquid having a first color, a second nozzle group including second nozzles which eject a liquid having a second color, and a third nozzle group including third nozzles which eject a liquid having a third color; and a control unit that controls driving of the head unit, wherein, when an amount of the liquid having the first color to be ejected from the first nozzles in order to form an image on the medium is a first ejection amount and an ejection state of the liquid ejected from the first nozzles is abnormal, the control unit increases the amount of the liquid having the second color ejected from the second nozzles by a second ejection amount which is smaller than the first ejection amount and increases the amount of the liquid having the third color ejected from the third nozzles by a third ejection amount which is smaller than the first ejection amount instead of allowing the first nozzles to eject the liquid having the first color.

2. The liquid ejecting apparatus according to claim 1, further comprising:

a transport mechanism that transports the medium in the first direction, wherein the first nozzle group is provided in a first area which extends in a second direction intersecting the first direction in the head unit, the second nozzle group is provided in a second area, which extends in the second direction, in the head unit, and the third nozzle group is provided in a third area, which extends in the second direction, in the head unit.

3. The liquid ejecting apparatus according to claim 1, wherein the liquid having the first color absorbs visible light in a first wavelength region at a predetermined rate or more, the liquid having the second color absorbs visible light in a second wavelength region at the predetermined rate or more, the liquid having the third color absorbs visible light in a third wavelength region at the predetermined rate or more, a part of the first wavelength region overlaps at least a part of the second wavelength region, and at least a part of the first wavelength region from which the second wavelength region is excluded overlaps at least a part of the third wavelength region.

4. The liquid ejecting apparatus according to claim 1, wherein the liquid having the first color absorbs visible light in a first wavelength region at a predetermined rate or more, the liquid having the second color absorbs visible light in a second wavelength region at the predetermined rate or more, the liquid having the third color absorbs visible light in a third wavelength region at the predetermined rate or more, and the control unit adjusts the second ejection amount to be larger than the third ejection amount when a wavelength region in which the first wavelength region overlaps the second wavelength region is wider than a wavelength region in which the first wavelength region overlaps the third wavelength region.

5. The liquid ejecting apparatus according to claim 1, wherein the control unit adjusts the second ejection amount to be larger than the third ejection amount when the weight ratio of a coloring material contained in the liquid having the second color being occupied in the liquid having the second color is smaller than the weight ratio of a coloring component contained in the liquid having the third color being occupied in the liquid having the third color.

6. A method of controlling a liquid ejecting apparatus that includes a-first nozzle group including first nozzles which eject a liquid having a first color, a second nozzle group including second nozzles which eject a liquid having a second color, and a third nozzle group including third nozzles which eject a liquid having a third color, the method comprising:

increasing, when an amount of the liquid having the first color to be ejected from the first nozzles in order to form an image on the medium is a first ejection amount and an ejection state of the liquid ejected from the first nozzles is abnormal, the amount of the liquid having the second color ejected from the second nozzles by a second ejection amount which is smaller than the first ejection amount and increasing the amount of the liquid having the third color ejected from the third nozzles by a third ejection amount which is smaller than the first ejection amount instead of allowing the first nozzles to eject the liquid having the first color.

7. A program for controlling a liquid ejecting apparatus that includes a first nozzle group including first nozzles which eject a liquid having a first color, a second nozzle group including second nozzles which eject a liquid having a second color, a third nozzle group including third nozzles which eject a liquid having a third color, and a computer, the program causing the computer to function as:

a control unit that increases, when an amount of the liquid having the first color to be ejected from the first nozzles in order to form an image on the medium is a first ejection amount and an ejection state of the liquid ejected from the first nozzles is abnormal, the amount of the liquid having the second color ejected from the second nozzles by a second ejection amount which is smaller than the first ejection amount and increases the amount of the liquid having the third color ejected from the third nozzles by a third ejection amount which is smaller than the first ejection amount instead of allowing the first nozzles to eject the liquid having the first color.

* * * * *